US010173294B2

(12) United States Patent
Owens, III

(10) Patent No.: US 10,173,294 B2
(45) Date of Patent: Jan. 8, 2019

(54) KNIFE STORAGE SYSTEM AND METHOD

(71) Applicant: William Thomas Owens, III, Owatonna, MN (US)

(72) Inventor: William Thomas Owens, III, Owatonna, MN (US)

( * ) Notice: Subject to any disclaimer, the term of this patent is extended or adjusted under 35 U.S.C. 154(b) by 153 days.

(21) Appl. No.: 15/181,051

(22) Filed: Jun. 13, 2016

(65) Prior Publication Data

US 2017/0355057 A1 Dec. 14, 2017

(51) Int. Cl.
*B24B 3/54* (2006.01)
*B26B 29/02* (2006.01)

(52) U.S. Cl.
CPC ..... *B24B 3/54* (2013.01); *B26B 29/025* (2013.01)

(58) Field of Classification Search
CPC ..... B26B 3/54; B26B 29/025
See application file for complete search history.

(56) References Cited

U.S. PATENT DOCUMENTS 2,512,237 A * 6/1950 Mravik ..... A45D 29/20 132/76.2
4,192,066 A * 3/1980 Tucker ..... F41B 13/00 30/162
4,523,379 A * 6/1985 Osterhout ..... B26B 29/025 30/151

* cited by examiner

*Primary Examiner* — John C Hong
(74) *Attorney, Agent, or Firm* — David W. Carstens; Jeffrey G. Degenfelder; Carstens & Cahoon, LLP

(57) ABSTRACT

A knife storage system and method is disclosed. The system and method utilize a resealable tube with retractable end-caps to safely store a hunting knife that may be contaminated with blood residue from a game animal that has been field dressed. The end-caps are configured with grooved cylinders to safely restrain a hunting knife so as to prevent dulling of the knife edge while simultaneously providing a fluid seal to the resealable tube to prevent contamination of the tube exterior with blood or other animal residue. Removal of both end-caps permits the tube and end-caps to be cleaned of game residue. Incorporated within the end-caps are integrated knife sharpening inserts comprised of ceramic and tungsten carbide to allow the knife to be safely sharpened in the field.

20 Claims, 64 Drawing Sheets

KNIFE STORAGE SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates to the safe storage and sharpening of knives. Without limitation of invention scope, the present invention provides a safe storage and sharpening mechanism for hunting knives that may be contaminated with blood and tissue residue from field-dressed game animals.

PRIOR ART AND BACKGROUND OF THE INVENTION

Overview (0100)-(0300)

Traditional techniques to field-dress gaming animals that have been recently killed typically involve the use of a hunting knife that is specifically designed for this purpose. Hunting knives (0101) of this and other types are typically stored in a scabbard (0102) as generally depicted in the examples provided in FIG. 1 (0100)-FIG. 3 (0300). This knife scabbard (0102) may have a variety of forms, but in typical hunting applications it is of open construction and formed using leather, plastic, or some other material that is softer than the steel used in the hunting knife (0101) so as to not dull the edge of the hunting knife (0101) when inserted and removed from the scabbard (0102).

Deficiencies in the Prior Art

For hunting applications, however, traditional scabbards suffer from the following deficiencies:

- Prior art scabbards will leak/drip blood associated with the game animal that has been field-dressed. This can present a serious contamination problem for automobiles, trucks, and other equipment in which the scabbard is transported.

- Prior art scabbards are difficult to clean and tend to collect blood contamination in areas that cannot be readily accessed, resulting in blood contamination that cannot be removed from the scabbard.
- Prior art scabbards can accidentally dislodge the knife and in some circumstances present a safety hazard.
- Prior art scabbards typically require the use of a separate honing stone or other sharpener to ensure that the hunting knife is sharp. As all outdoorsmen are aware, a dull knife represents a safety hazard when field-dressing game.
- Prior art knife storage systems do not incorporate integrated sharpening capability that may be safely employed in the field.

To date the prior art has not fully addressed these deficiencies.

OBJECTIVES OF THE INVENTION

Accordingly, the objectives of the present invention are (among others) to circumvent the deficiencies in the prior art and affect the following objectives:

(1) Provide for a knife storage system that is drip proof;
(2) Provide for a knife storage system that is easily cleaned;
(3) Provide for a knife storage system in which blood contamination may be easily removed;
(4) Provide for a knife storage system that permits field sharpening of hunting knives;
(5) Provide for a knife storage system is easily secured during transport; and
(6) Provide for a knife storage system that is easily transported.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

The present invention pertains to a system and method for safely storing and transporting hunting knives. The disclosed invention incorporates a double-ended cylindrical tube configured with resealable end-caps that are configured to capture a hunting knife by securing both the knife hilt and knife edge so as to prevent dulling of the hunting knife edge during transport. Various embodiments of the invention may incorporate retaining clips and/or sharpening attachments to permit safe in-field sharpening of the hunting knife.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
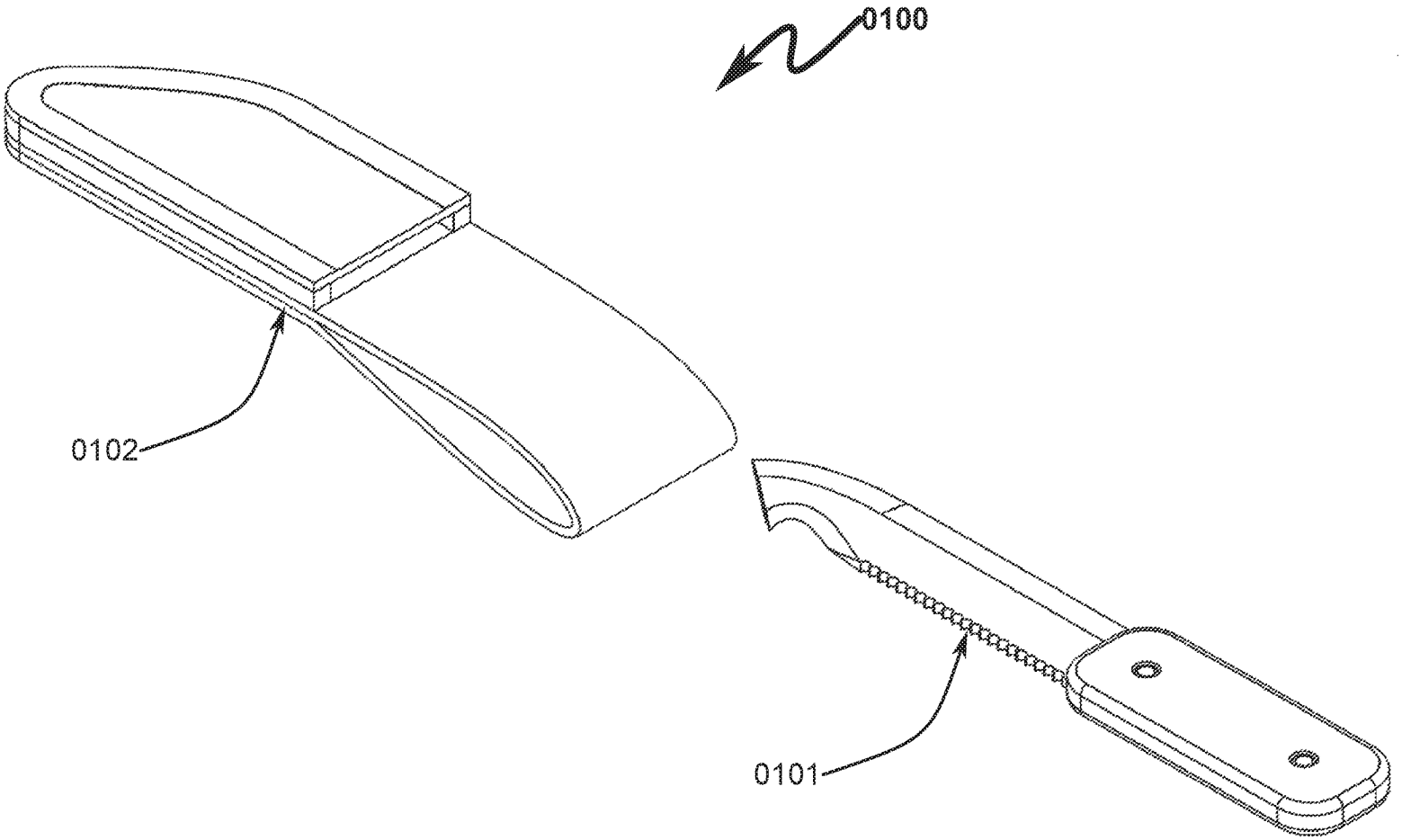
FIG. 1 Prior Art
FIG. 1 illustrates a perspective assembly view of prior art scabbard and hunting knife.
Figure 2:
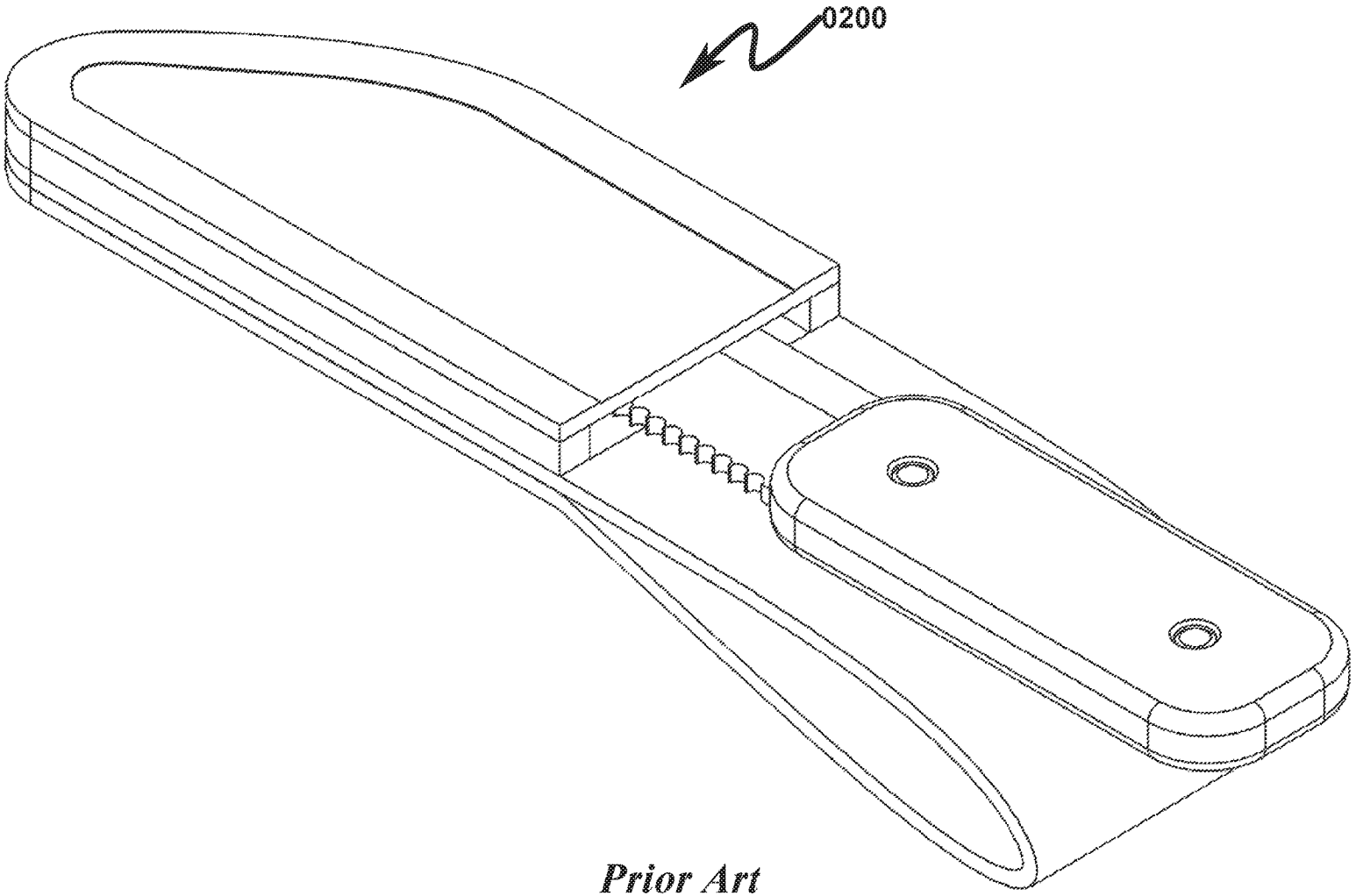
FIG. 2 Prior Art
FIG. 2 illustrates a perspective view of a prior art scabbard and hunting knife as assembled.
Figure 3:
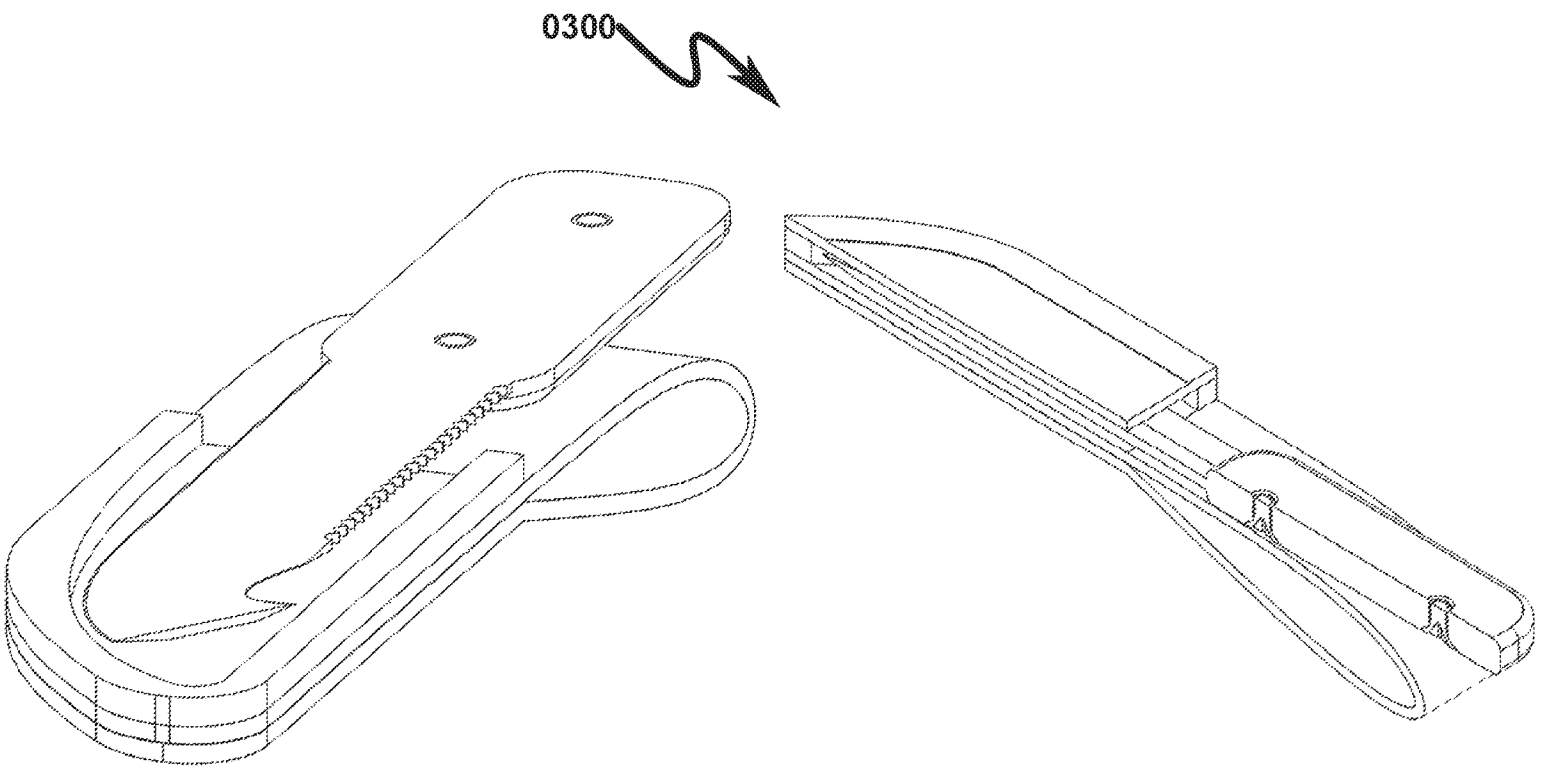
FIG. 3 Prior Art
FIG. 3 illustrates perspective sectional views of a prior art scabbard as assembled.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a KNIFE STORAGE SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

First Exemplary Embodiment Construction (0300)-(3200)

Overview

Figure 4:
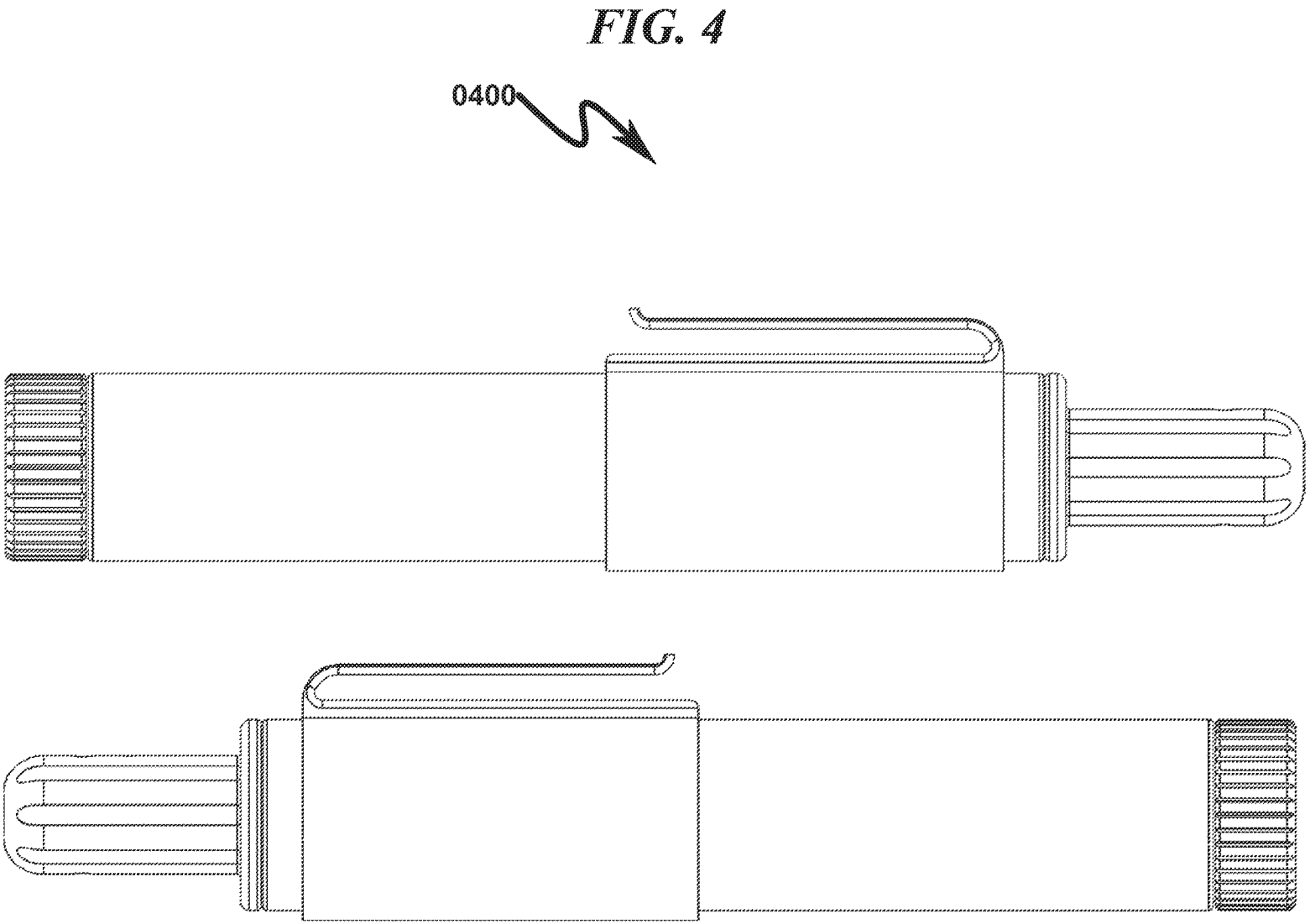
FIG. 4 illustrates front and back views of a preferred exemplary invention embodiment.
Figure 5:
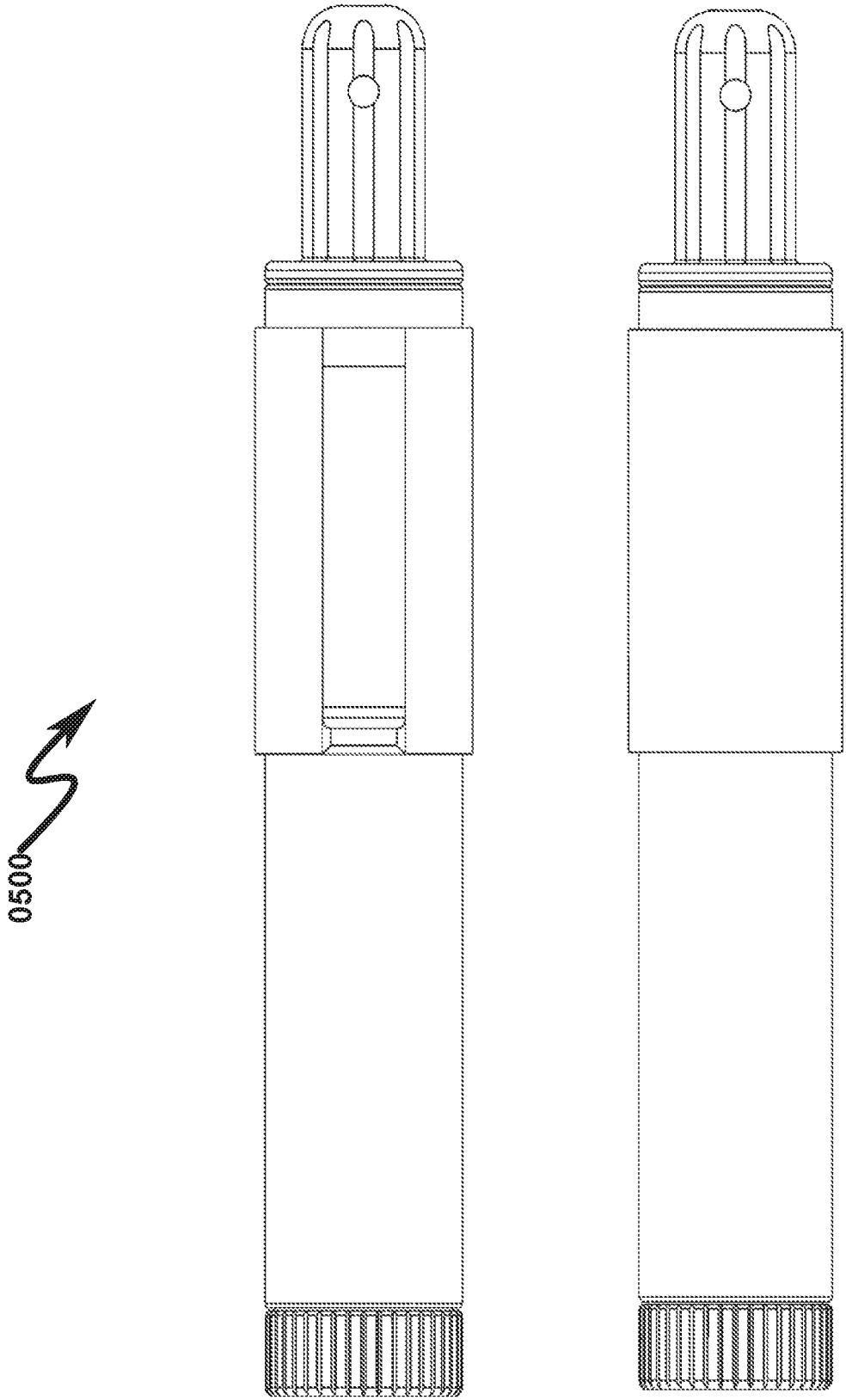
FIG. 5 illustrates top and bottom views of a preferred exemplary invention embodiment.
Figure 6:
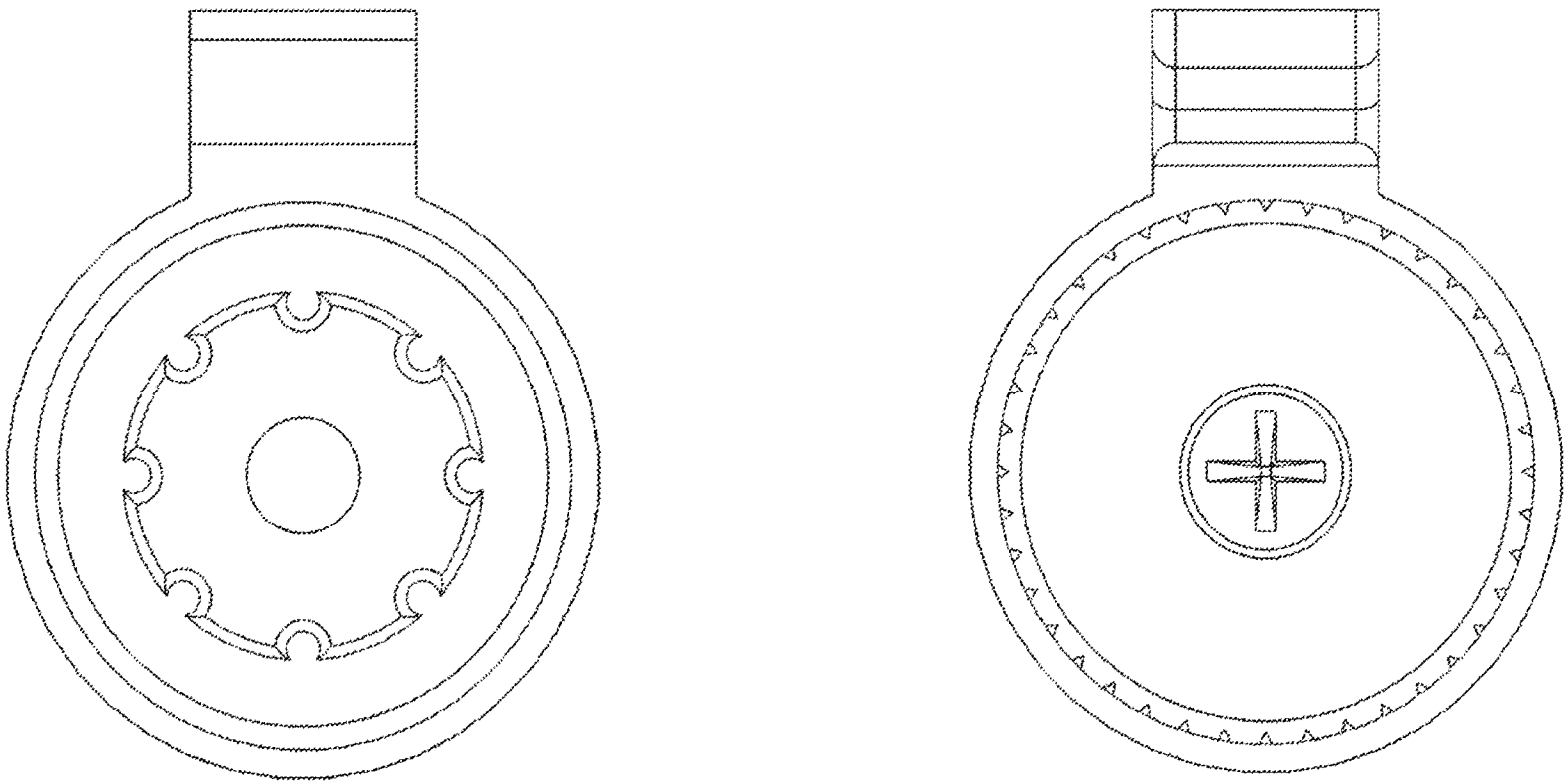
FIG. 6 illustrates left side and right side views of a preferred exemplary invention embodiment.
Figure 7:
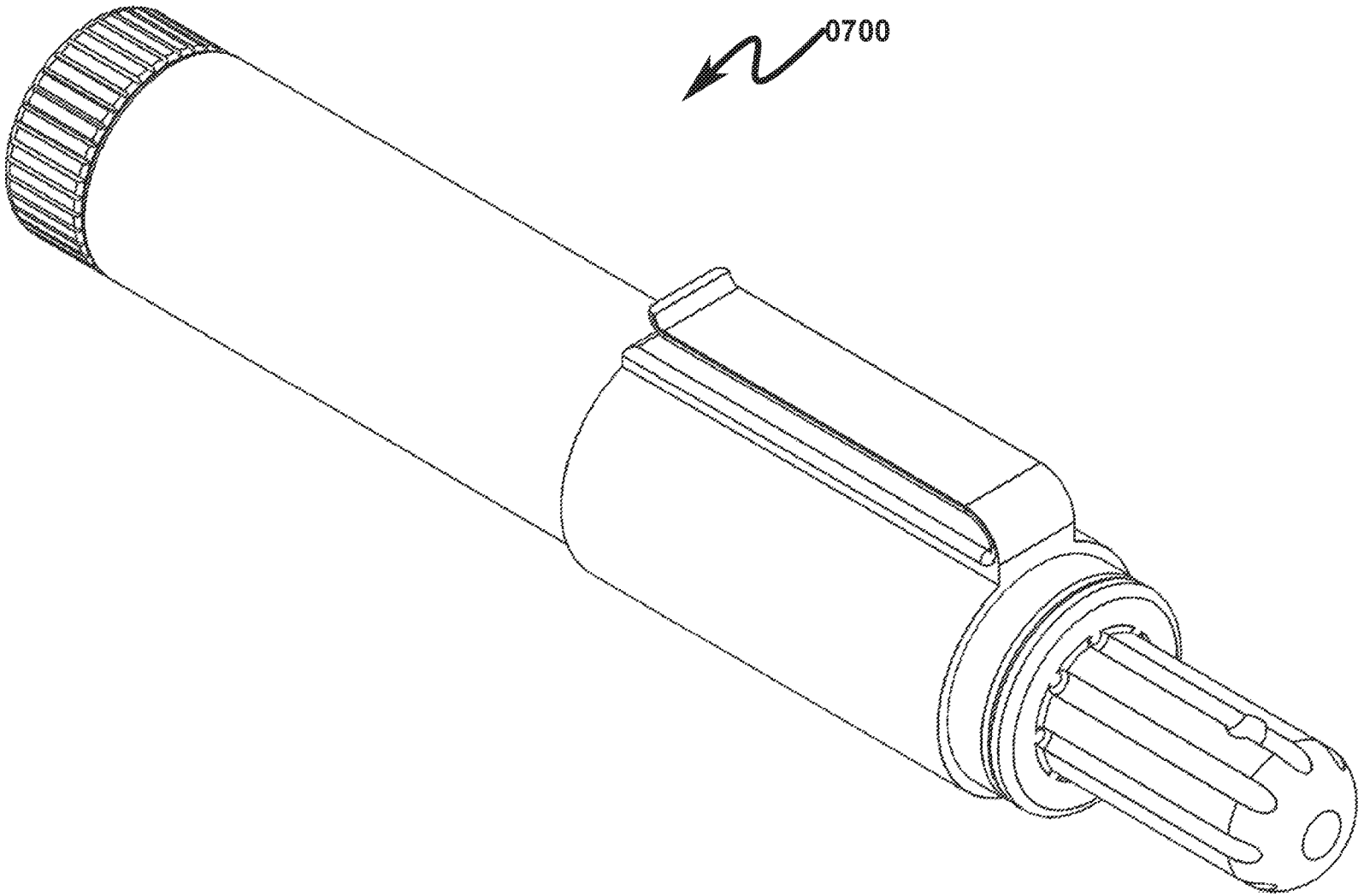
FIG. 7 illustrates a front top perspective view of a preferred exemplary invention embodiment.
Figure 8:
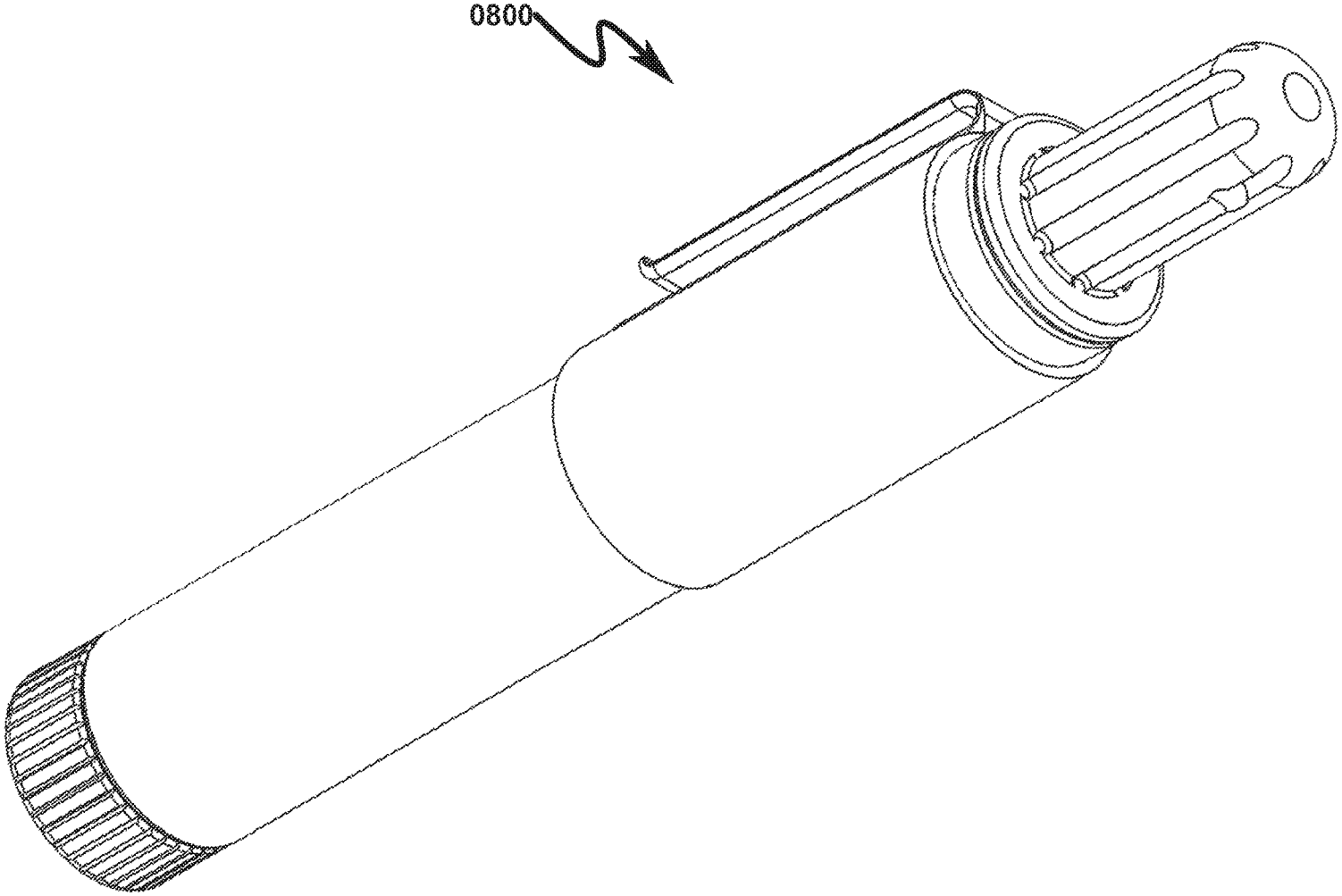
FIG. 8 illustrates a front bottom perspective view of a preferred exemplary invention embodiment.
Figure 32:
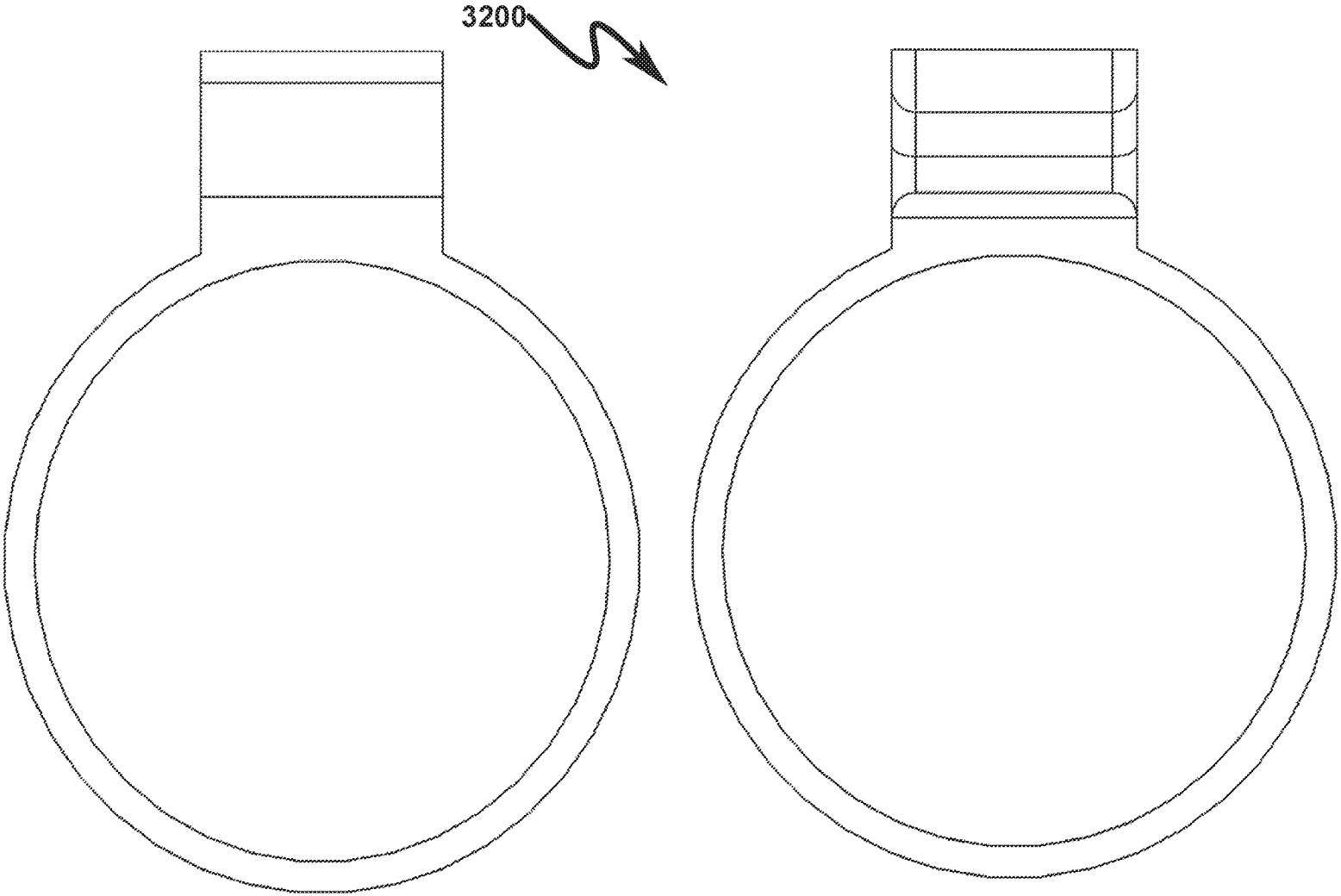
FIG. 32 illustrates right side and left side views of an exemplary retention clip used in many preferred invention embodiments.

Basic concepts taught by the present invention may be best illustrated by the first exemplary preferred embodiment depicted in FIG. 4 (0400)-FIG. 32 (3200). General views of this first exemplary embodiment are provided in FIG. 4 (0400)-FIG. 8 (0800) with assembly and detail views provided in FIG. 9 (0900)-FIG. 32 (3200).

General Construction

Figure 9:
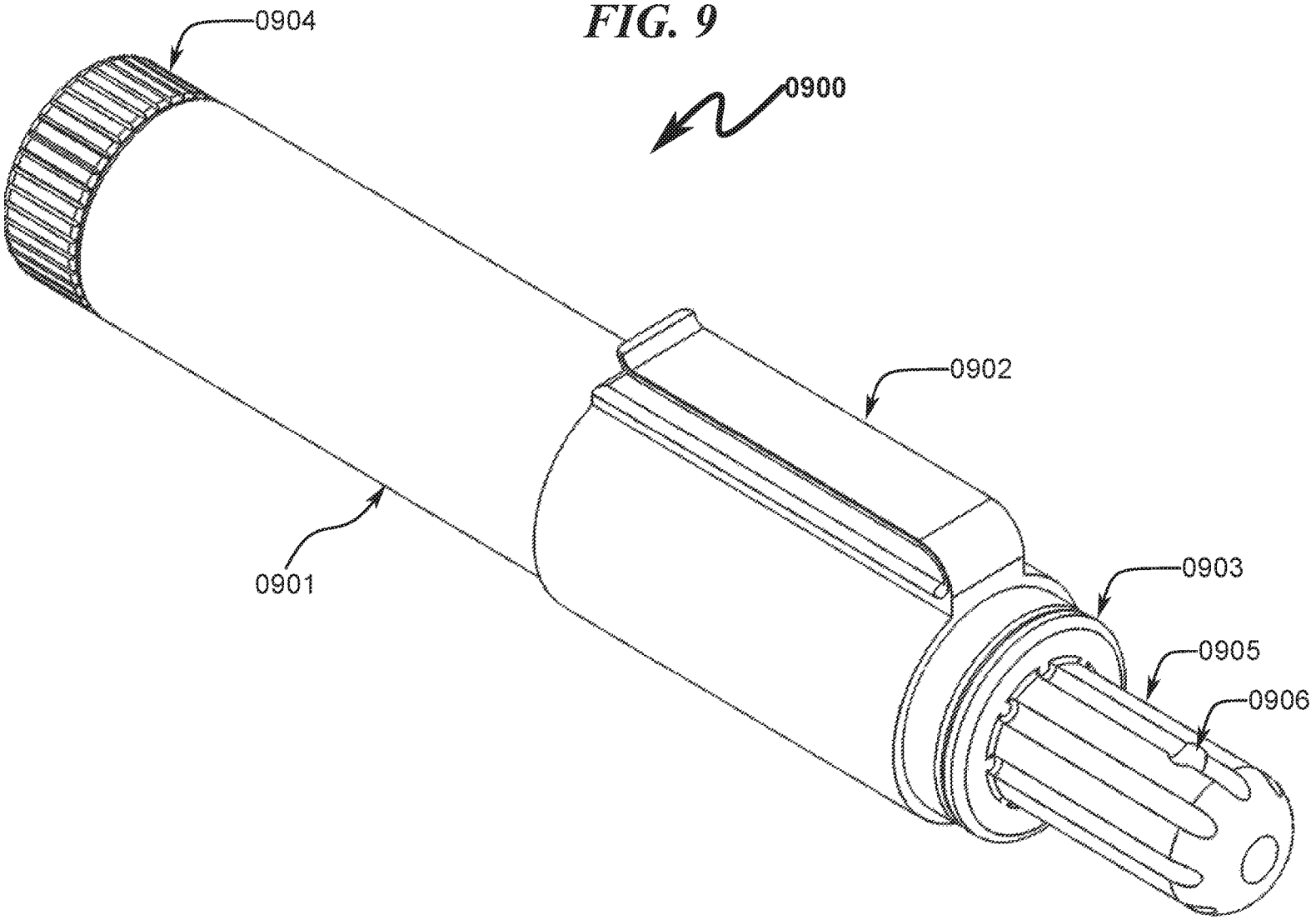
FIG. 9 illustrates a front top perspective assembly view of a preferred exemplary invention embodiment (full assembly)
Figure 10:
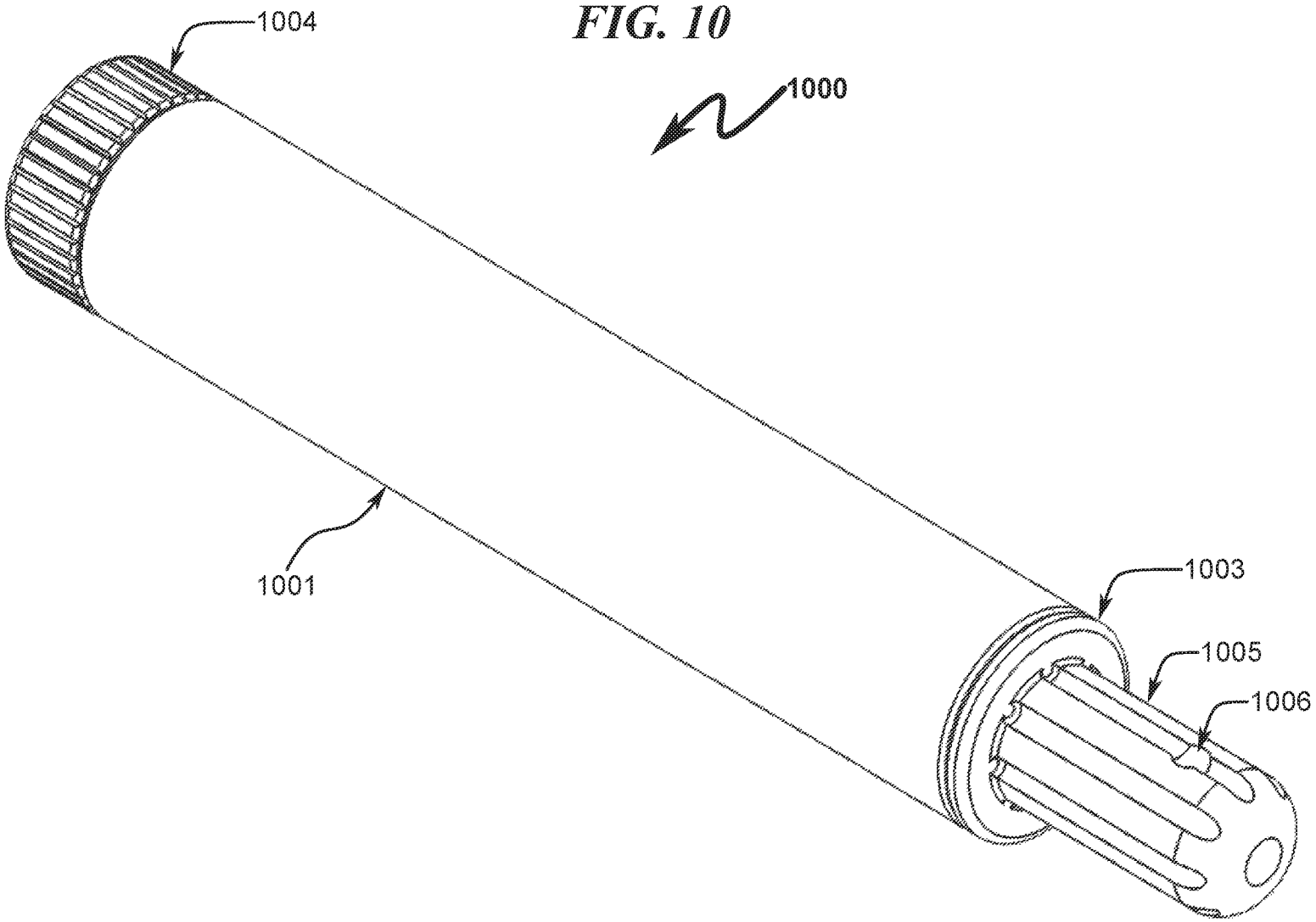
FIG. 10 illustrates a front top perspective assembly view of a preferred exemplary invention embodiment (retention clip hidden)
Figure 17:
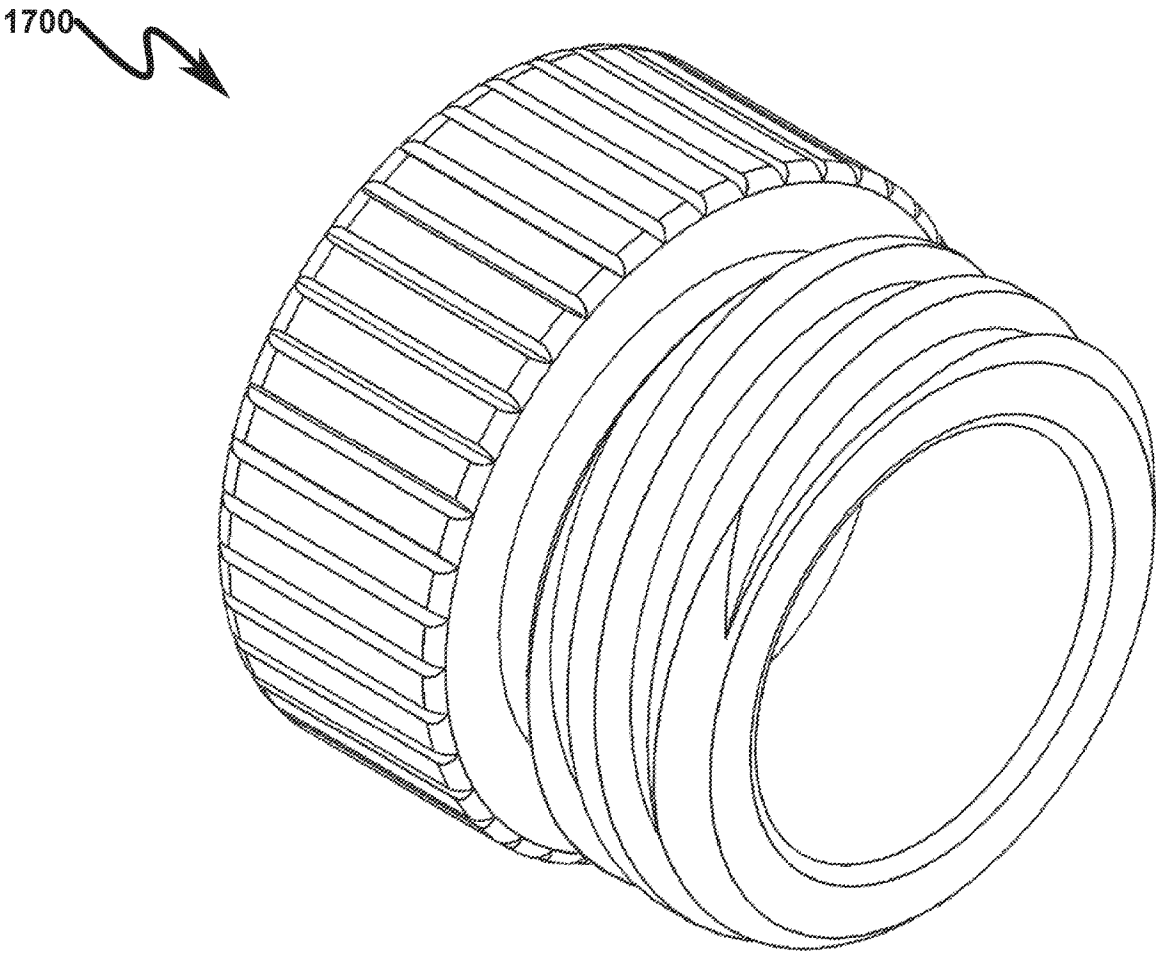
FIG. 17 illustrates a front top right perspective detail view of a preferred exemplary invention embodiment bottom end-cap.
Figure 18:
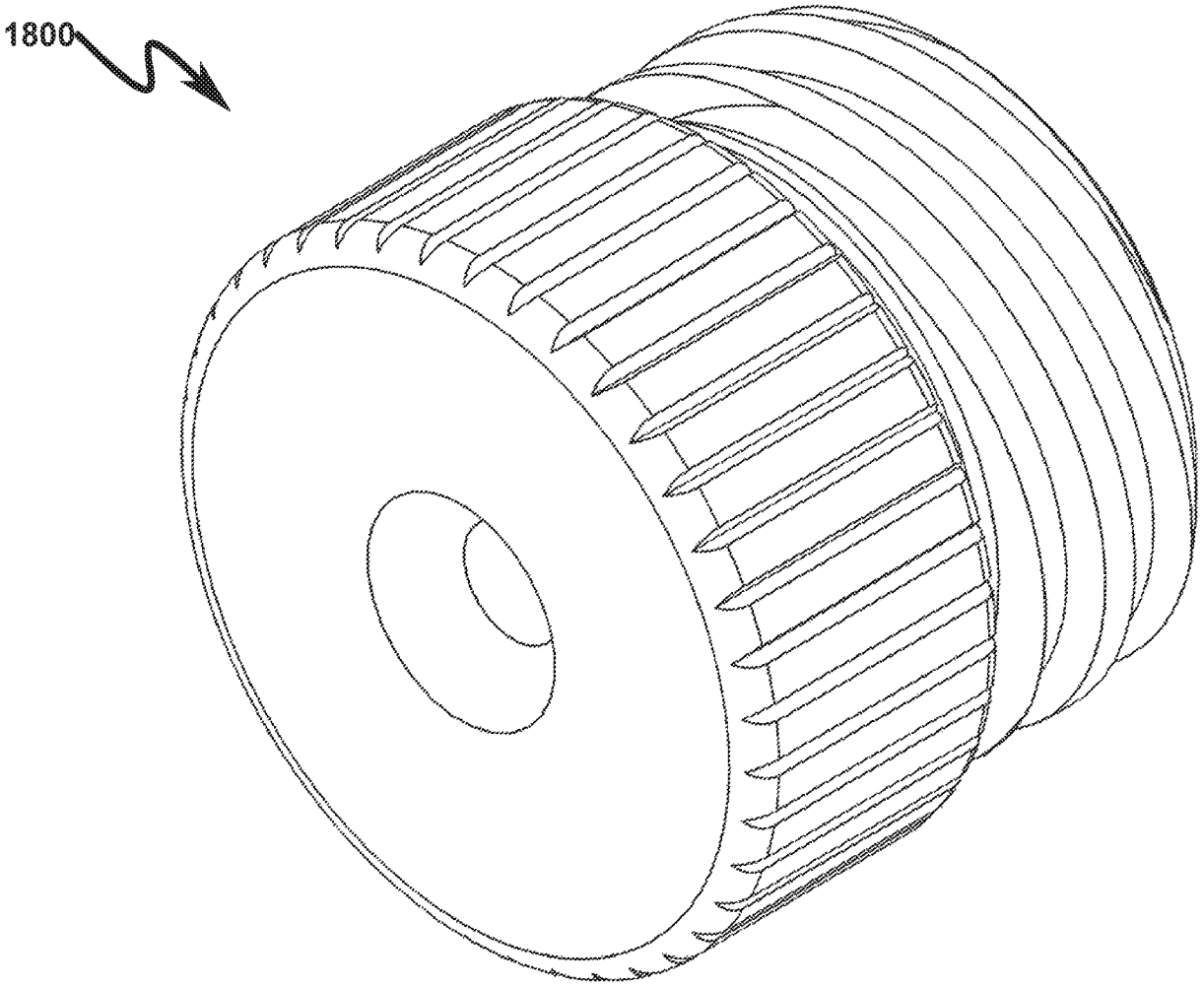
FIG. 18 illustrates a front top left perspective detail view of a preferred exemplary invention embodiment bottom end-cap.
Figure 19:
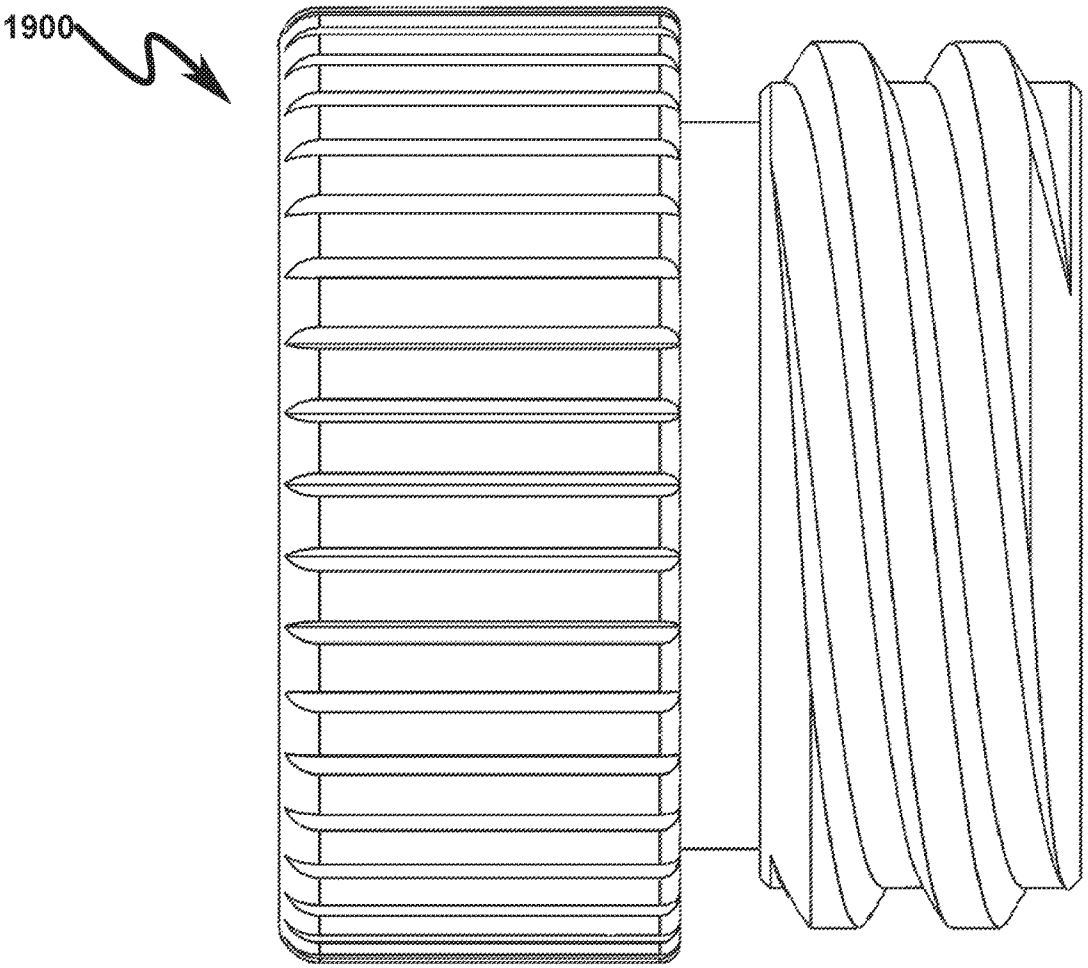
FIG. 19 illustrates a front view of a preferred exemplary invention embodiment bottom end-cap.
Figure 20:
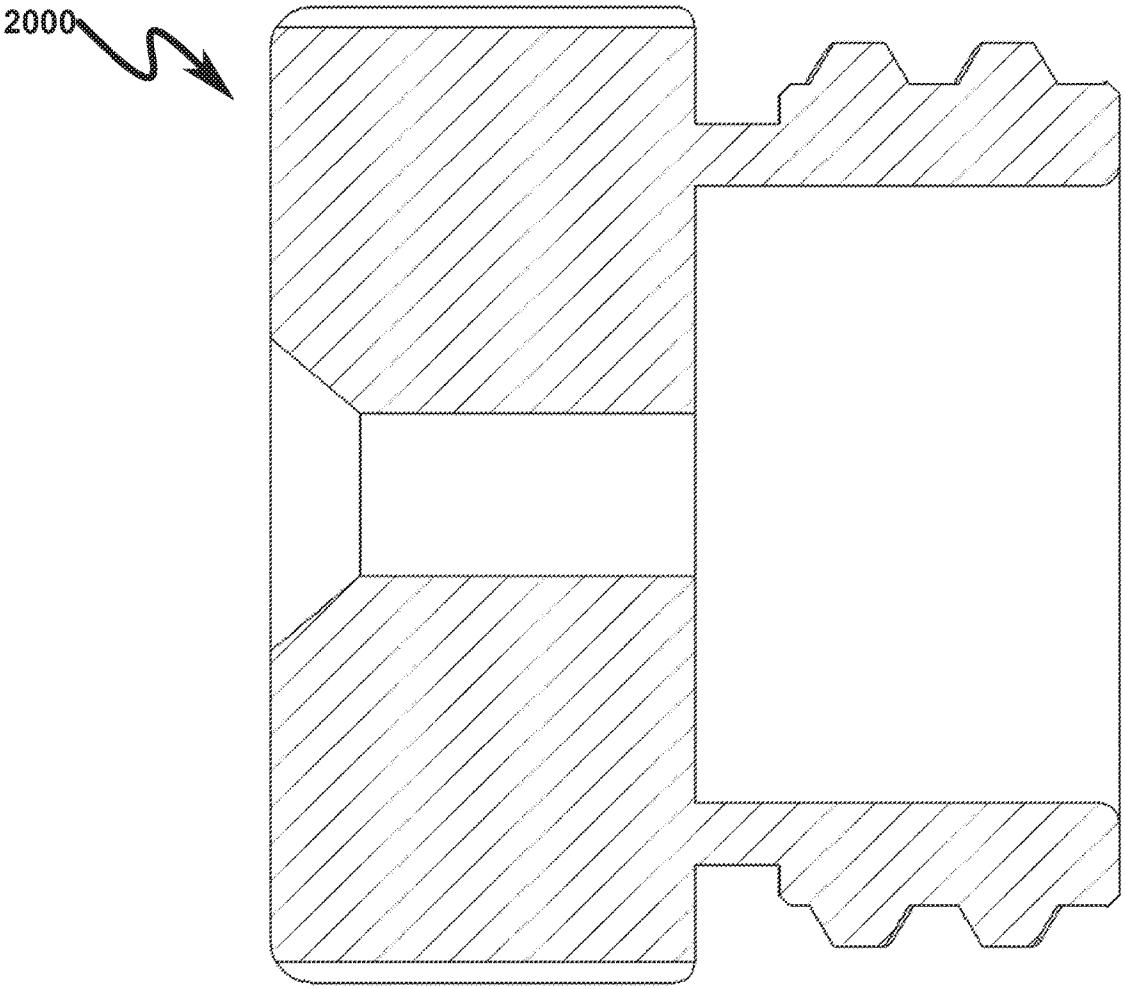
FIG. 20 illustrates a front section view of a preferred exemplary invention embodiment bottom end-cap.
Figure 21:
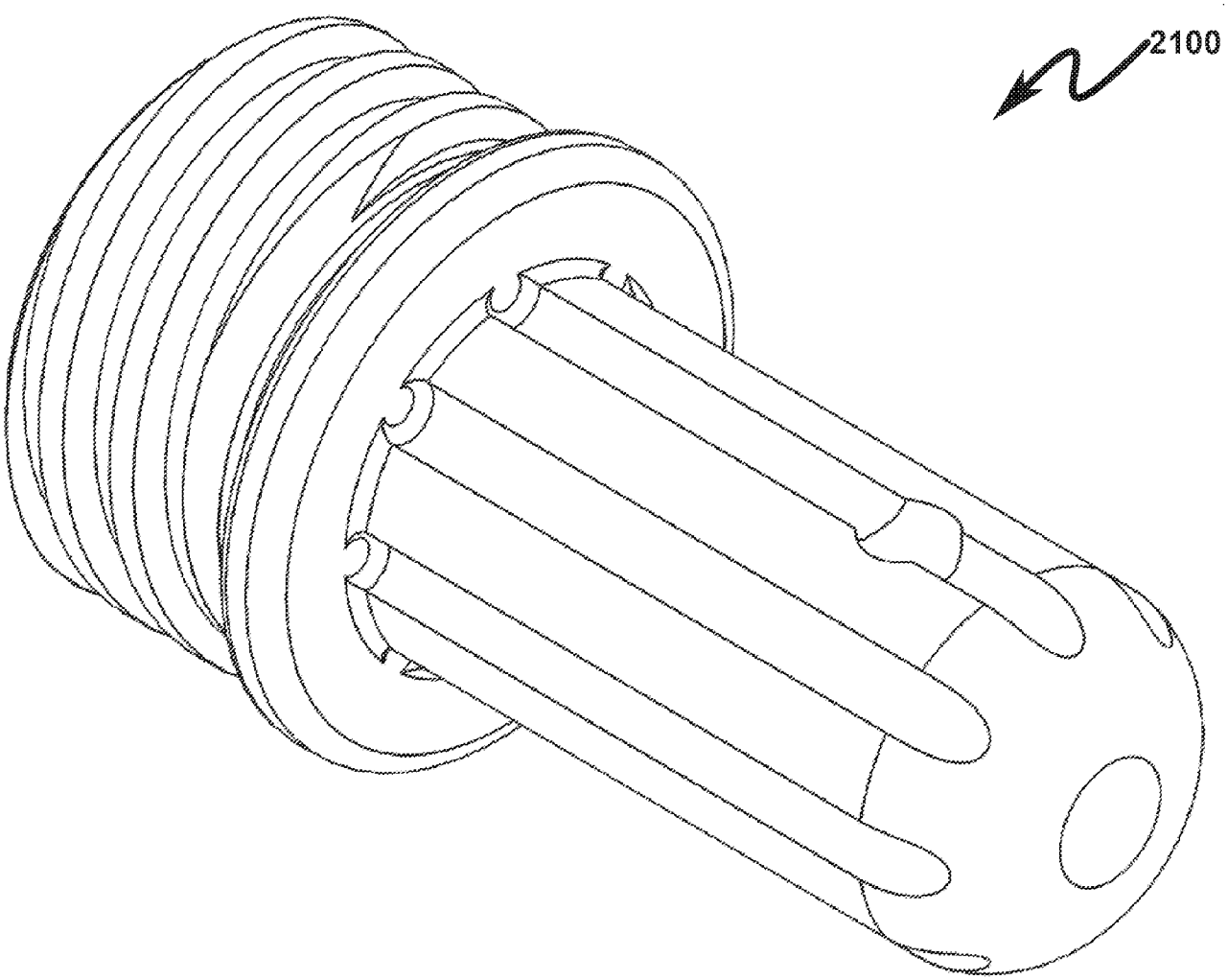
FIG. 21 illustrates a front top right perspective detail view of a preferred exemplary invention embodiment handle end-cap.
Figure 22:
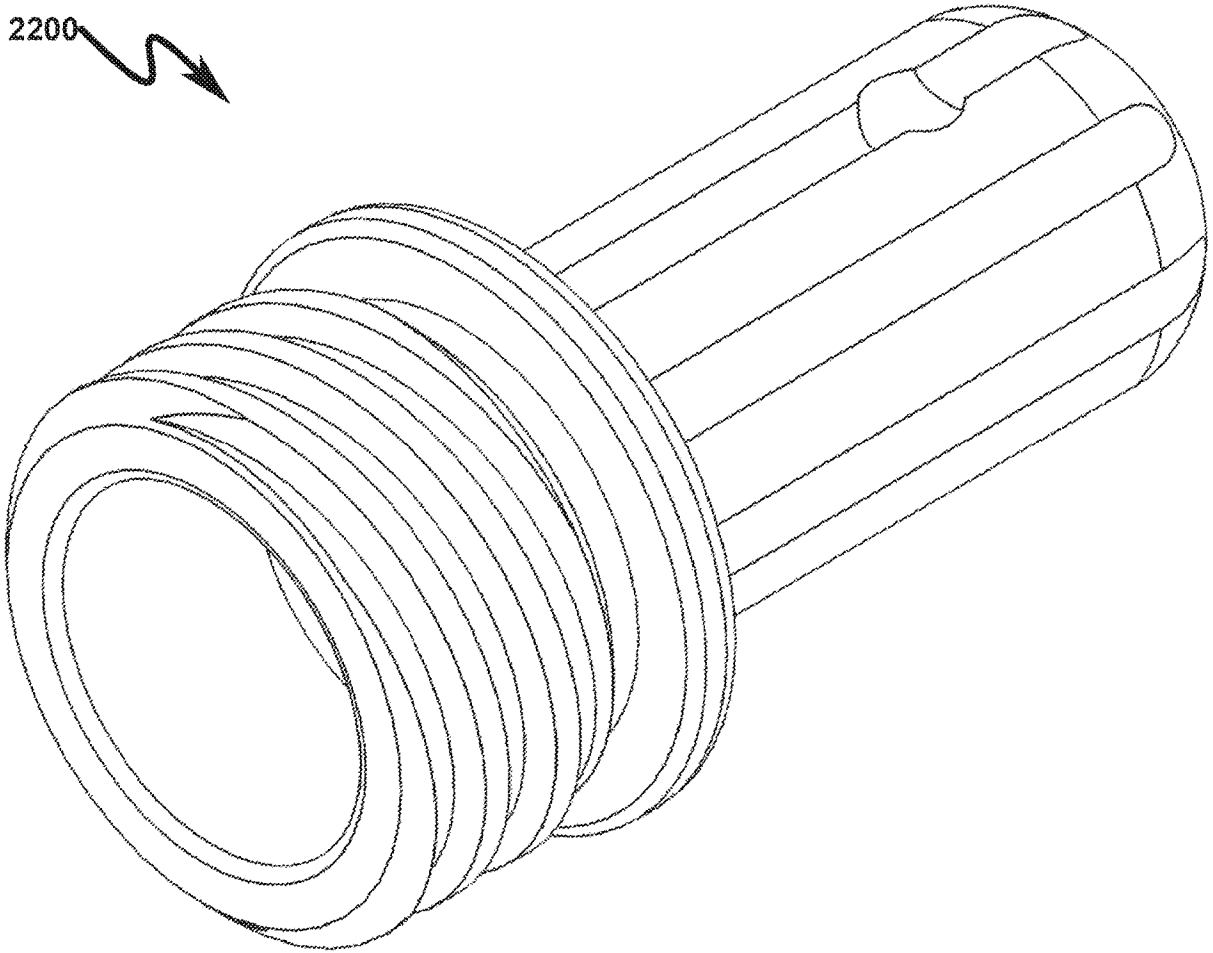
FIG. 22 illustrates a front top left perspective detail view of a preferred exemplary invention embodiment handle end-cap.
Figure 23:
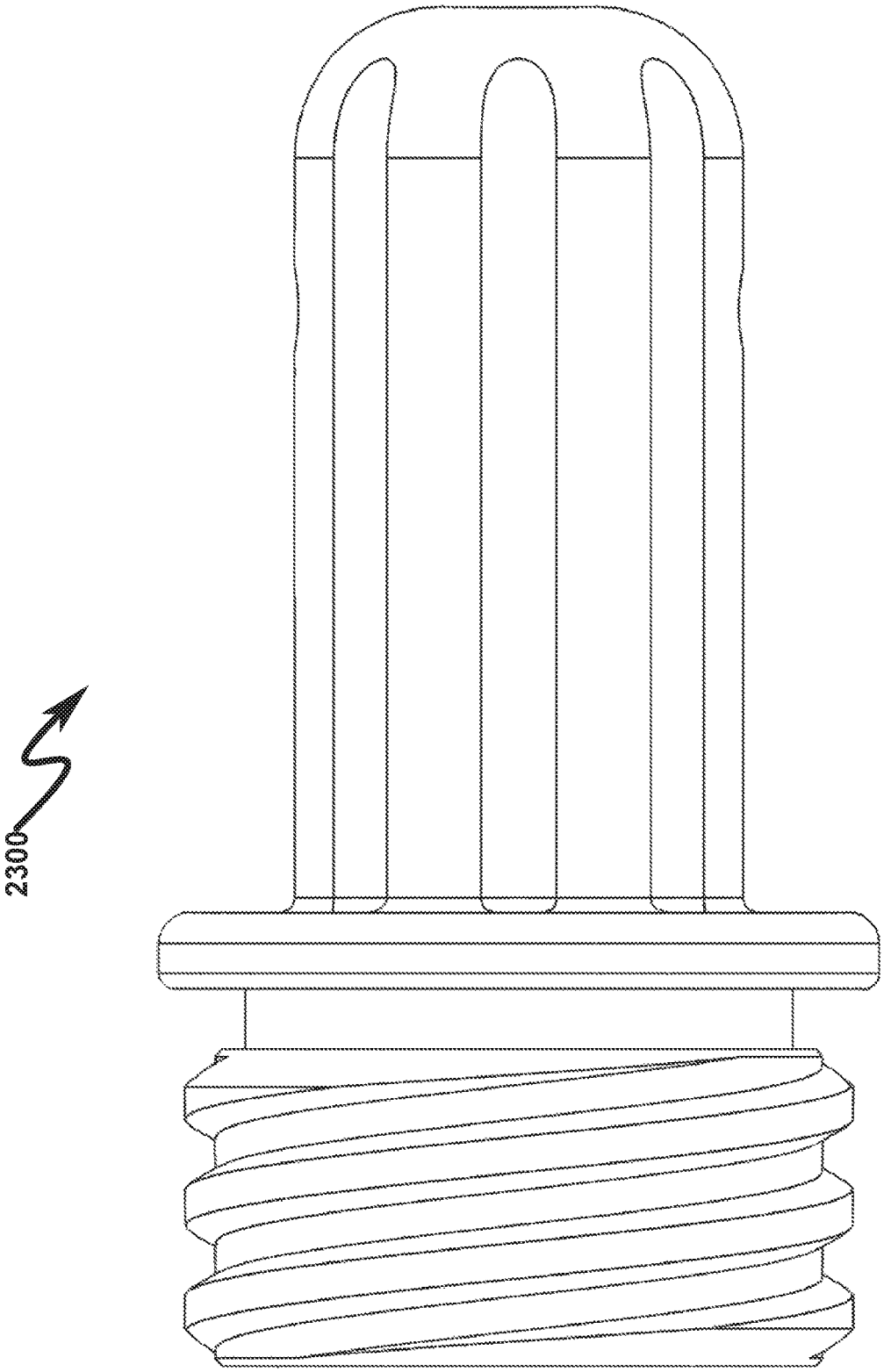
FIG. 23 illustrates a front view of a preferred exemplary invention embodiment handle end-cap.
Figure 24:
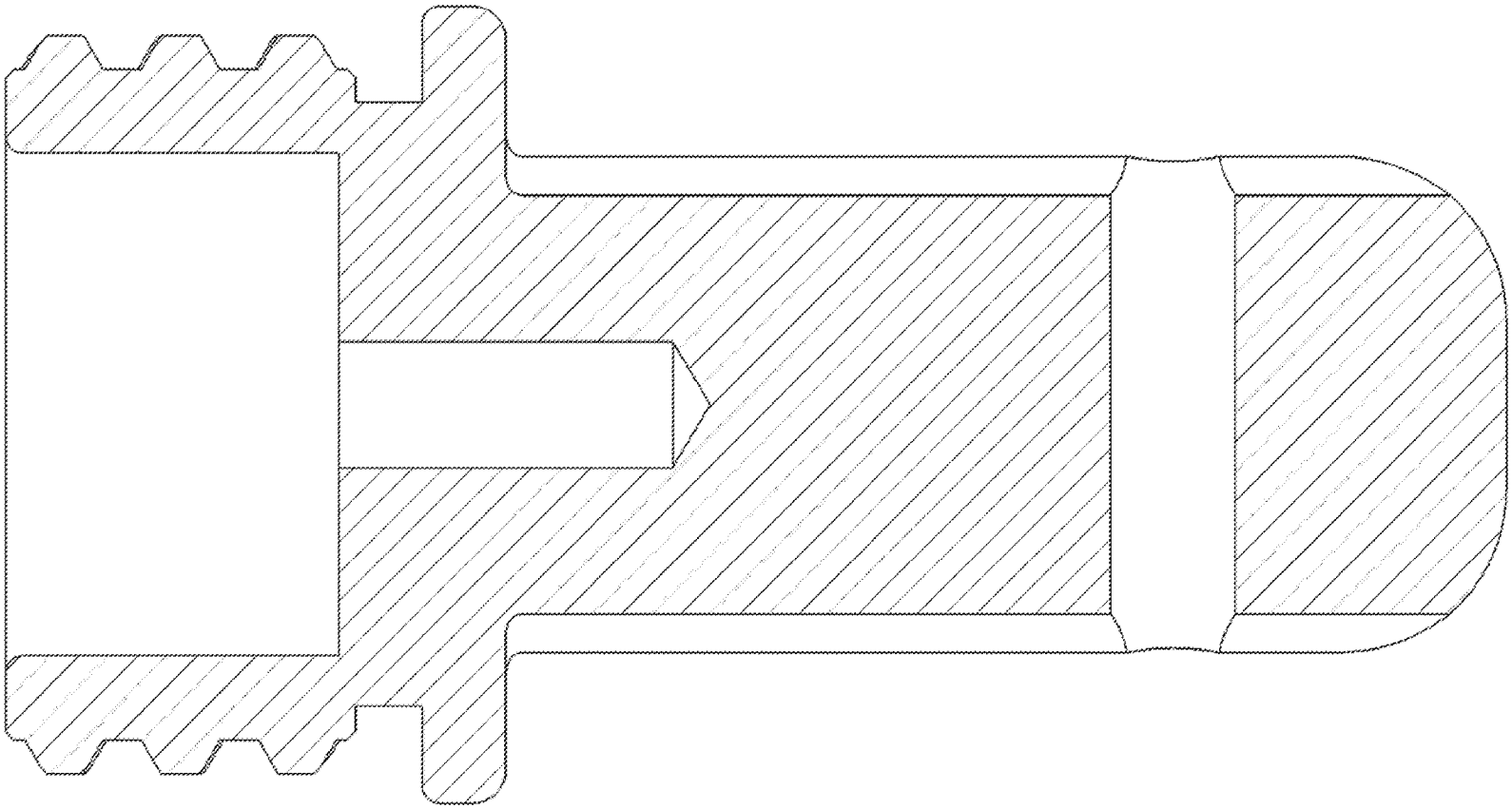
FIG. 24 illustrates a front section view of a preferred exemplary invention embodiment handle end-cap.
Figure 25:
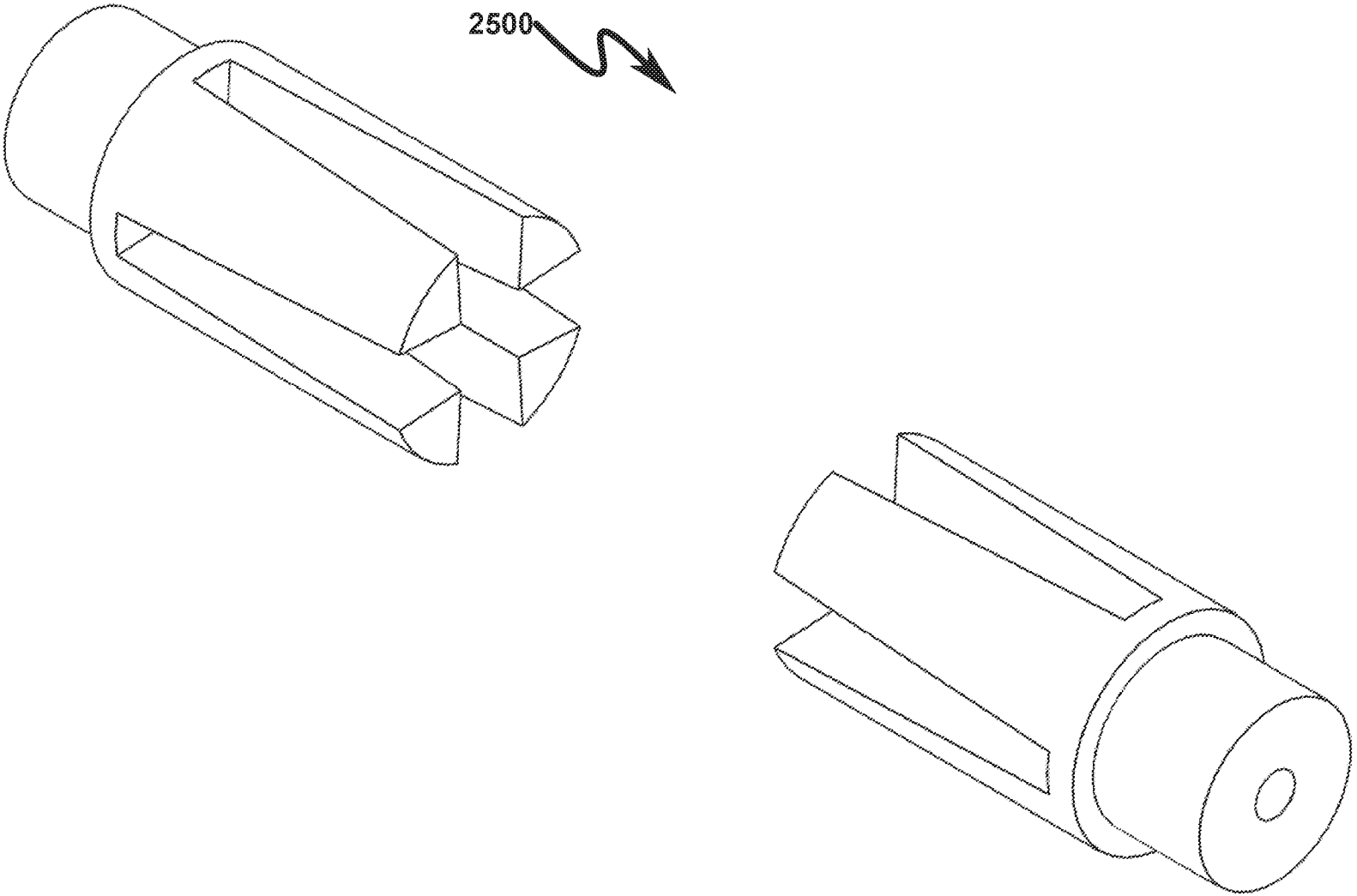
FIG. 25 illustrates a front top right perspective detail view of a preferred exemplary invention embodiment knife retainer set.
Figure 26:
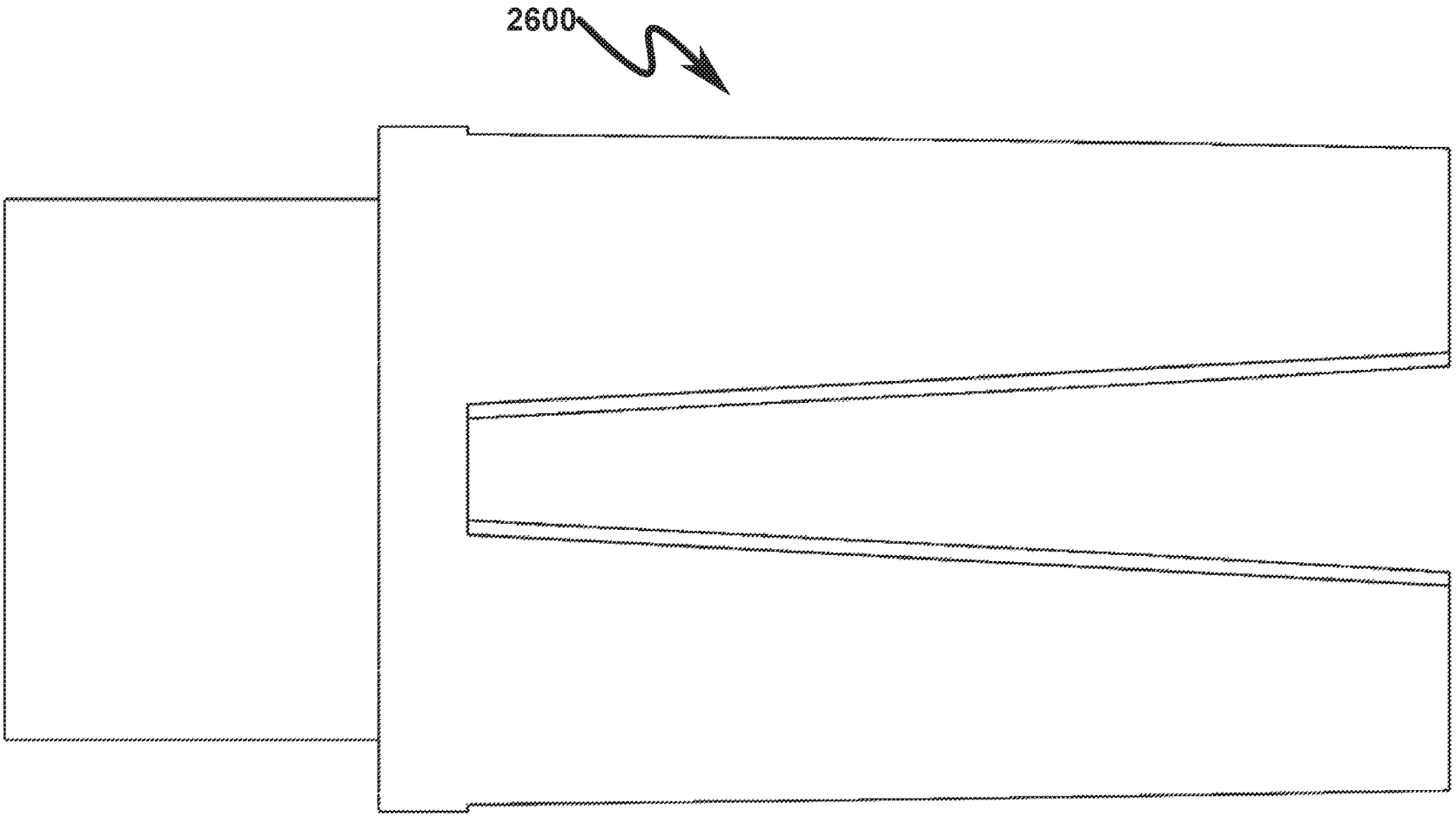
FIG. 26 illustrates a front detail view of a preferred exemplary invention embodiment knife retainer.
Figure 27:
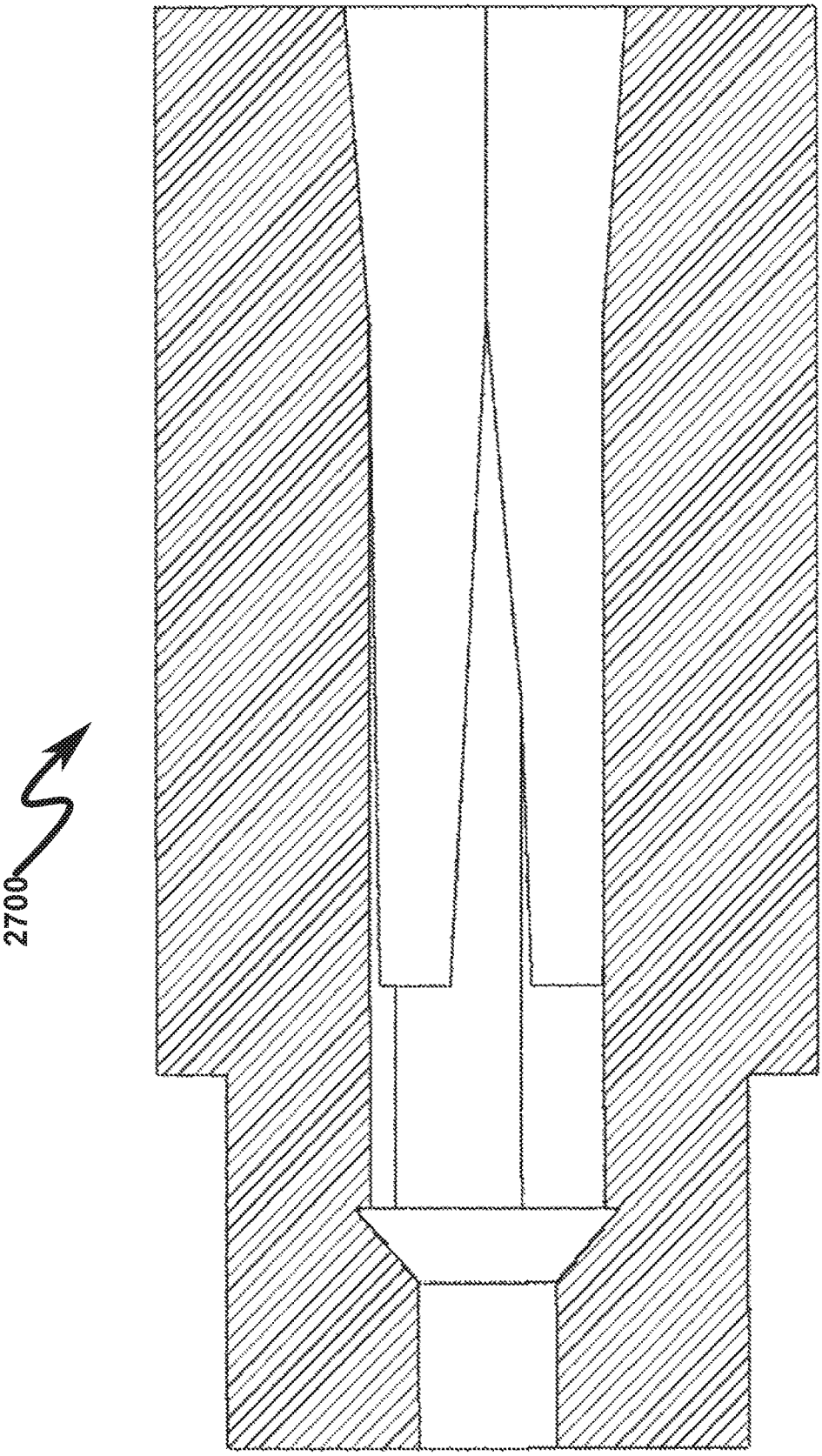
FIG. 27 illustrates a front detail sectional view of a preferred exemplary invention embodiment knife retainer.
Figure 28:
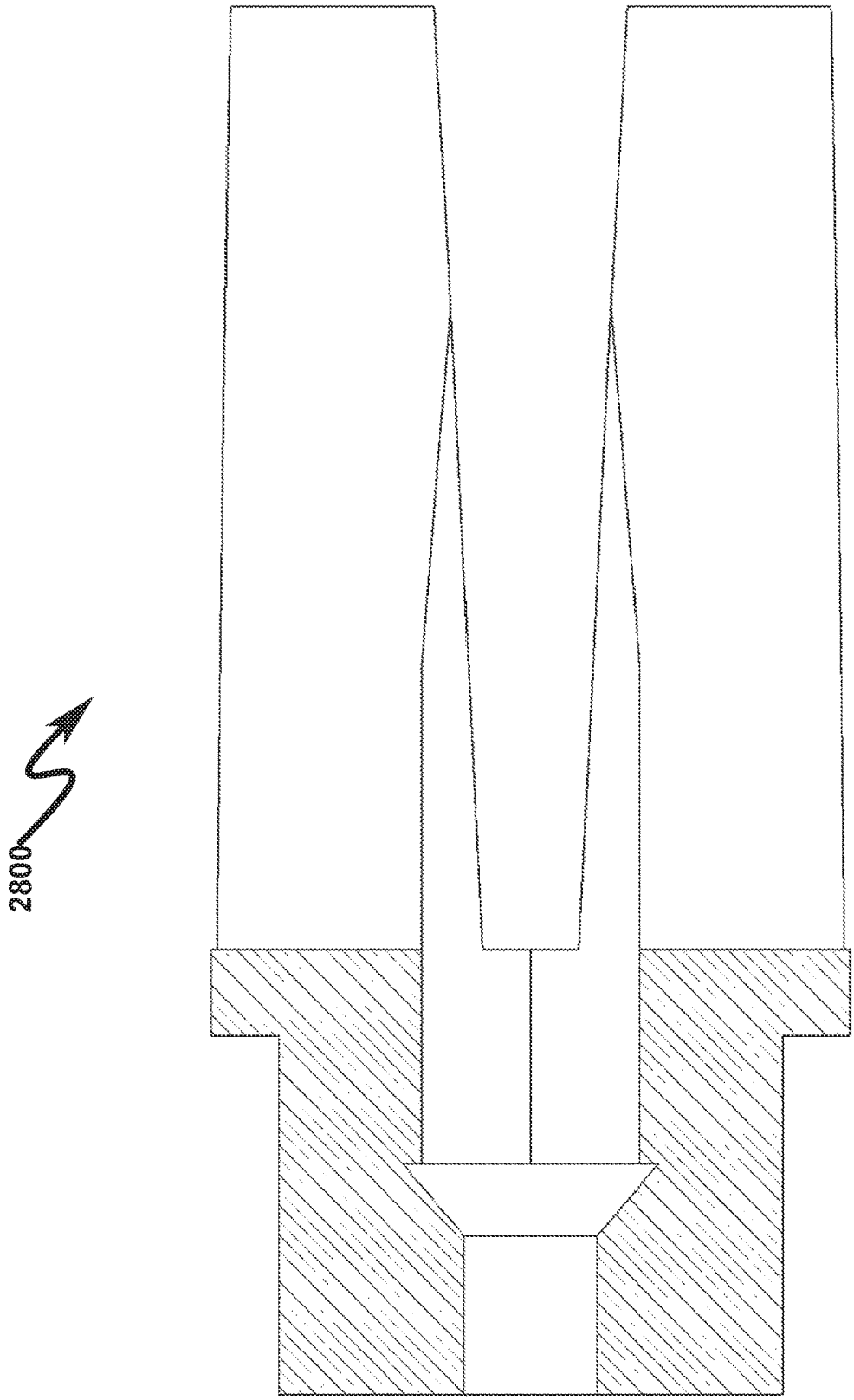
FIG. 28 illustrates a front detail 45-degree sectional view of a preferred exemplary invention embodiment knife retainer rotated by 45 degrees about its longitudinal axis.
Figure 29:
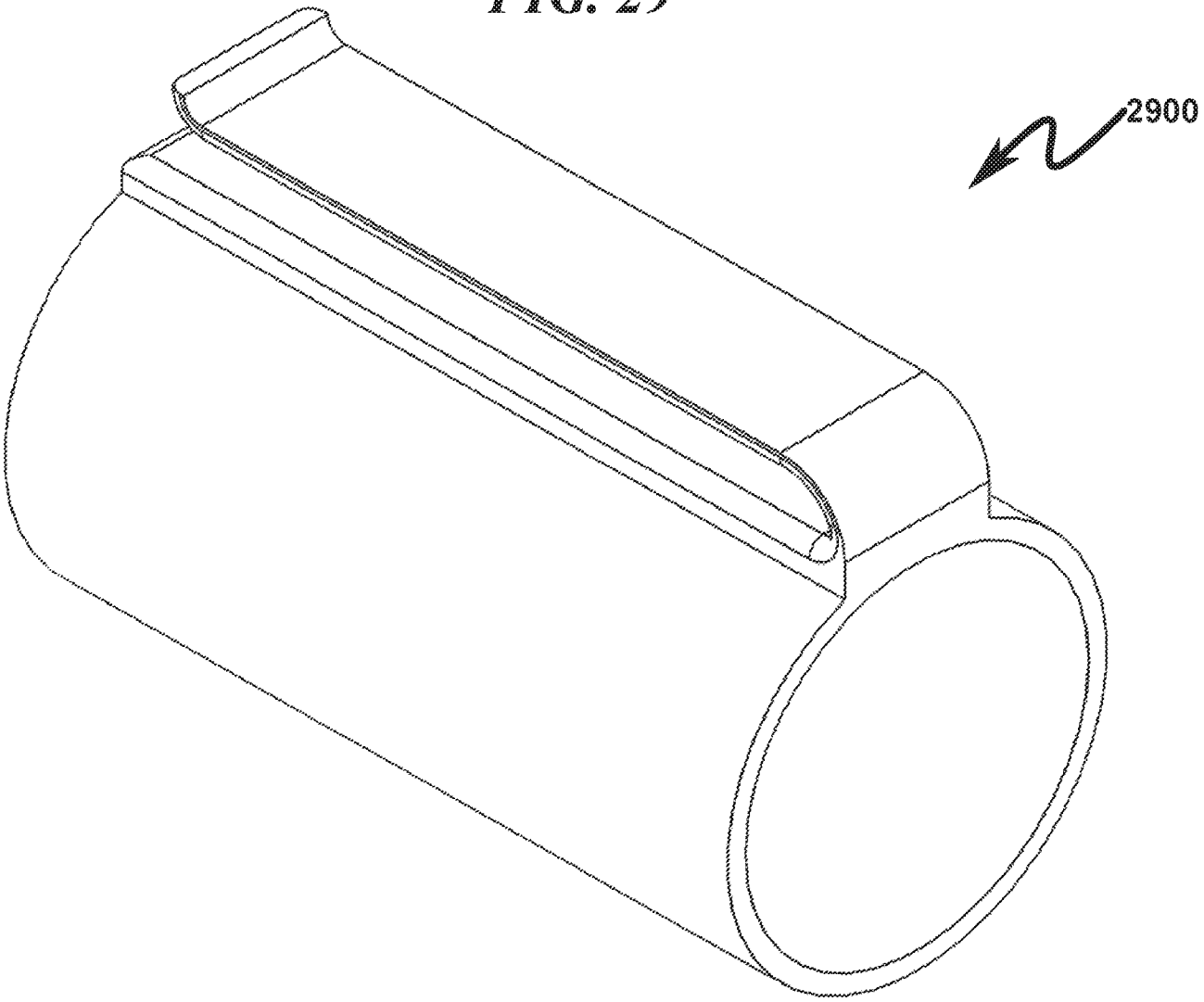
FIG. 29 illustrates a top right front perspective view of an exemplary retention clip used in many preferred invention embodiments.
Figure 30:
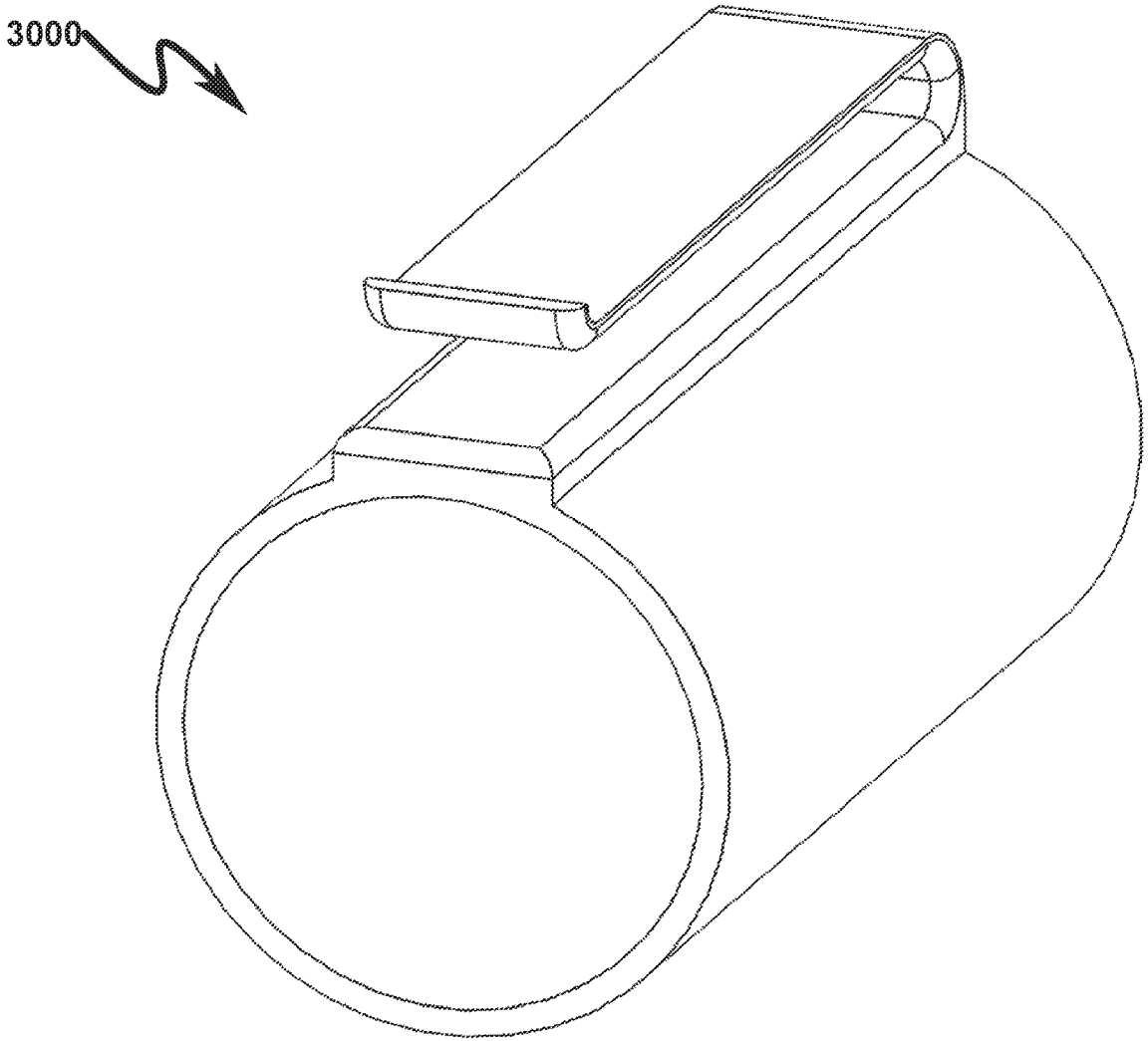
FIG. 30 illustrates a top left front perspective view of an exemplary retention clip used in many preferred invention embodiments.
Figure 31:
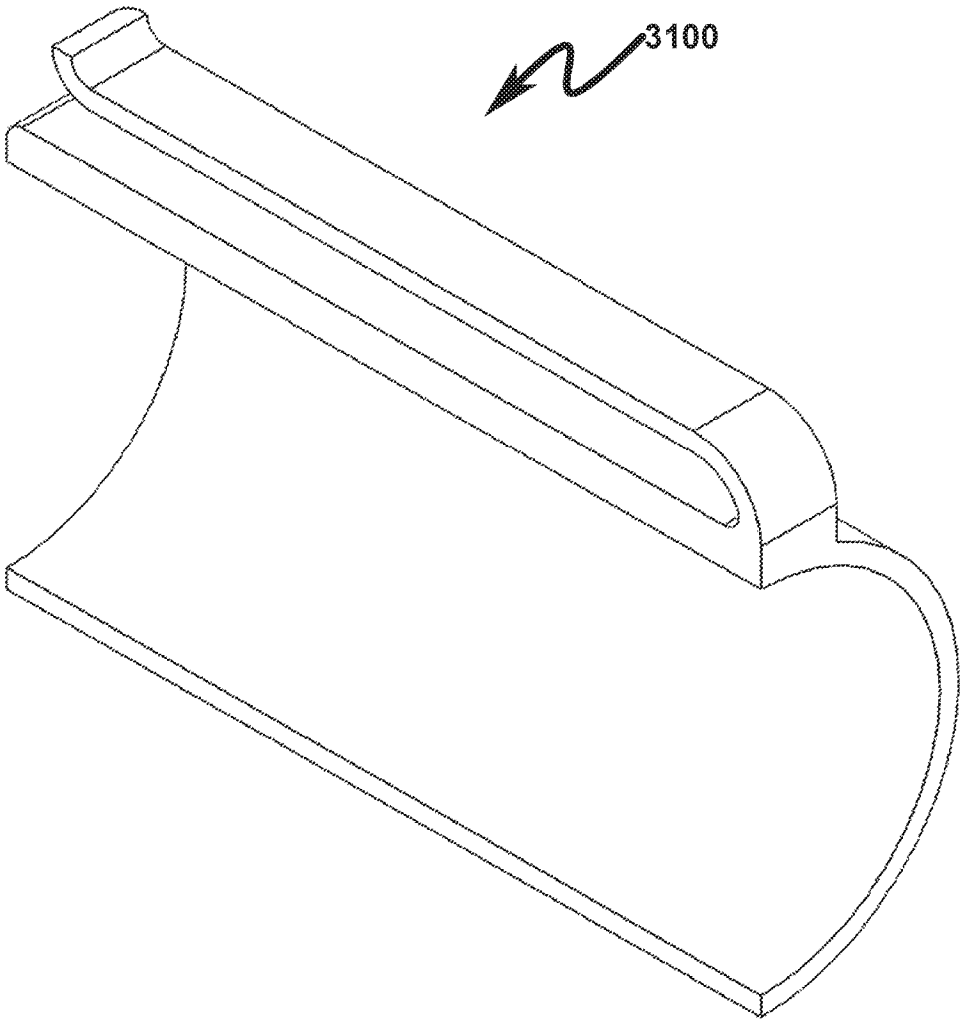
FIG. 31 illustrates a top right front perspective front section view of an exemplary retention clip used in many preferred invention embodiments.

Referencing FIG. 9 (0900)-FIG. 10 (1000), this first preferred exemplary invention embodiment comprises a center retention tube (CRT) (0901, 1001) and optional retention clip (0902, 1002). A top end-cap (0903, 1003) and bottom end-cap (0904, 1004) are provided to seal the ends of the center retention tube (CRT) (0901, 1001). Additional detail of the top end-cap (0903, 1003) and bottom end-cap (0904, 1004) are provided in FIG. 17 (1700)-FIG. 20 (2000) and FIG. 21 (2100)-FIG. 24 (2400) respectively. As depicted, the top end-cap (0903, 1003) may incorporate a handle (0905, 1005) (with optional lanyard hole (0906, 1006)) that is not present on the bottom end-cap (0904, 1004). The end-caps (0903, 0904, 1003, 1004) and center retention tube (CRT) (0901, 1001) mate with external and internal threads respectively as generally illustrated by the external thread exemplars provided in FIG. 17 (1700)-FIG. 20 (2000) and FIG. 21 (2100)-FIG. 24 (2400). A preferred thread implementation as illustrated uses ACME class threads having a lead of two or greater.

Knife Retention

Figure 11:
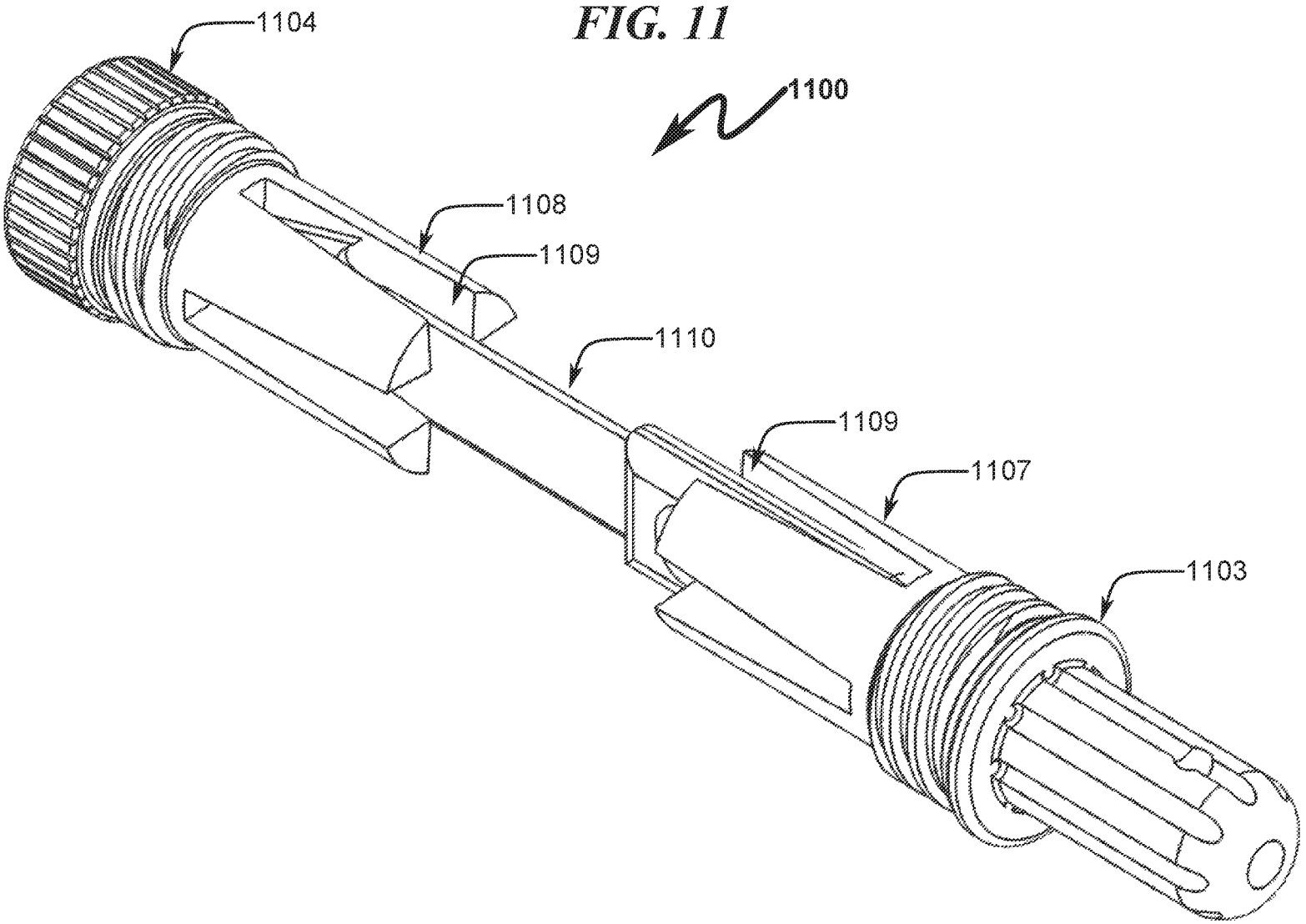
FIG. 11 illustrates a front top perspective assembly view of a preferred exemplary invention embodiment (retention clip and center retention tube (CRT) hidden)
Figure 12:
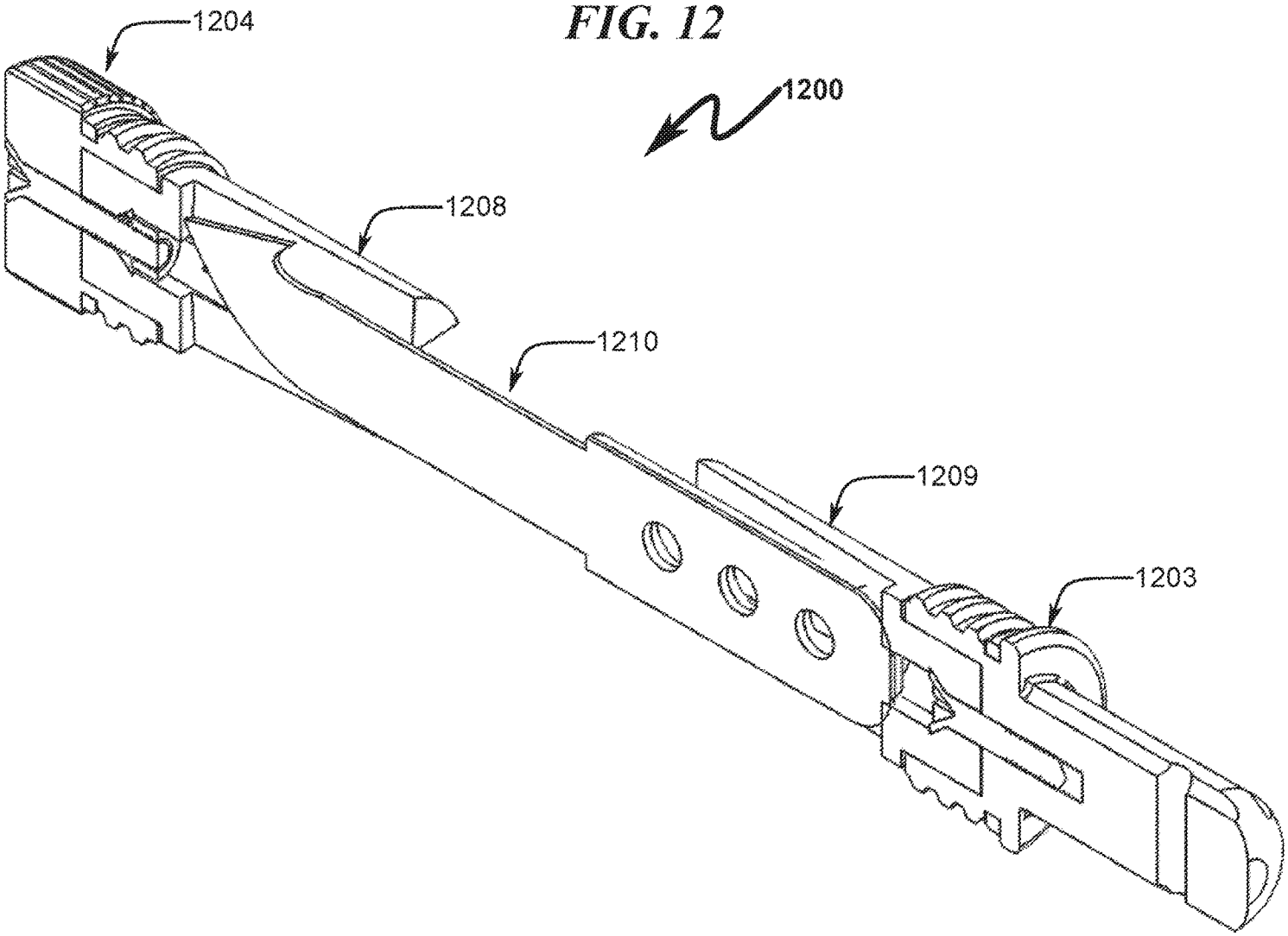
FIG. 12 illustrates a front top perspective assembly front section view of a preferred exemplary invention embodiment (retention clip and center retention tube (CRT) hidden)
Figure 13:
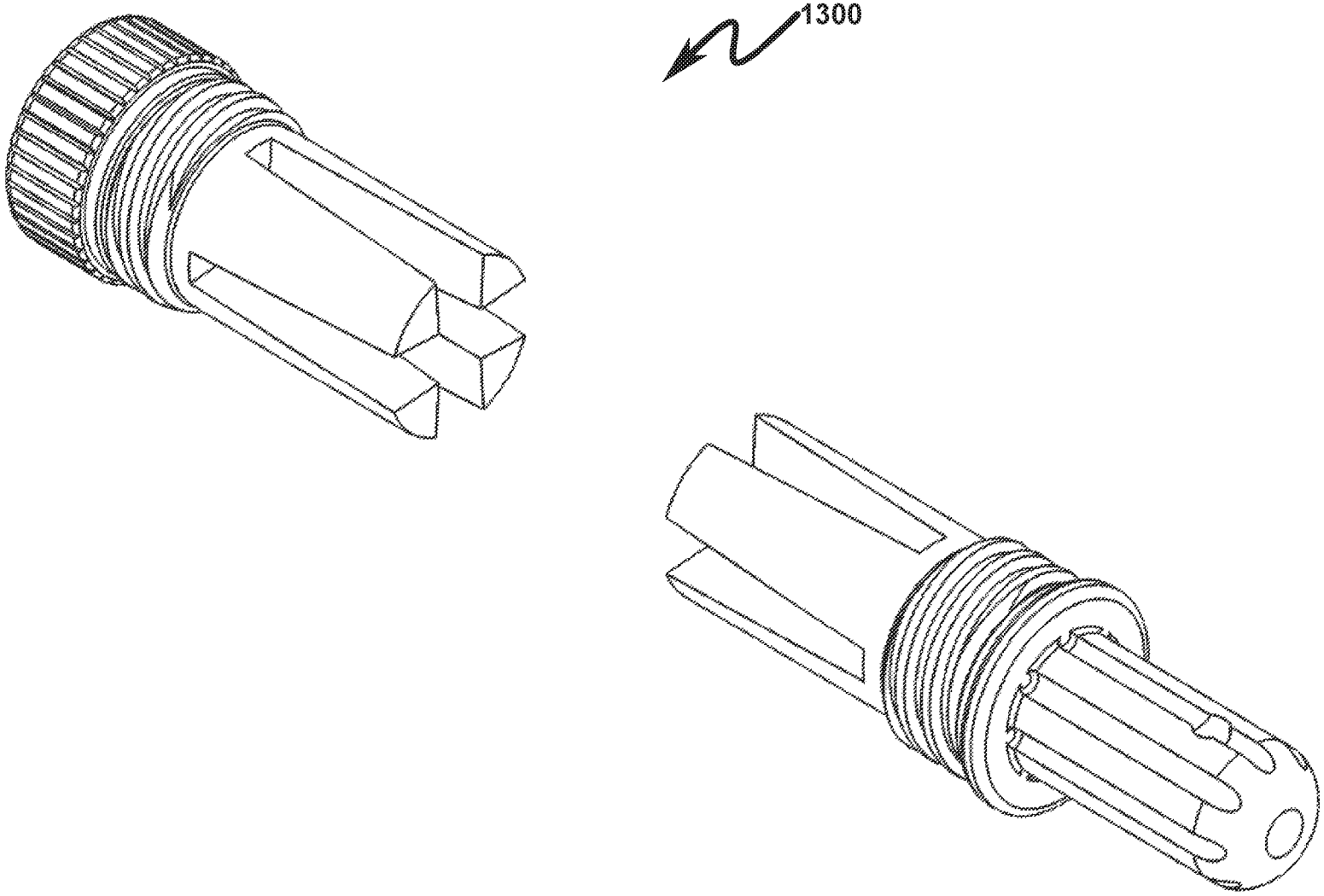
FIG. 13 illustrates a front top perspective assembly view of a preferred exemplary invention embodiment (retention clip, center retention tube (CRT), and knife hidden)
Figure 14:
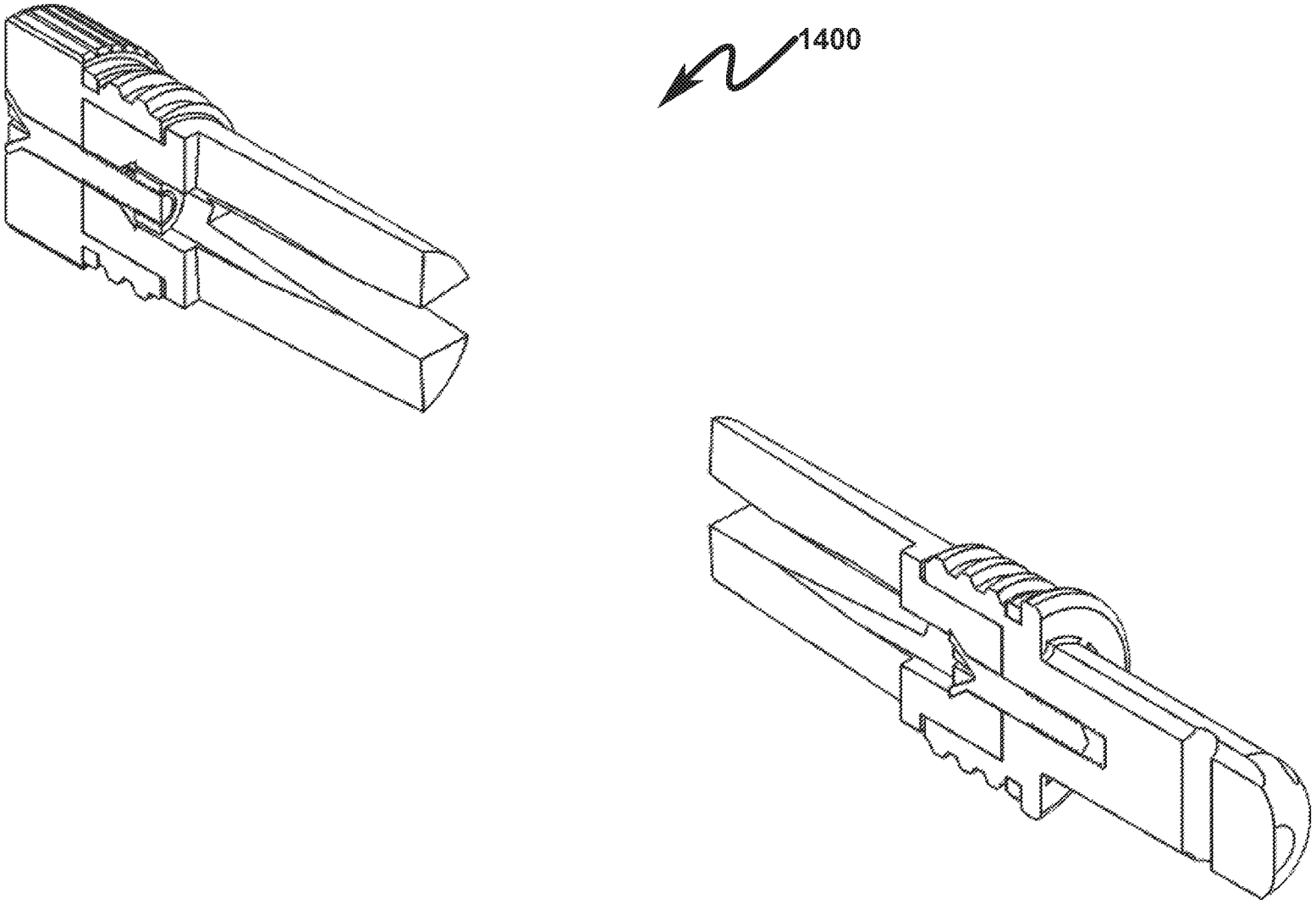
FIG. 14 illustrates a front top perspective assembly front section view of a preferred exemplary invention embodiment (retention clip, center retention tube (CRT), and knife hidden)

Referencing FIG. 11 (1100)-FIG. 14 (1400), a knife (1110, 1210) is depicted as being retained between a first knife retainer (FNR) (1107, 1207) and a second knife retainer (1108, 1108) that are attached to the corresponding top end-cap (1103, 1203) and bottom end-cap (1104, 1204). Each of the knife retainers (1107, 1207, 1108, 1108) has a number of associated blade slots (1109, 1209) that are positioned through the longitudinal axis of the knife retainers (1107, 1207, 1108, 1108) to permit retention of the knife (1110, 1210) blade and/or hilt/handle.

Preferred material selection for the center retention tube (CRT) (0901, 1001, 1101, 1201), top end-cap (0903, 1003), and bottom end-cap (0904, 1004) is plastic with PVC and ABS considered optimal materials. Note, however, that the first knife retainer (FNR) (1107, 1207) and second knife retainer (1108, 1208) may be constructed of similar or different materials. In some preferred embodiments, at least one of the knife retainers (1107, 1207, 1108, 1208) is constructed of a rigid foam material. This allows, for example, the knife retainer capturing the knife blade to be made of a hard plastic material while the knife retainer capturing the knife hilt to be constructed of a rigid foam that can conform to a variety of knife hilt configurations while still restraining the knife within the center retention tube (CRT) (0901, 1001, 1101, 1201) during transit. This capability is important to reduce the potential for dulling the edge of the knife during transport.

End-Cap Detail

Figure 15:
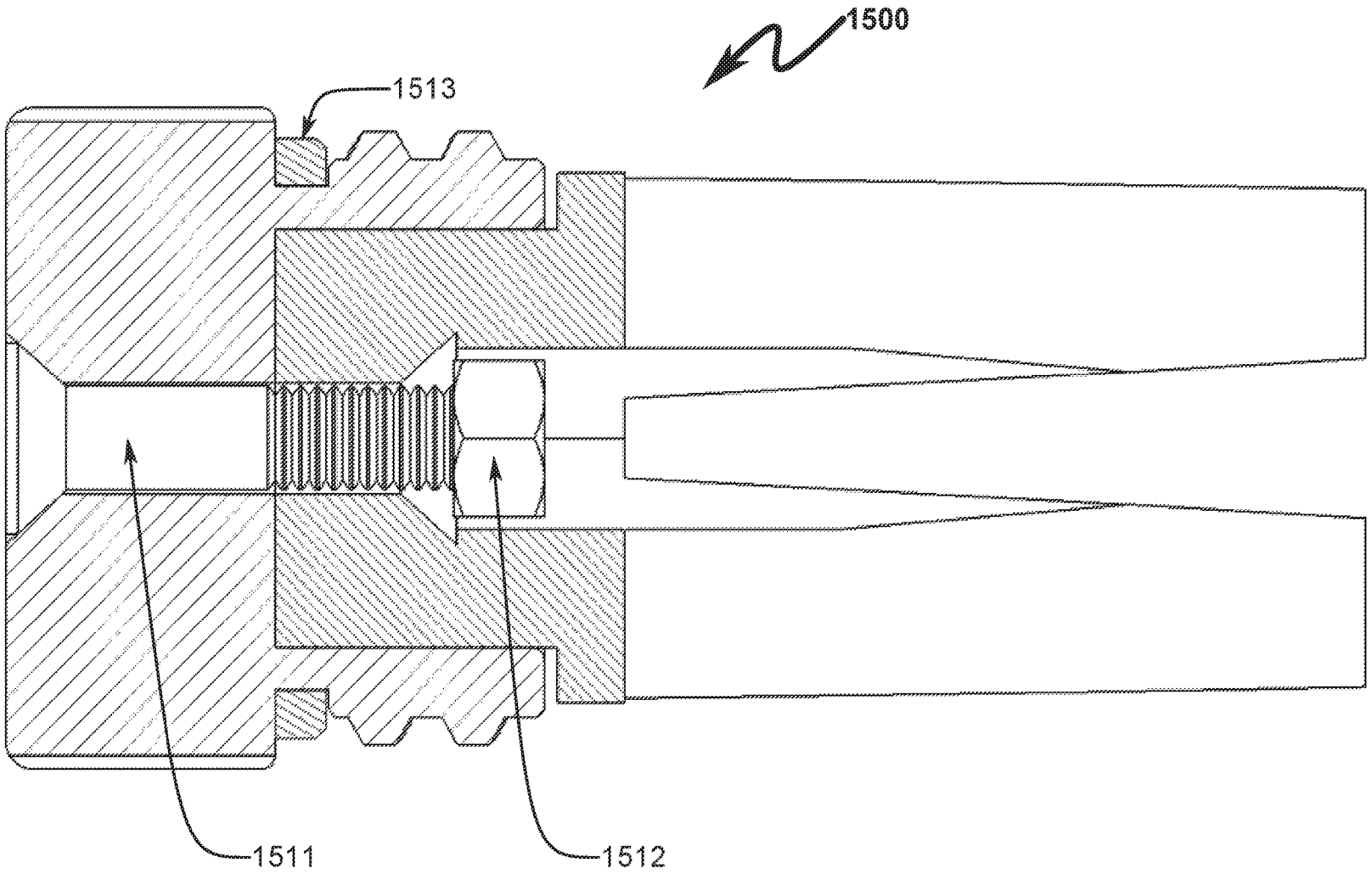
FIG. 15 illustrates a front section view of a preferred exemplary invention embodiment knife retainer and bottom end-cap.
Figure 16:
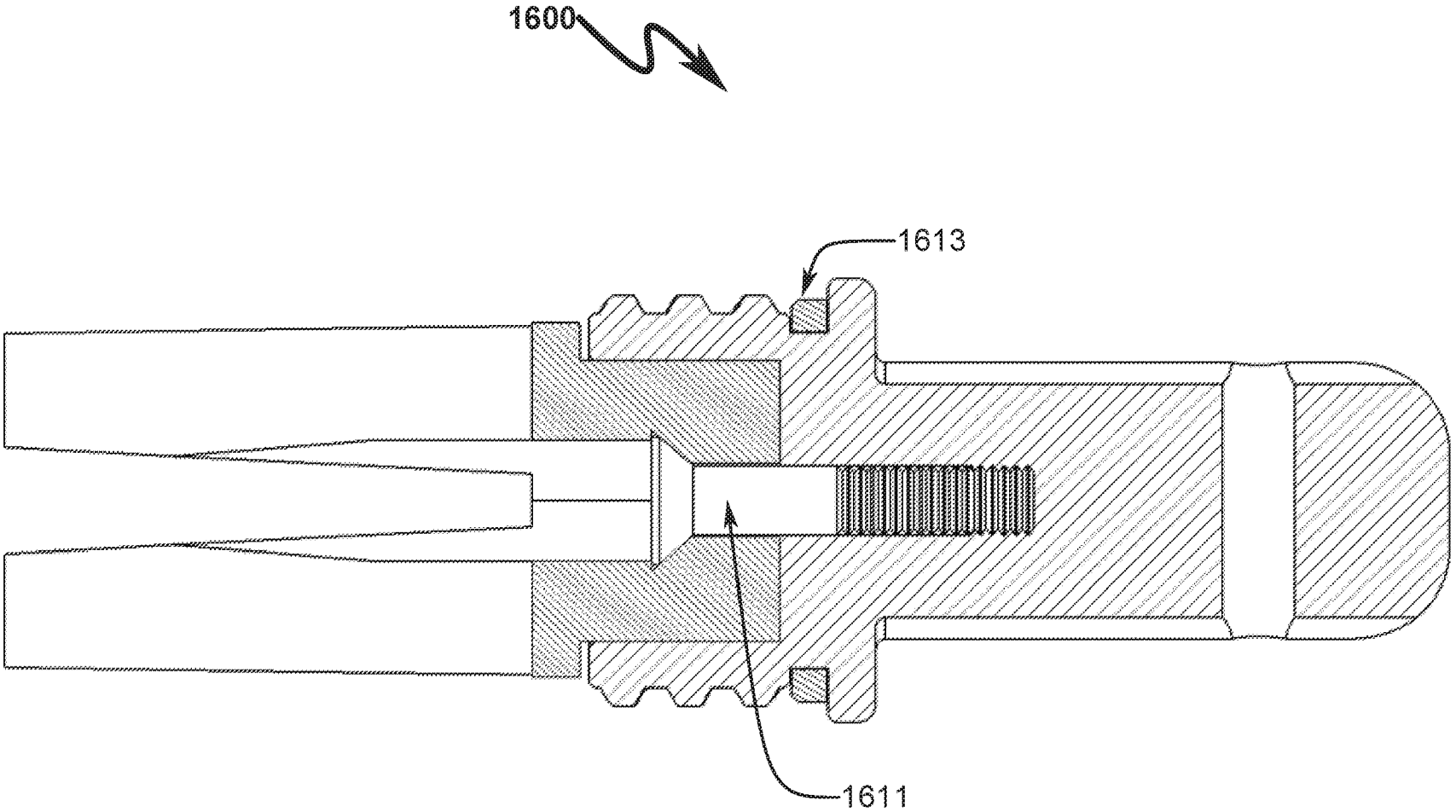
FIG. 16 illustrates a front section view of a preferred exemplary invention embodiment knife retainer and top handle end-cap.

Referencing FIG. 15 (1500)-FIG. 16 (1600), additional detail of the end-caps and knife retainers is provided. Here it can be seen that the end-caps and knife retainers are mated together with corresponding male-female cylindrical portions of their structure and in this example fastened together using a screw/bolt (1511, 1611) and nut (1512). This attachment may also be implemented in the bottom end-cap by reversing the screw/bolt (1511, 1611) and providing for a threaded hole in the end-cap as depicted in the top end-cap embodiment depicted in FIG. 16 (1600). To ensure an impermeable fluid barrier between the end-caps and the distal ends of the center retention tube (CRT), a sealing ring (1513, 1613) is provided for the end-caps. This provision ensures that animal blood and other contaminants remain within the CRT.

Alternate Exemplary Embodiment (3300)-(5800)

Figure 33:
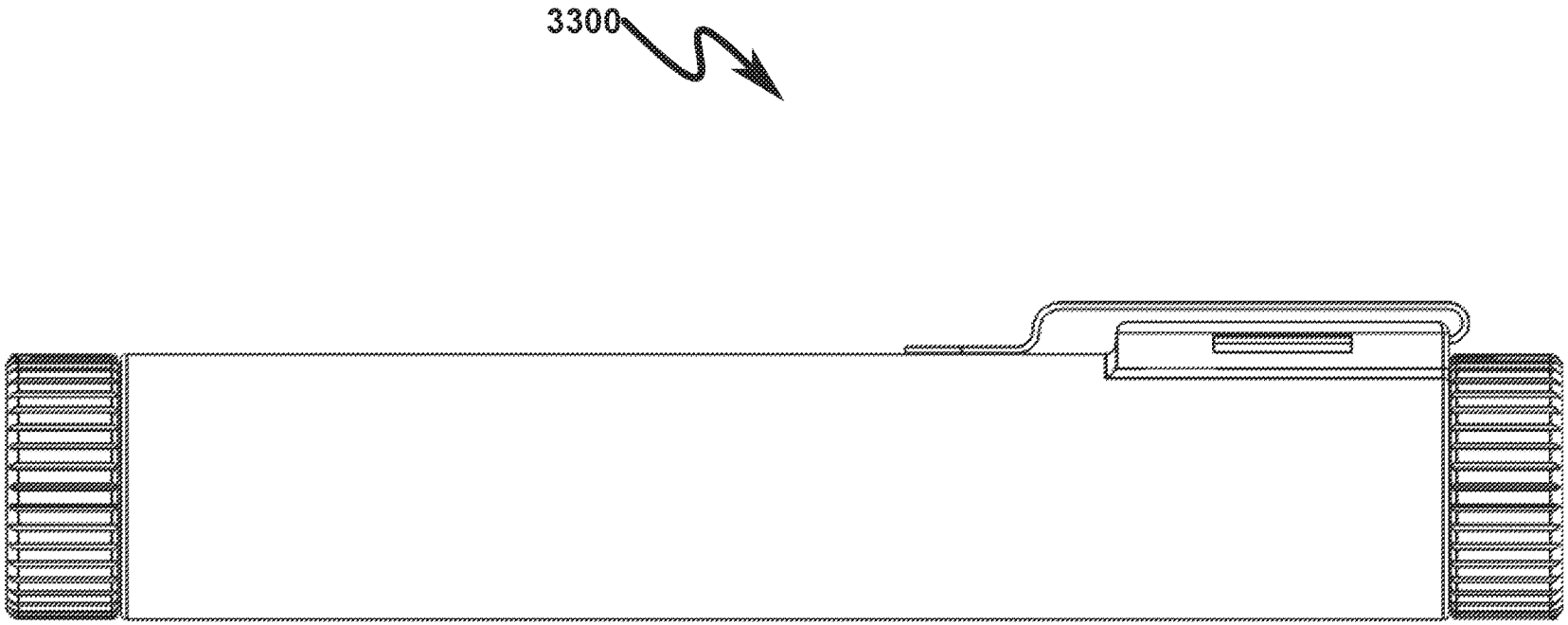
FIG. 33 illustrates a front view of an alternate preferred exemplary invention embodiment.
Figure 34:
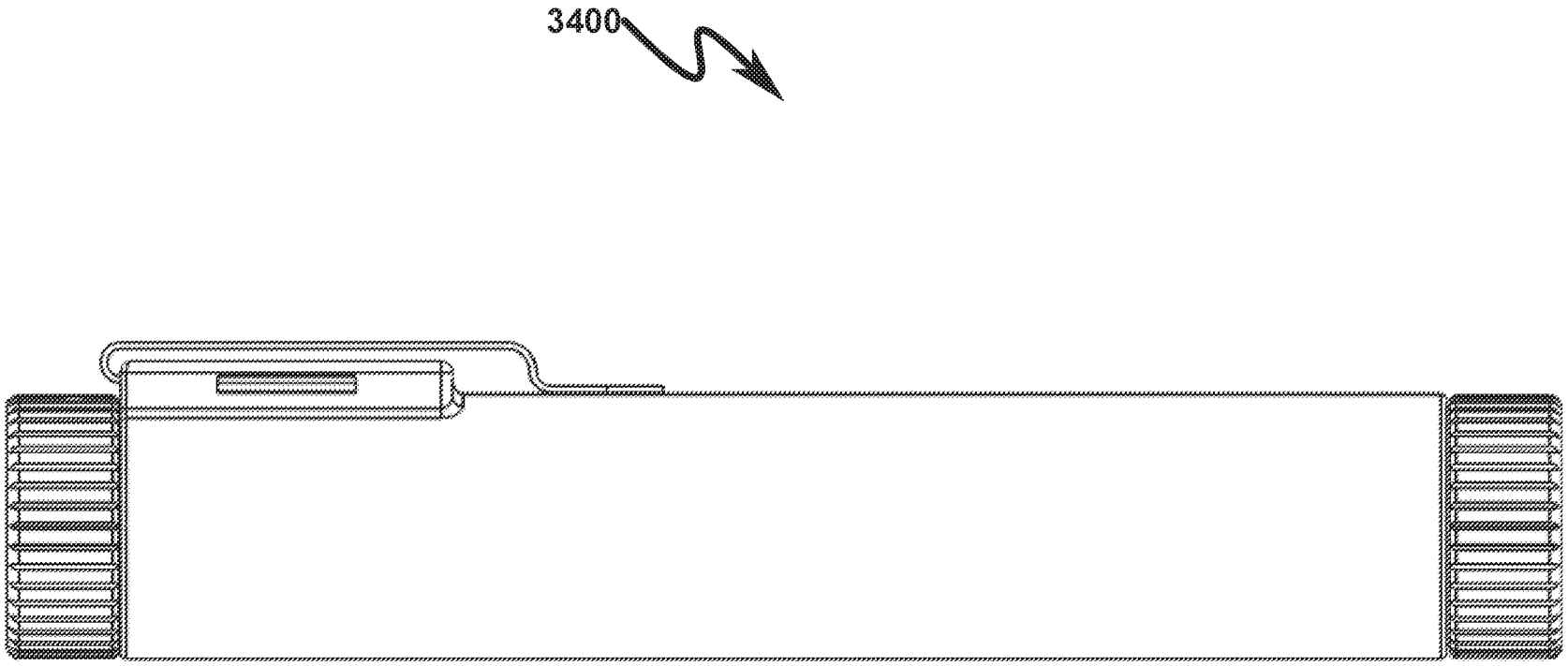
FIG. 34 illustrates a back view of an alternate preferred exemplary invention embodiment.
Figure 35:
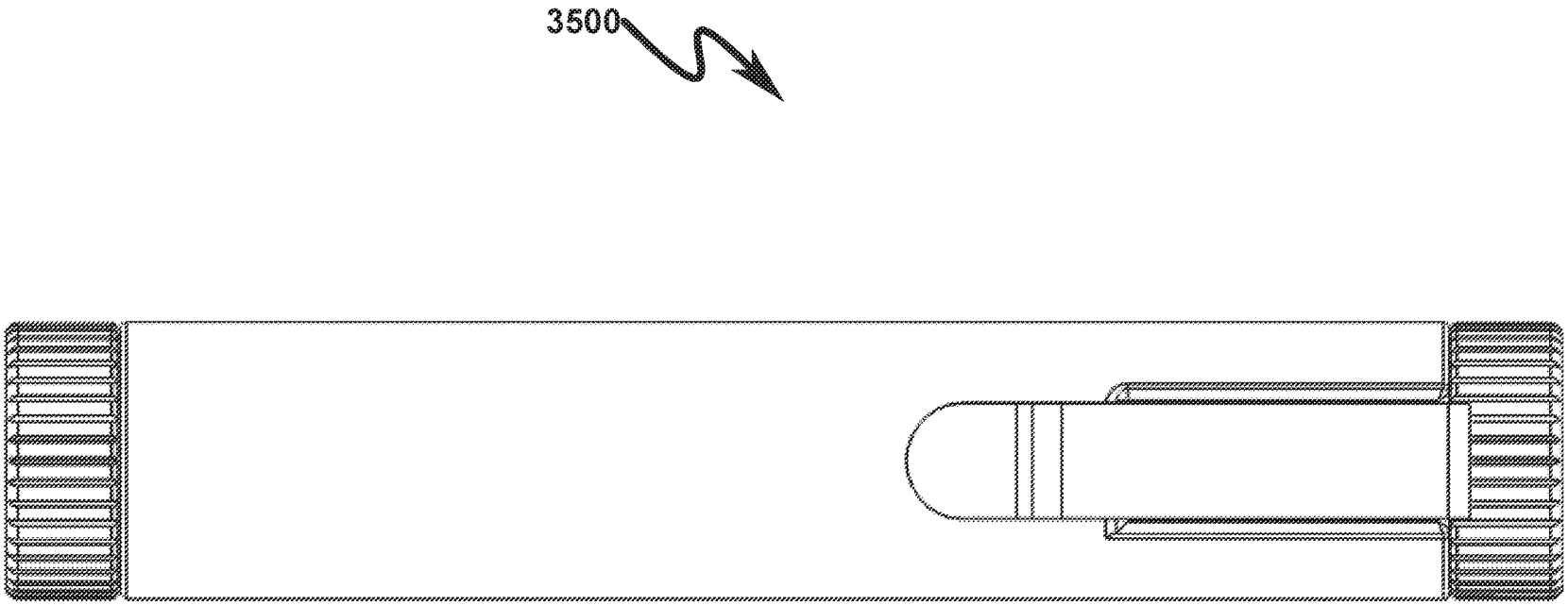
FIG. 35 illustrates a top view of an alternate preferred exemplary invention embodiment.
Figure 36:
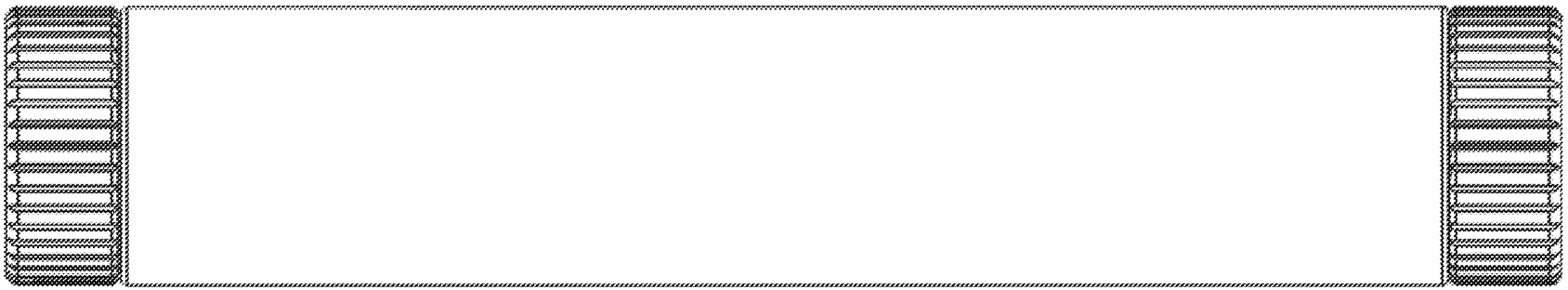
FIG. 36 illustrates a bottom view of an alternate preferred exemplary invention embodiment.
Figure 37:
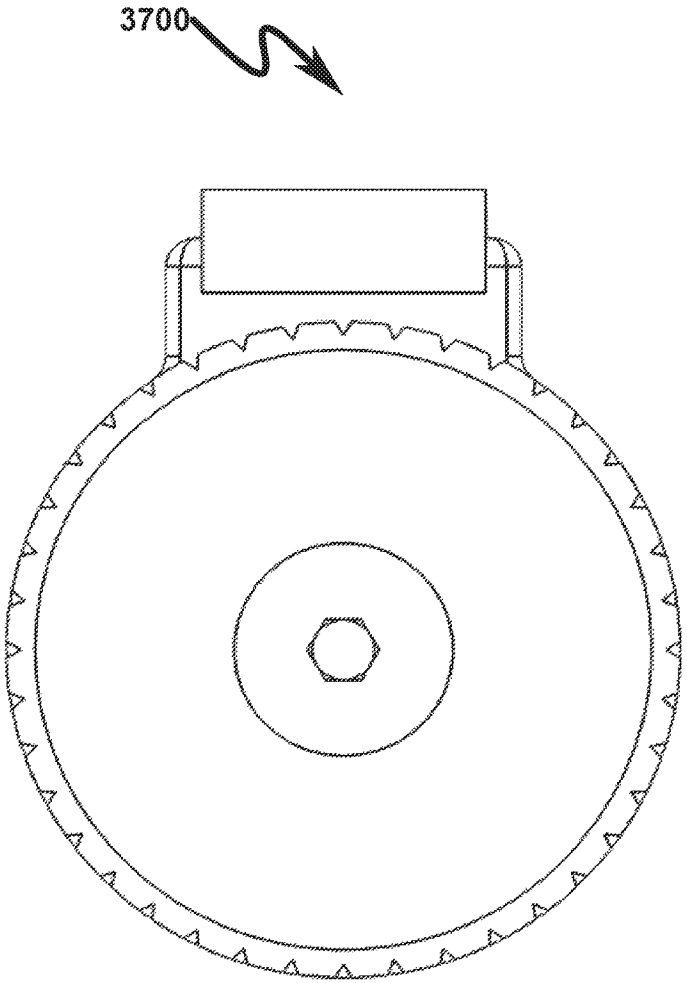
FIG. 37 illustrates a left side view of an alternate preferred exemplary invention embodiment.
Figure 38:
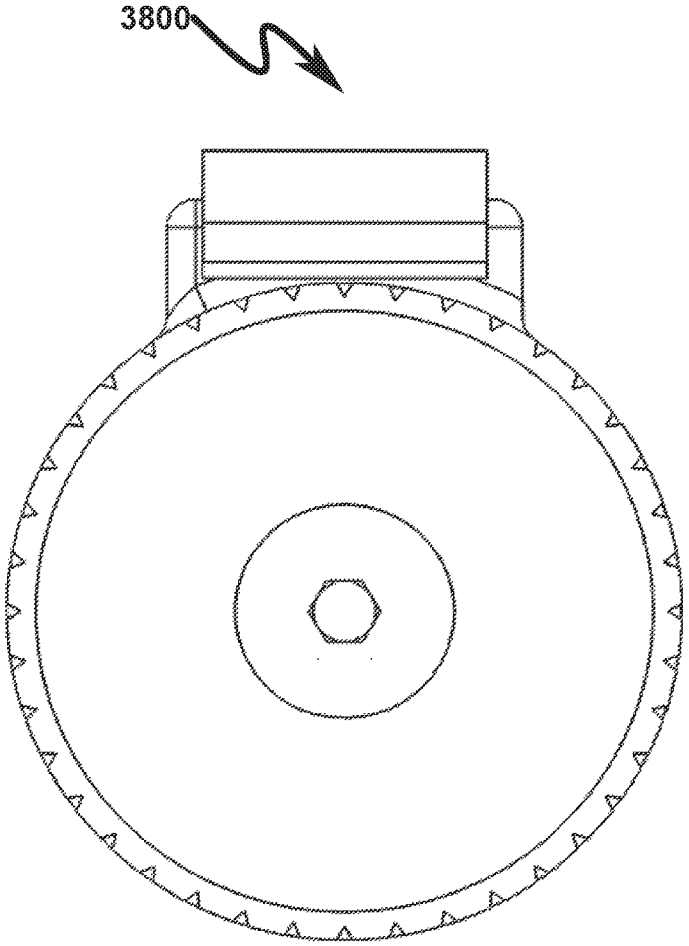
FIG. 38 illustrates a right side view of an alternate preferred exemplary invention embodiment.
Figure 39:
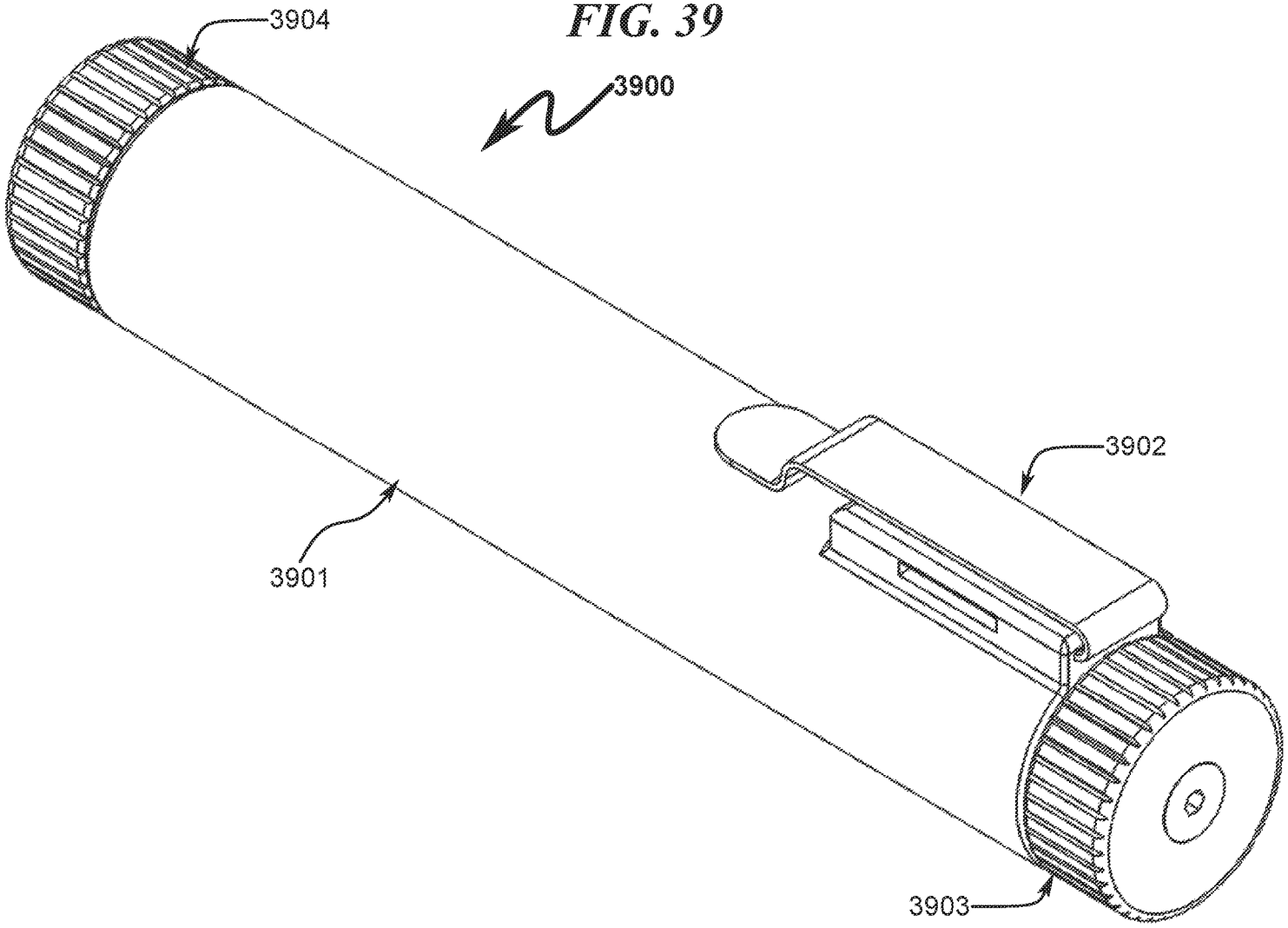
FIG. 39 illustrates a front top perspective view of an alternate preferred exemplary invention embodiment.
Figure 40:
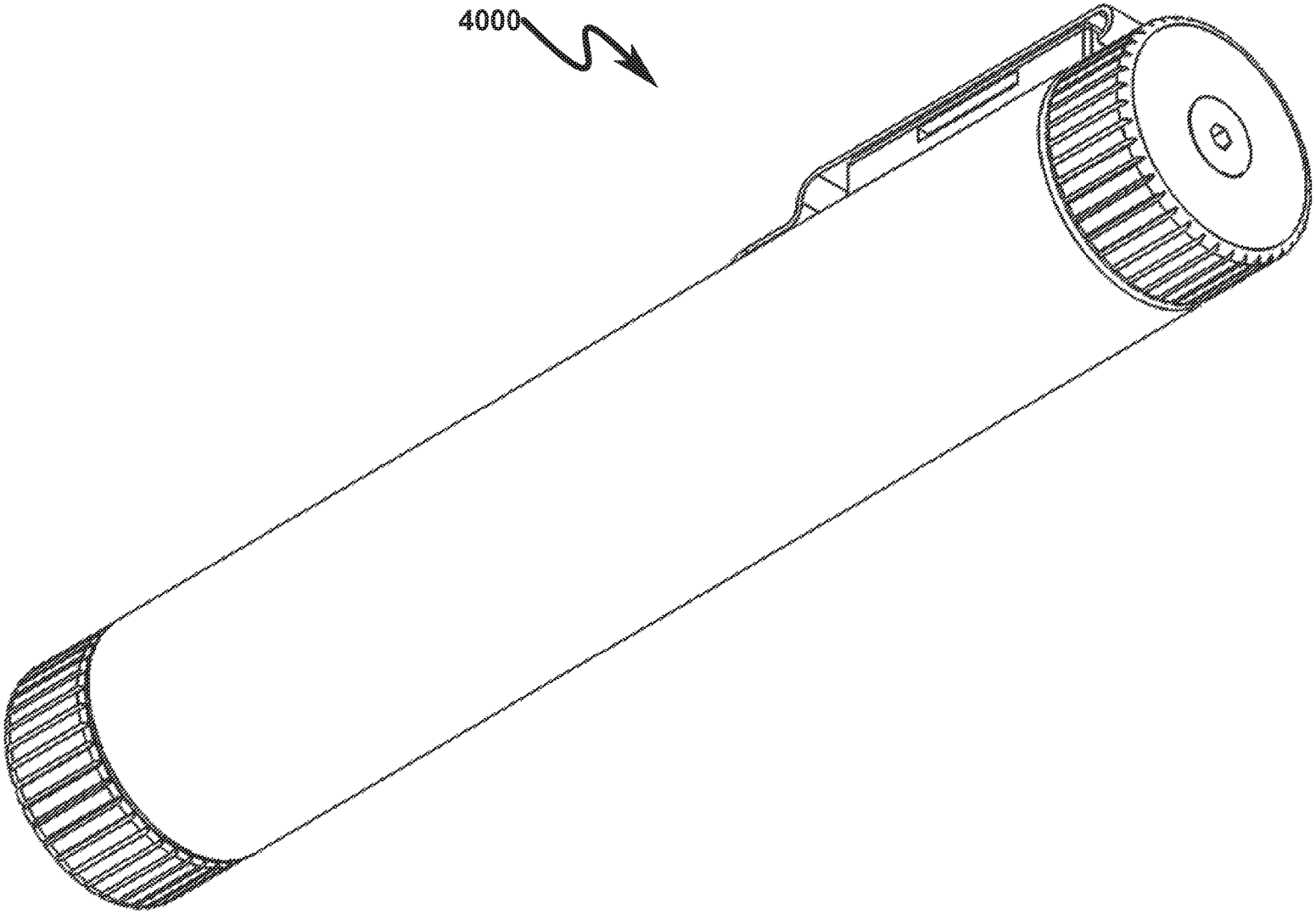
FIG. 40 illustrates a front bottom perspective view of an alternate preferred exemplary invention embodiment.
Figure 41:
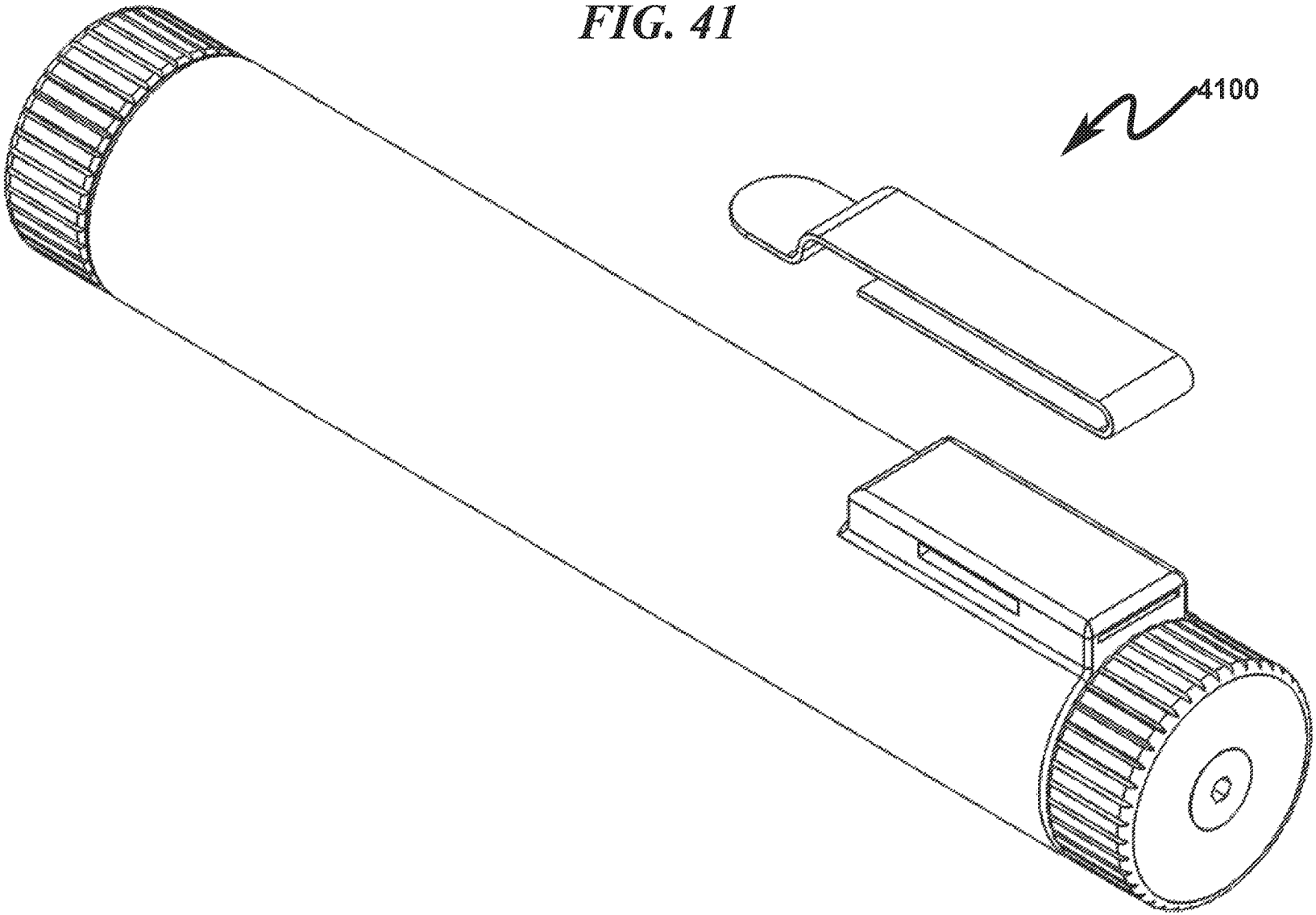
FIG. 41 illustrates a front top perspective assembly view of an alternate preferred exemplary invention embodiment (retaining clip exploded)
Figure 42:
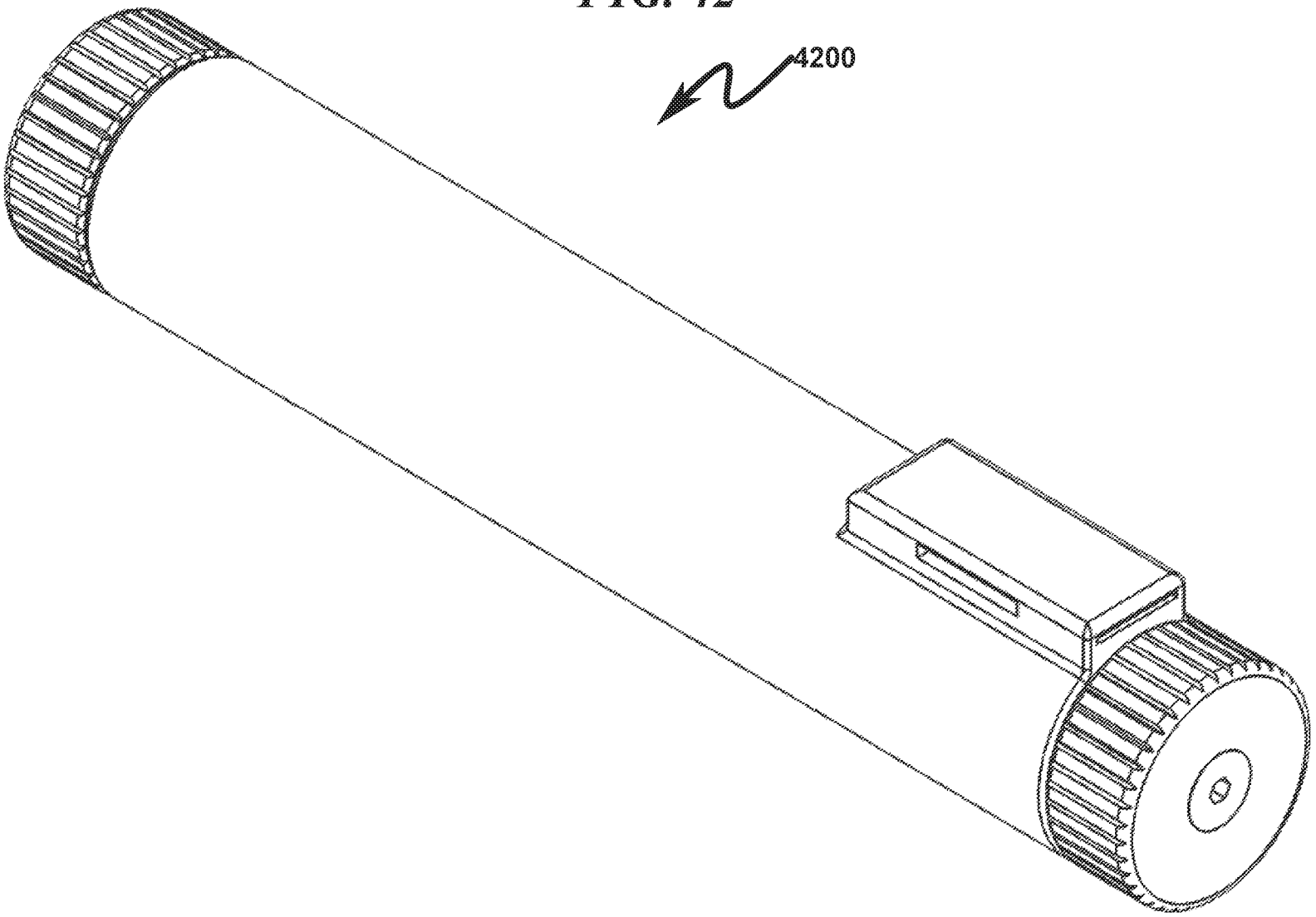
FIG. 42 illustrates a front top perspective assembly view of an alternate preferred exemplary invention embodiment (retaining clip hidden)
Figure 43:
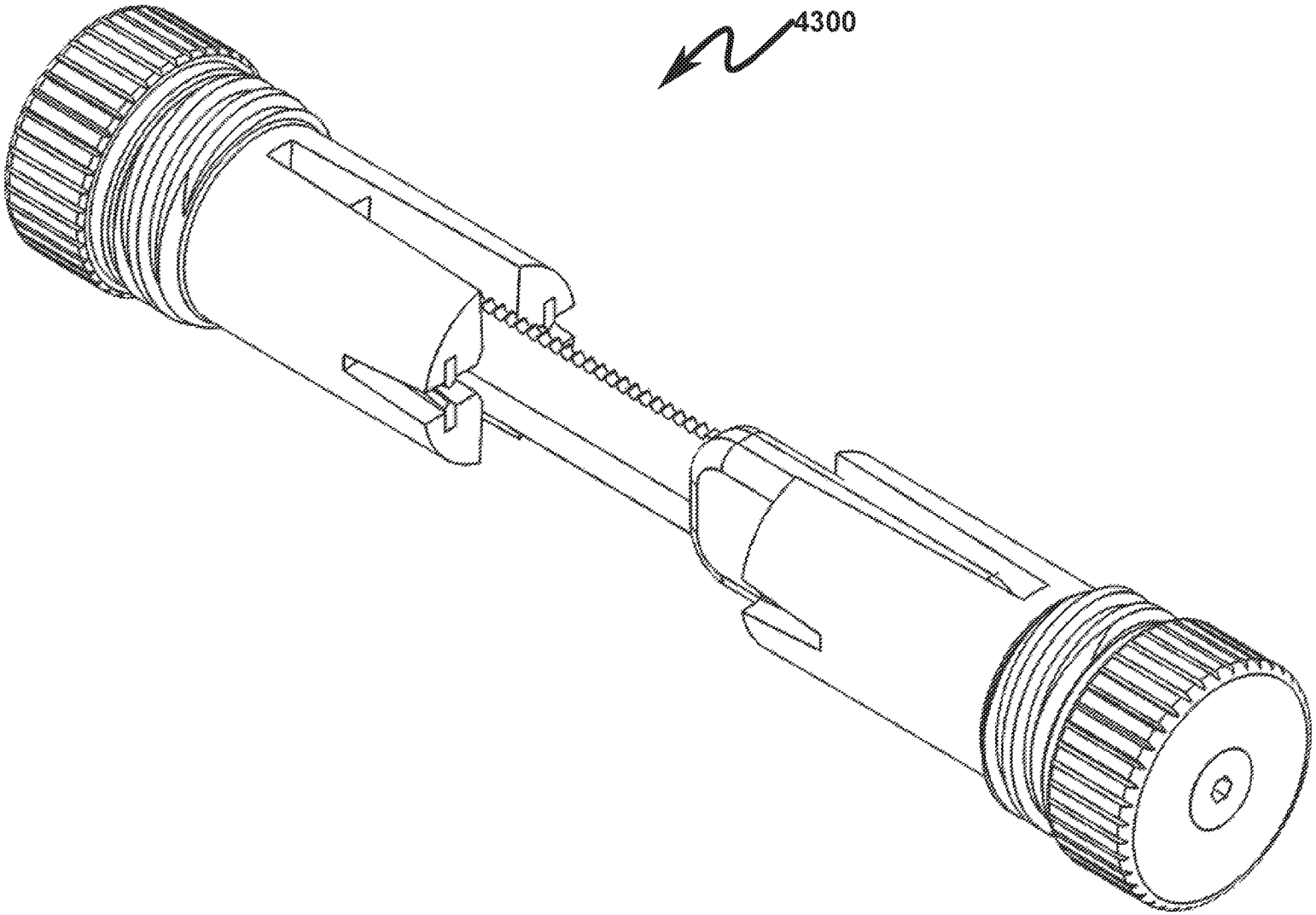
FIG. 43 illustrates a front top perspective assembly view of an alternate preferred exemplary invention embodiment (center retention tube (CRT) hidden)
Figure 44:
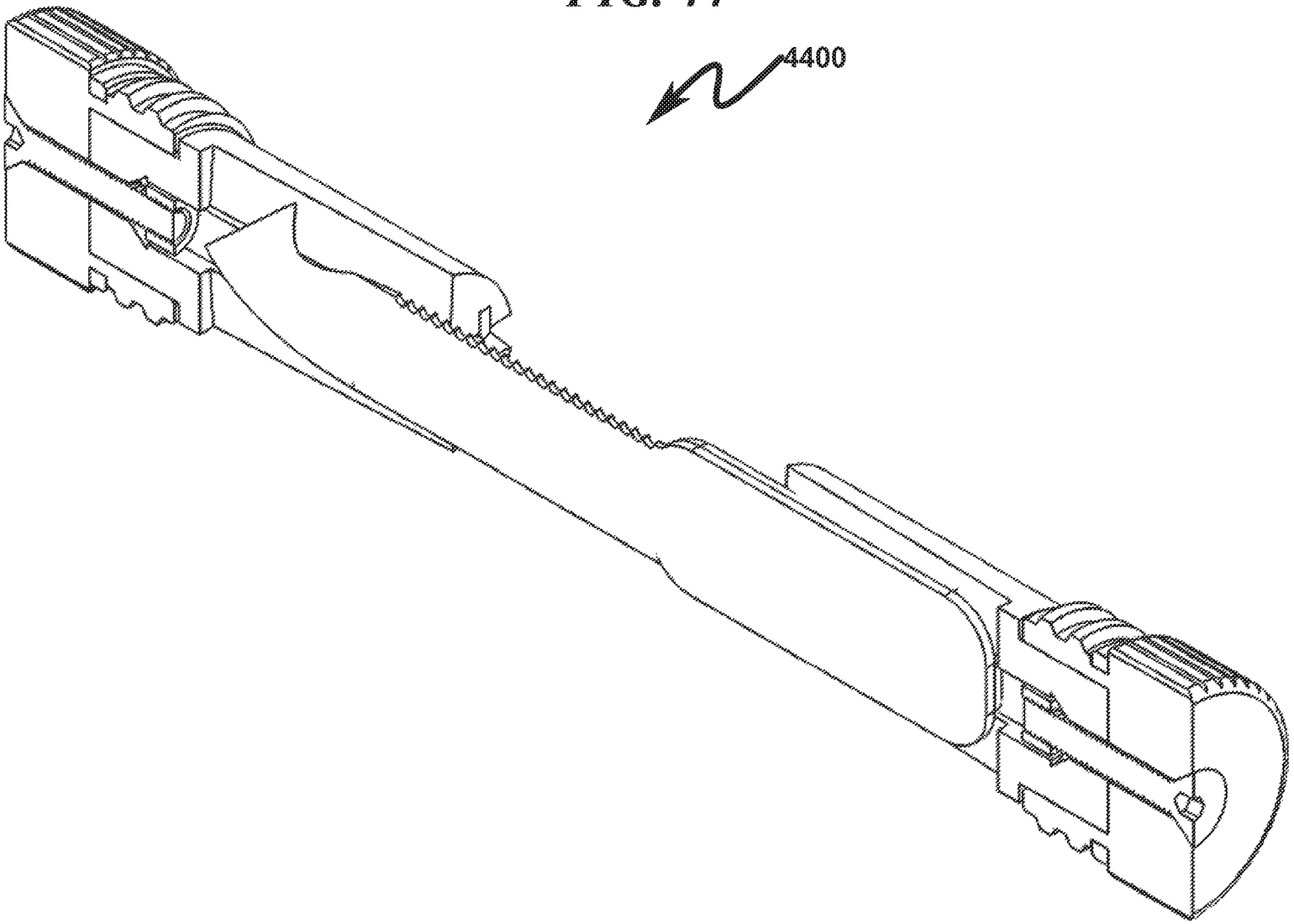
FIG. 44 illustrates a front top perspective assembly front section view of an alternate preferred exemplary invention embodiment (center retention tube (CRT) hidden)
Figure 45:
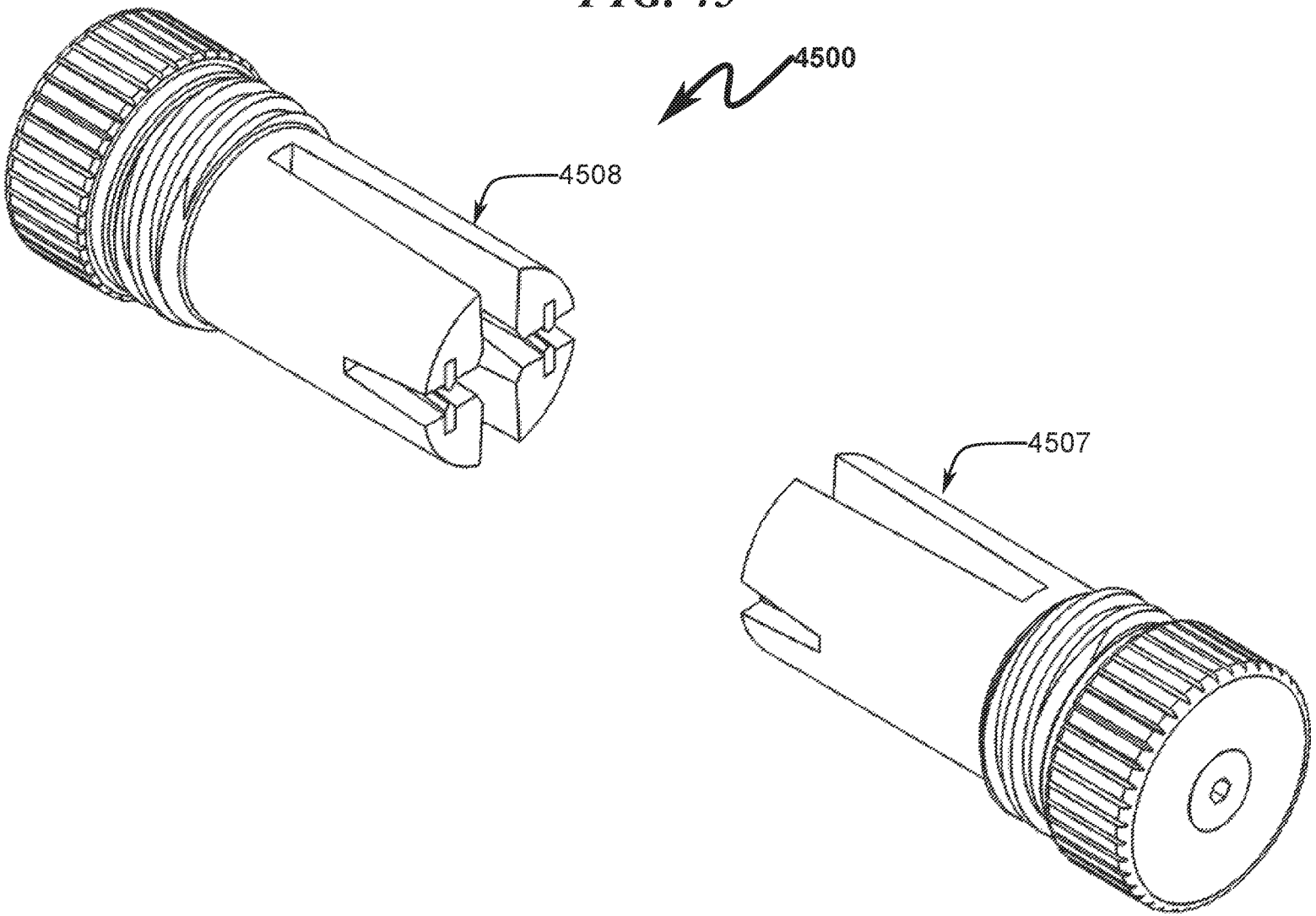
FIG. 45 illustrates a front top perspective assembly view of an alternate preferred exemplary invention embodiment (knife and center retention tube (CRT) hidden)
Figure 46:
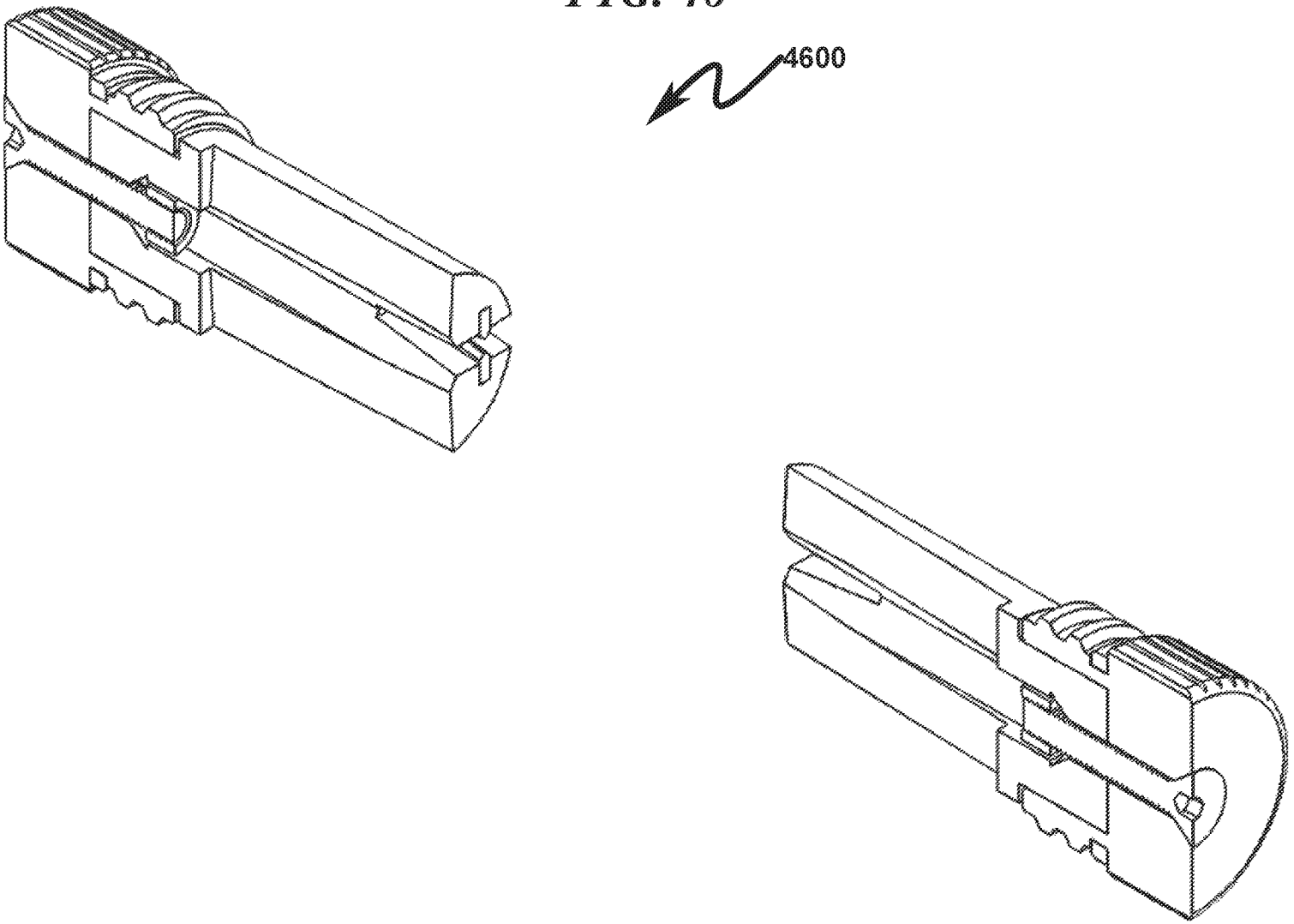
FIG. 46 illustrates a front top perspective assembly front section view of an alternate preferred exemplary invention embodiment (knife and center retention tube (CRT) hidden)
Figure 47:
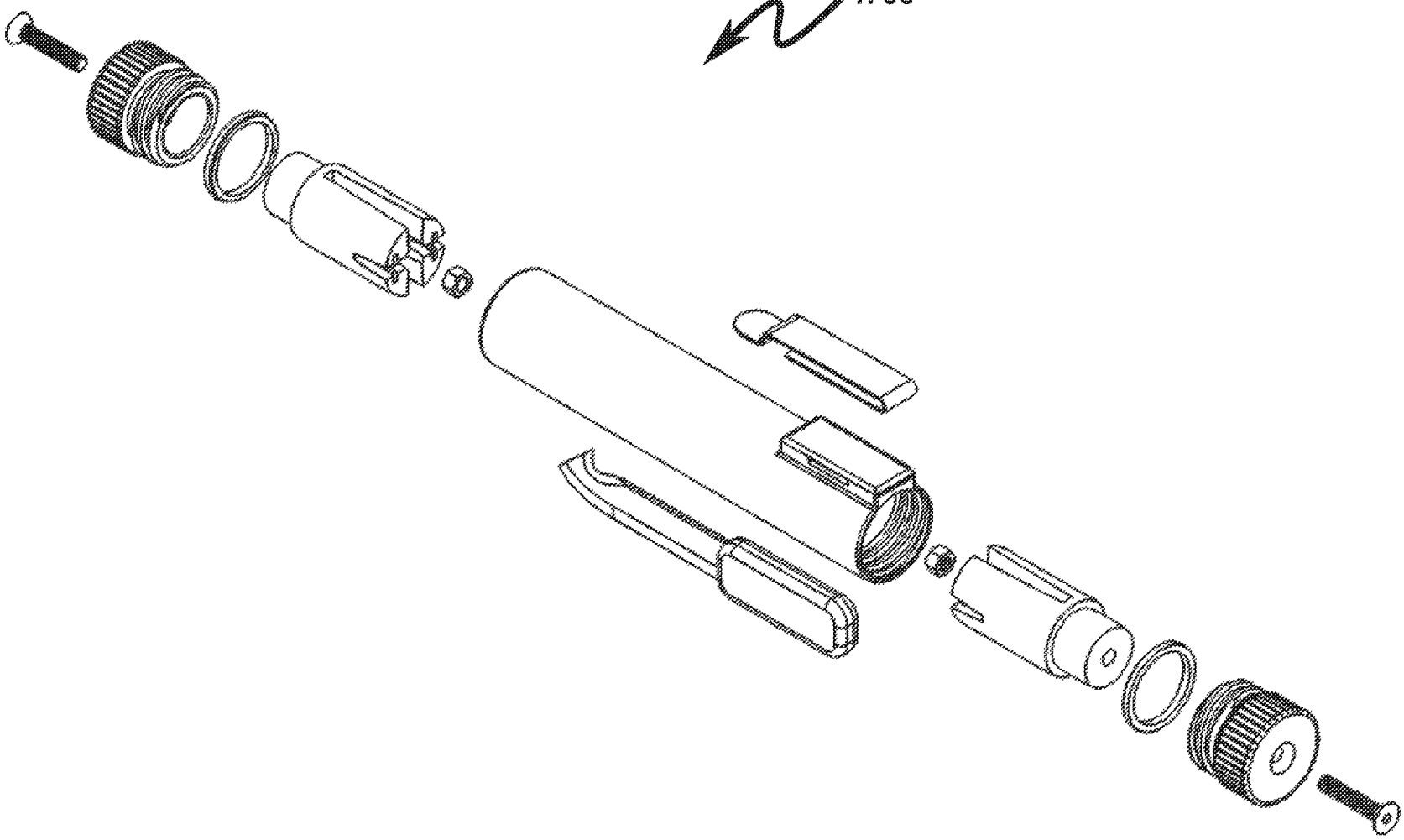
FIG. 47 illustrates a front top perspective exploded view of an alternate preferred exemplary invention embodiment.
Figure 48:
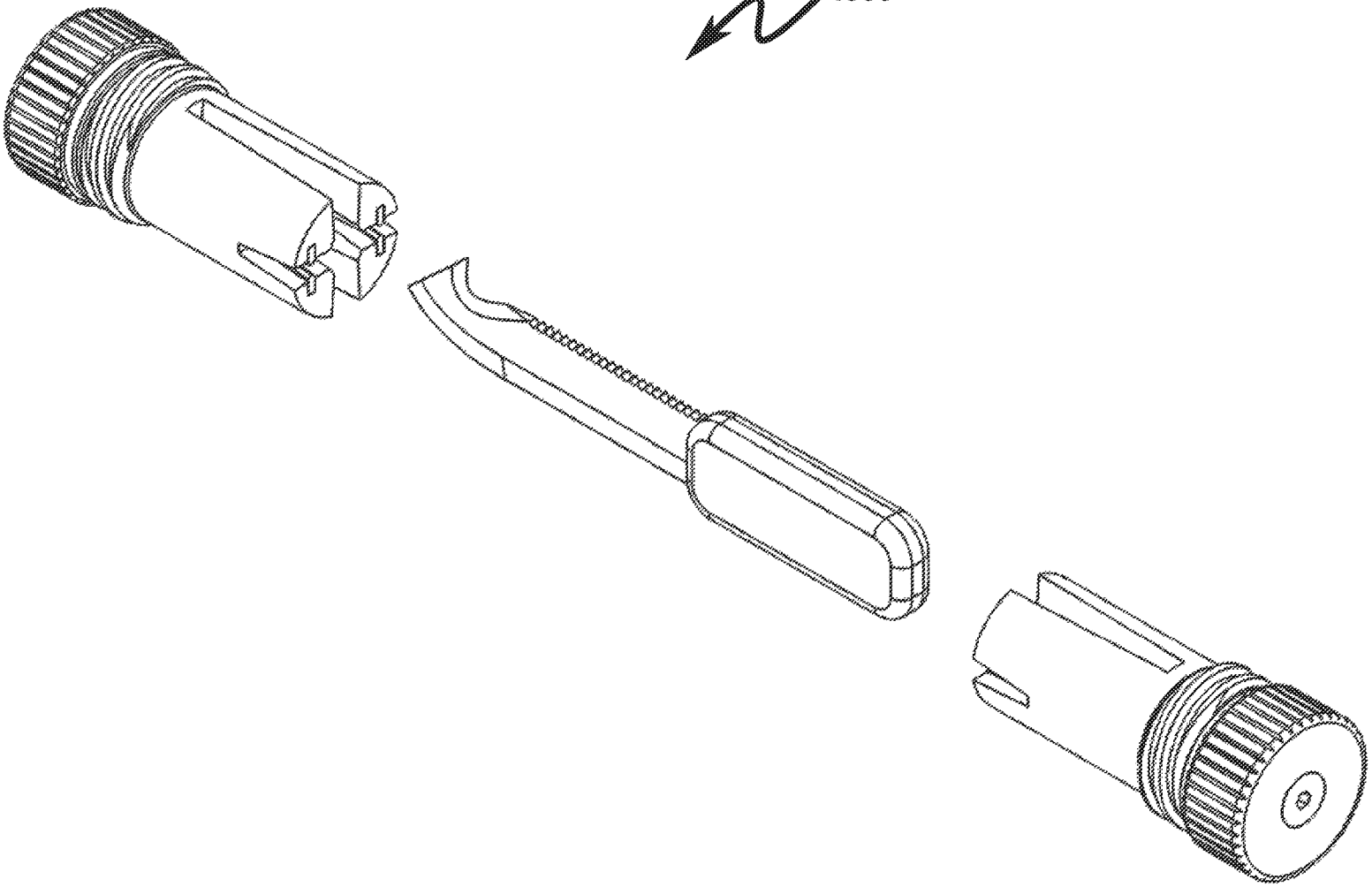
FIG. 48 illustrates a front top perspective exploded view of an alternate preferred exemplary invention embodiment (center retention tube (CRT) hidden)
Figure 49:
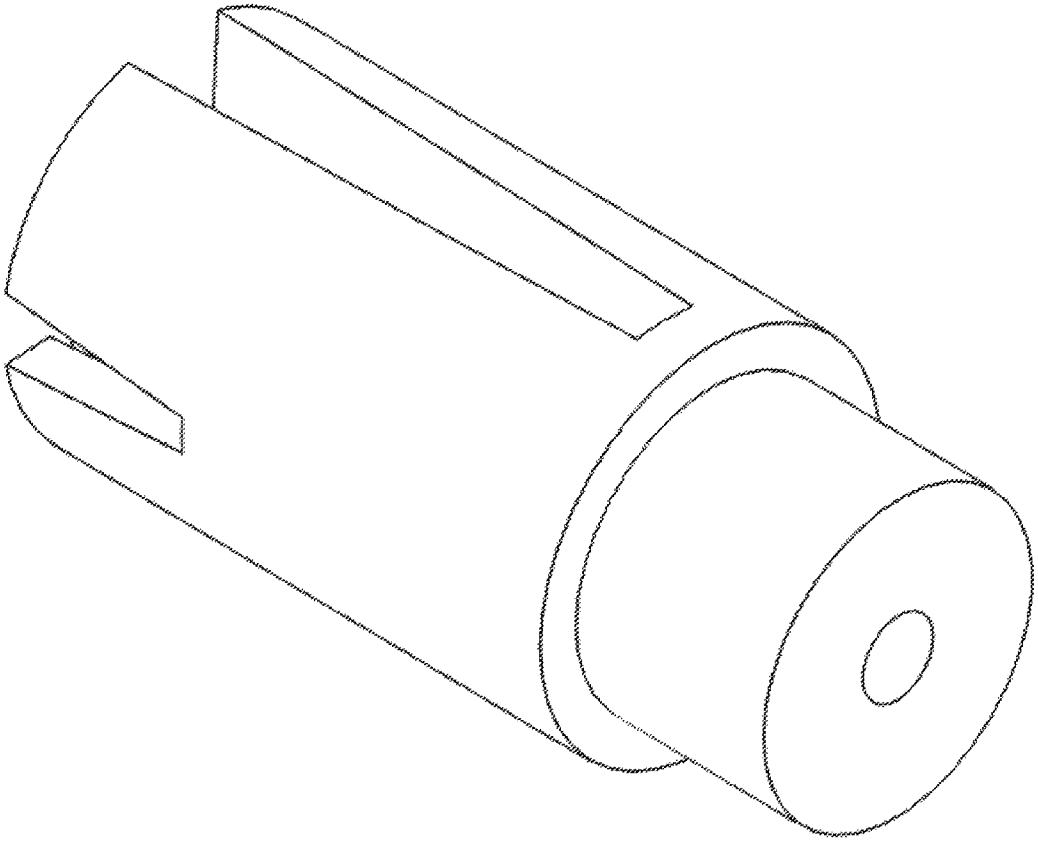
FIG. 49 illustrates a right front top perspective view of an exemplary knife retention insert (KRI)
Figure 50:
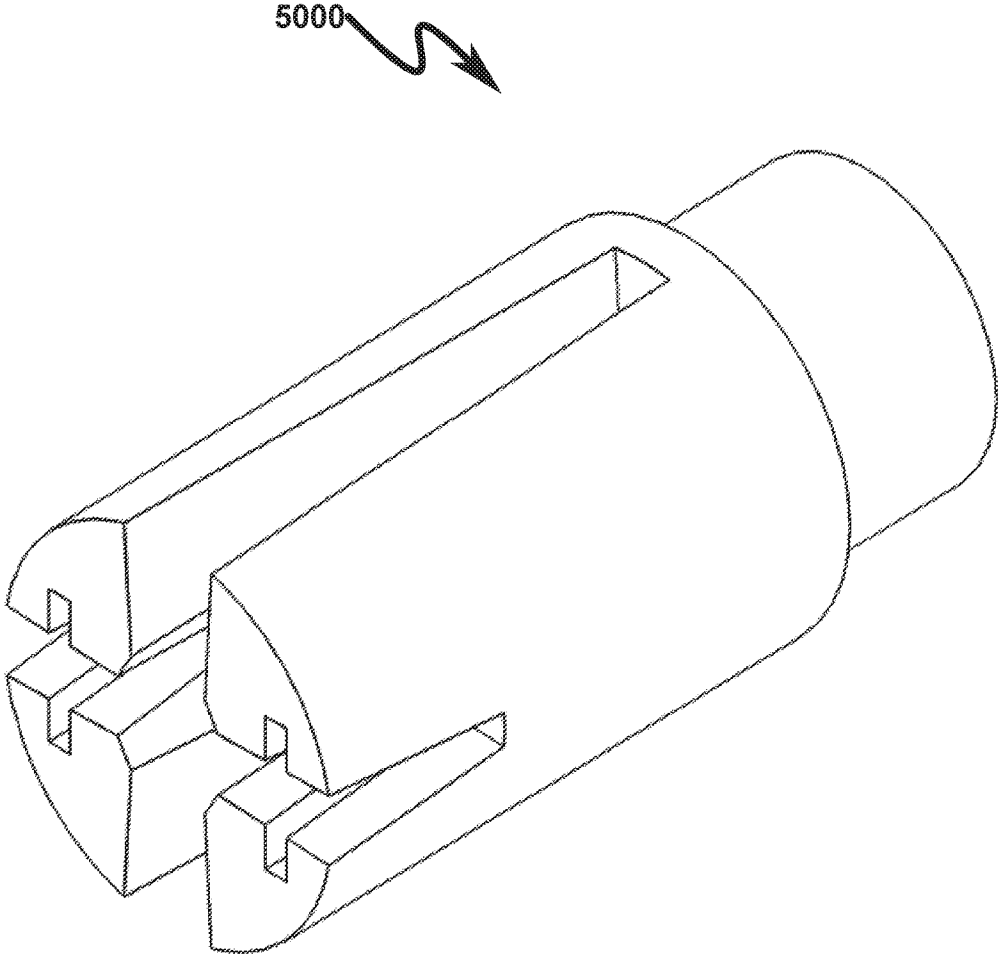
FIG. 50 illustrates a right rear top perspective view of an exemplary knife retention insert (KRI)
Figure 51:
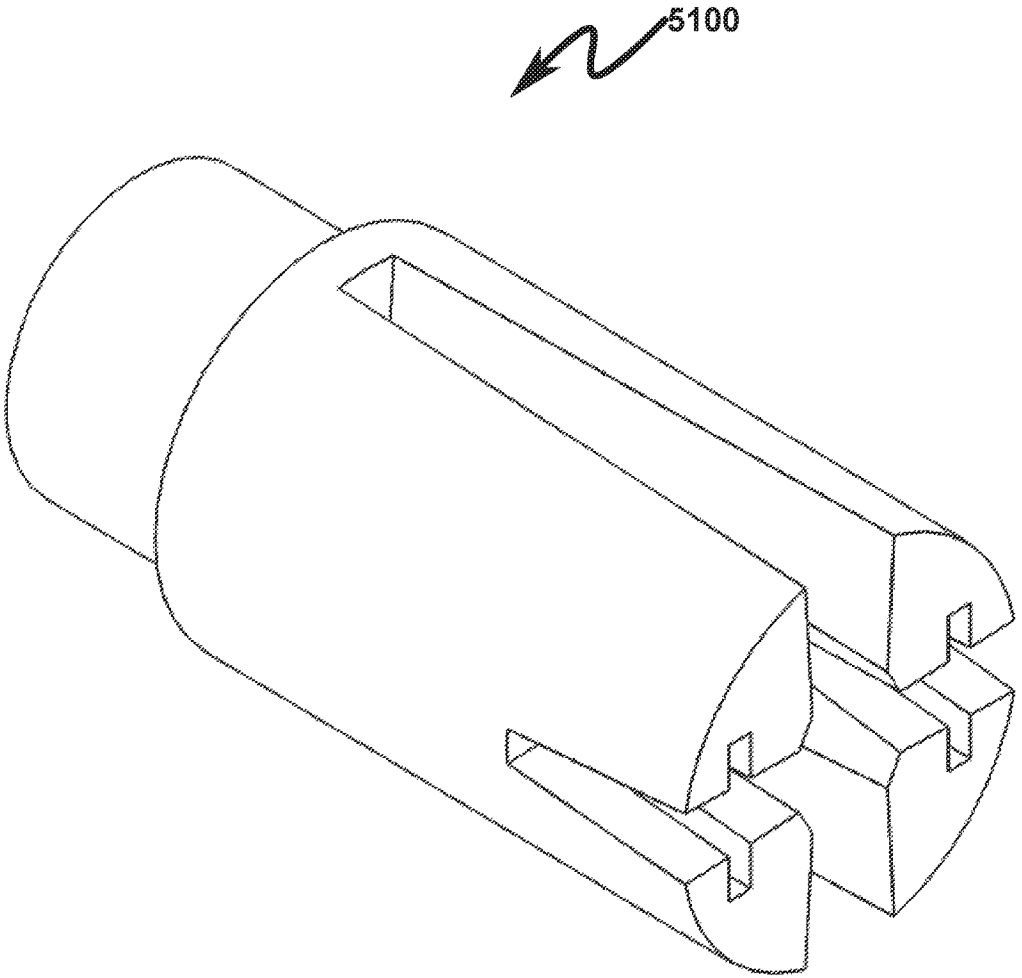
FIG. 51 illustrates a left rear top perspective view of an exemplary knife retention insert (KRI)
Figure 52:
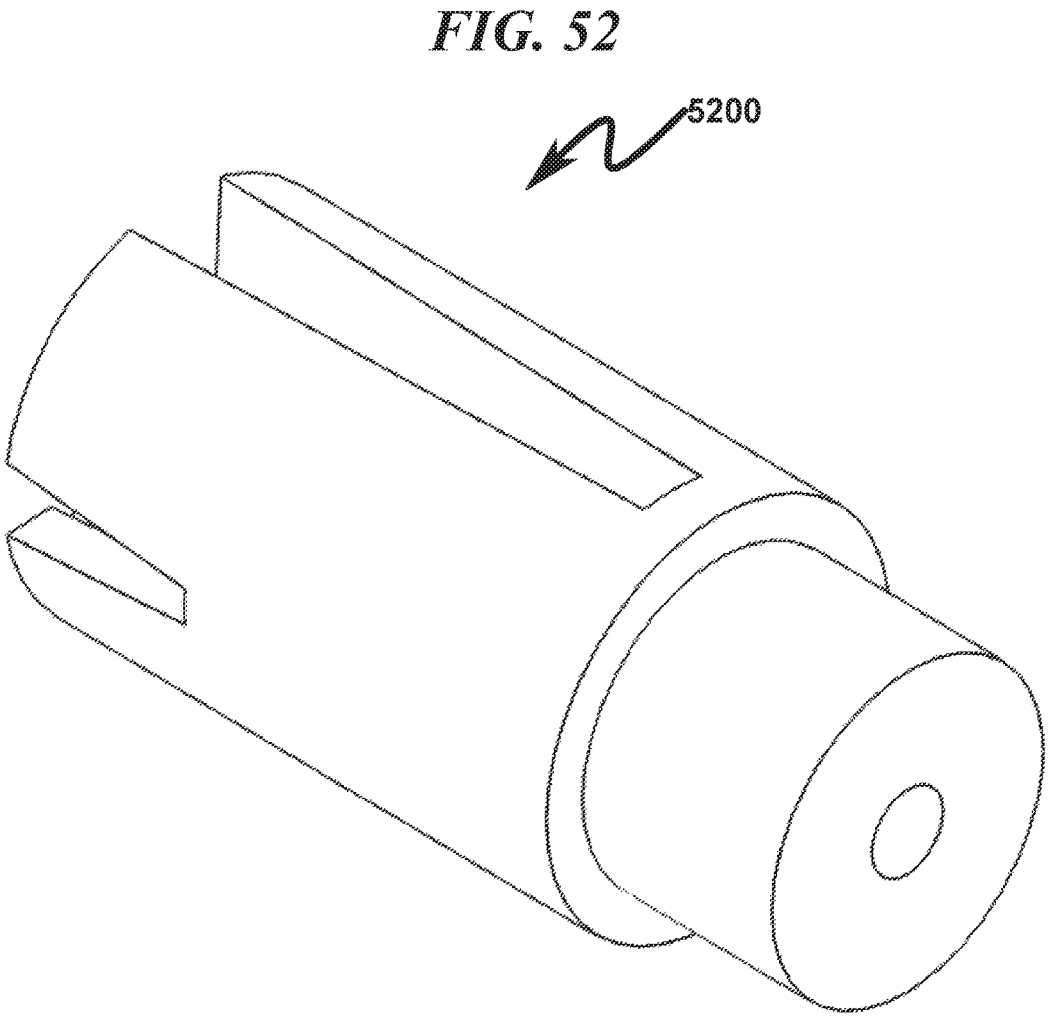
FIG. 52 illustrates a left front top perspective view of an exemplary knife retention insert (KRI)
Figure 53:
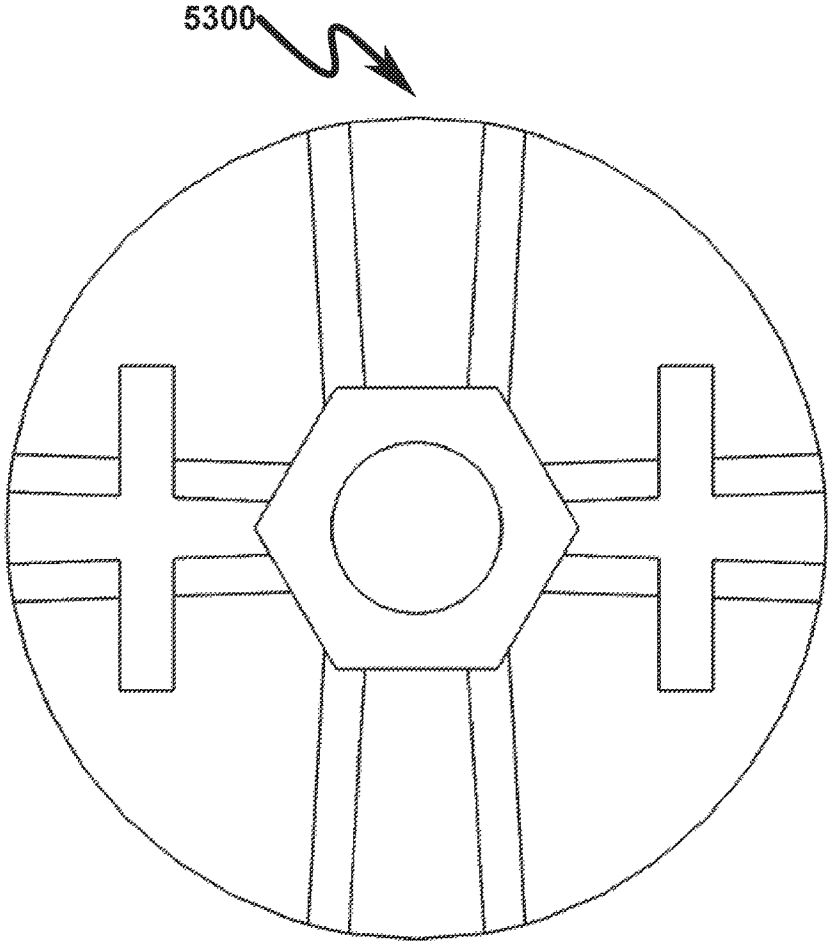
FIG. 53 illustrates an end view of an exemplary knife retention insert (KRI)
Figure 58:
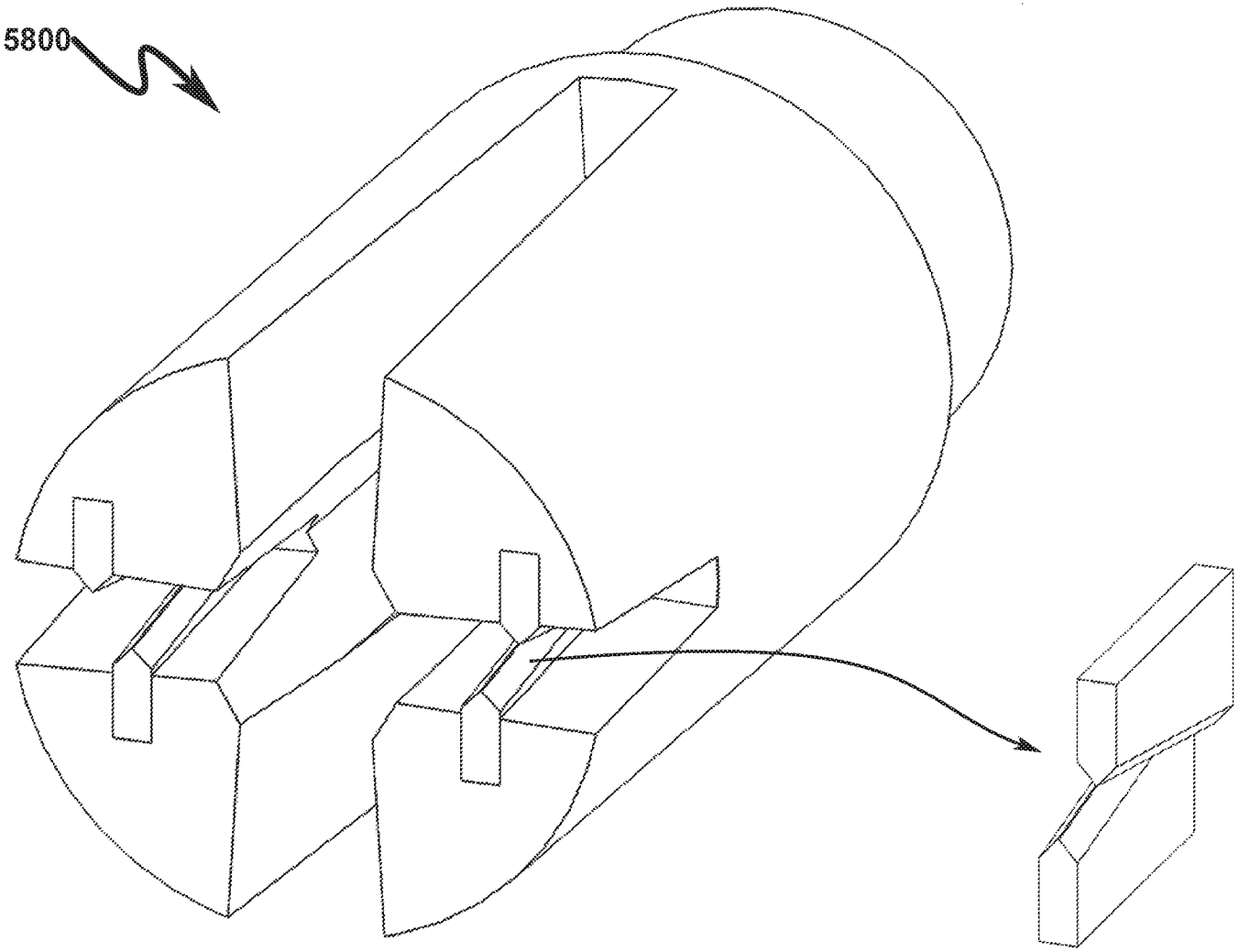
FIG. 58 illustrates a front left side top perspective view of an exemplary knife retention insert (KRI) with knife sharpening inserts (KSI) installed.

The present invention may also incorporate additional features as generally depicted in FIG. 33 (3300)-FIG. 58 (5800). Here it can be seen that the end-caps (3903, 3904) may be constructed to be identical. Furthermore, the retaining clip (3902) may be incorporated within the CRT (3901).

Additionally, as depicted in these drawings the knife retention cylinders/inserts (KRI) (4507, 4508) may incorporate optional knife sharpening inserts (KSI) (5411, 5412). These knife sharpening inserts (KSI) (5411, 5412) permit field sharpening of the knife without disrupting the secure storage of the knife when in transit. The knife sharpening inserts (KSI) (5411, 5412) may comprise metal, tungsten carbide, and/or ceramic and are configured in a V-shaped fashion to facilitate knife sharpening. Different types of sharpening inserts may be configured on each end-cap of the CRT.

Figure 54:
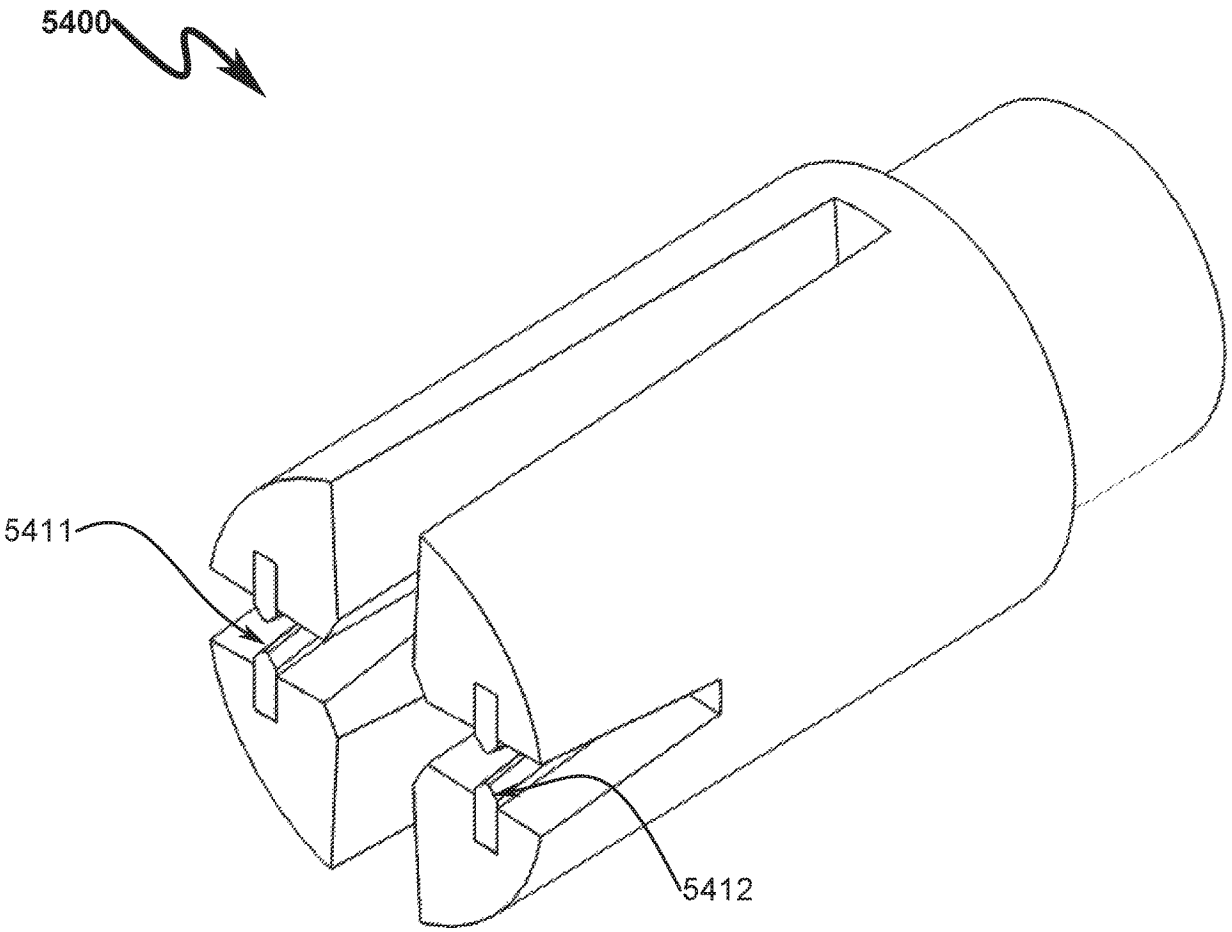
FIG. 54 illustrates a front left side top perspective view of an exemplary knife retention insert (KRI) with knife sharpening inserts (KSI) installed.
Figure 56:
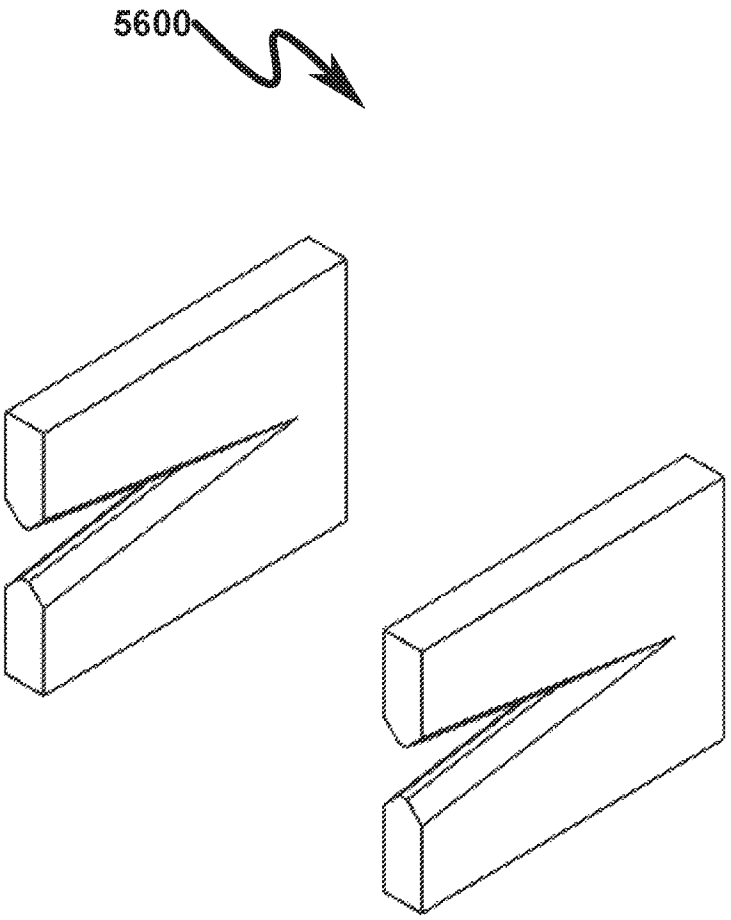
FIG. 56 illustrates a right rear top perspective view of an exemplary set of knife sharpening inserts (KSI)
Figure 57:
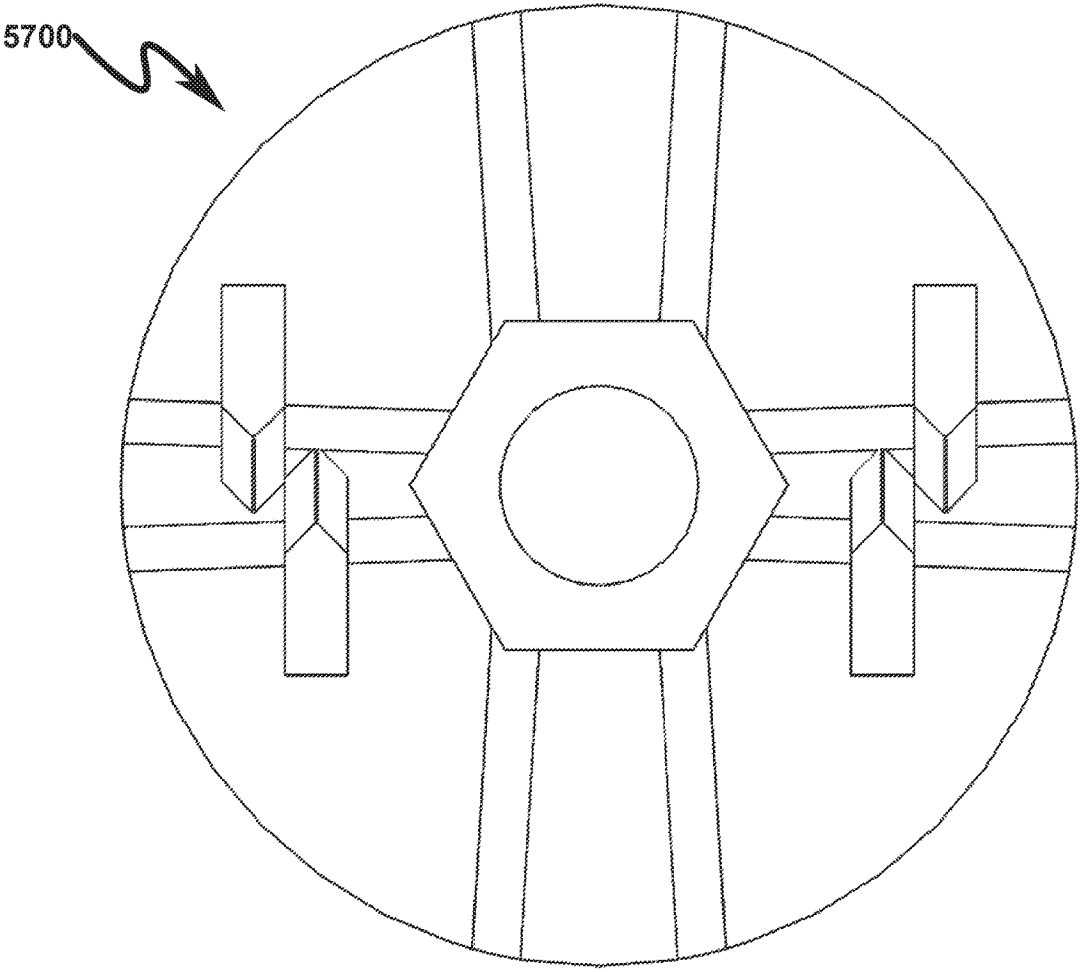
FIG. 57 illustrates an end view of an alternative exemplary knife retention insert (KRI) with knife sharpening inserts (KSI) installed.

The knife sharpening inserts (KSI) (5411, 5412) are depicted as a unitary structure in FIG. 54 (5400)-FIG. 56 (5600) but may also be configured as separate inserts that are configured in a V-shaped fashion as generally depicted in FIG. 57 (5700)-FIG. 58 (5800).

Double-Sided End-Cap (5900)-(6300)

Figure 59:
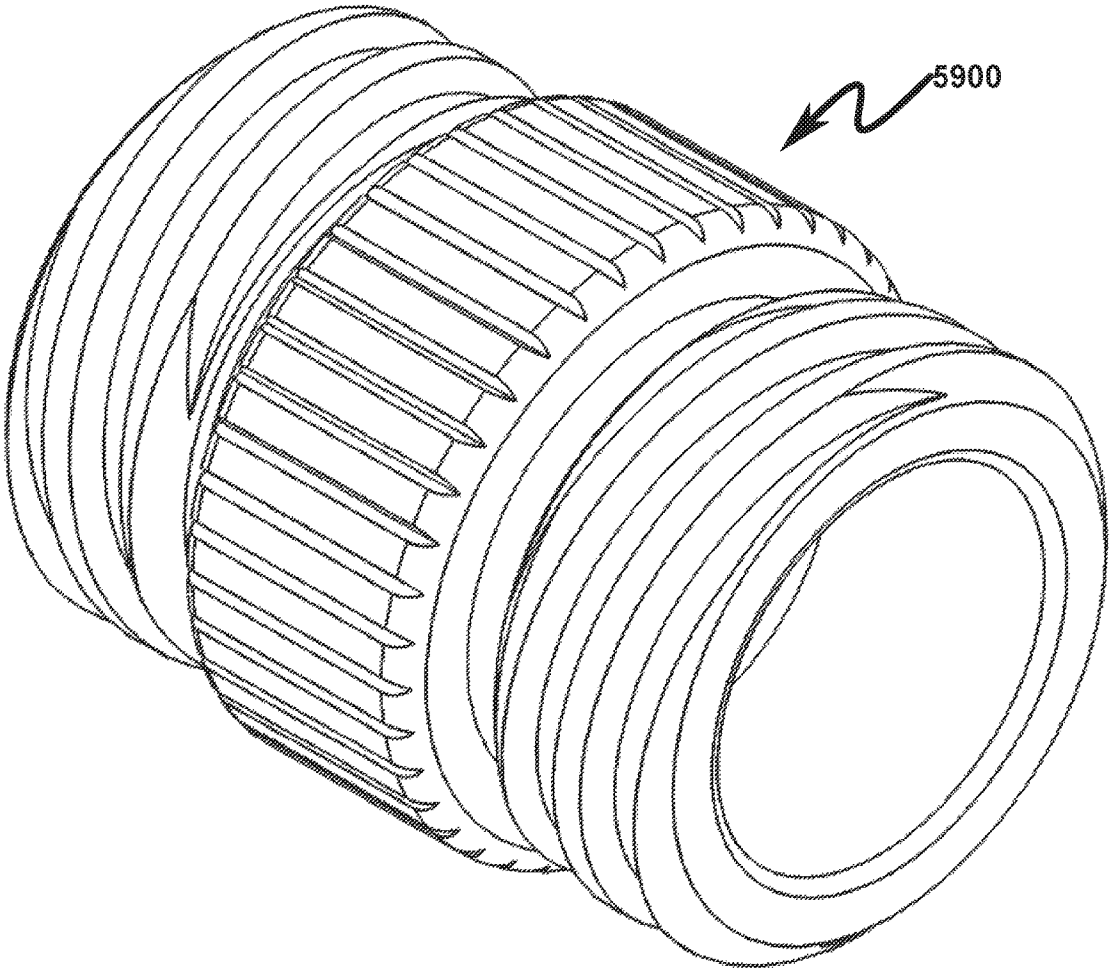
FIG. 59 illustrates a right front top perspective view of an exemplary double-sided end-cap used to extend the safe operating distance of the knife sharpener.
Figure 60:
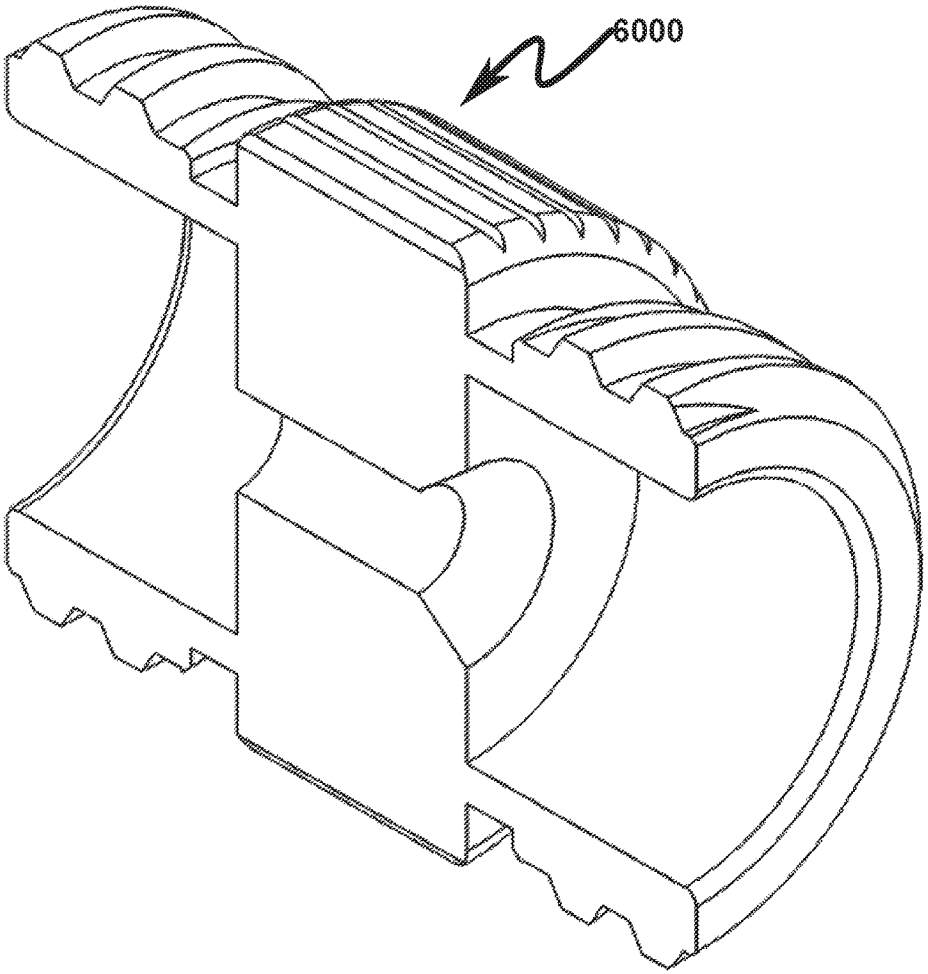
FIG. 60 illustrates a right front top perspective section view of an exemplary double-sided end-cap used to extend the safe operating distance of the knife sharpener.
Figure 61:
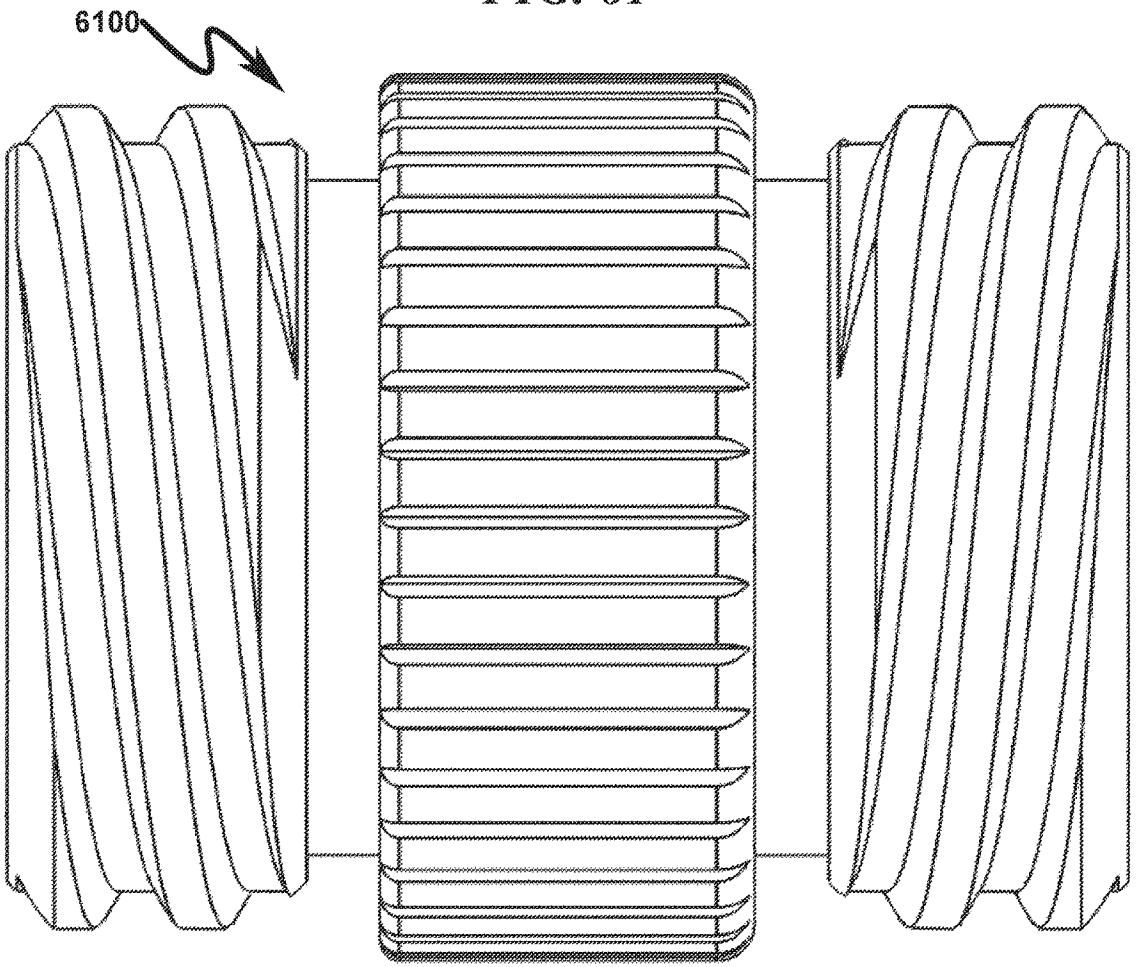
FIG. 61 illustrates a front side view of an exemplary double-sided end-cap used to extend the safe operating distance of the knife sharpener.
Figure 62:
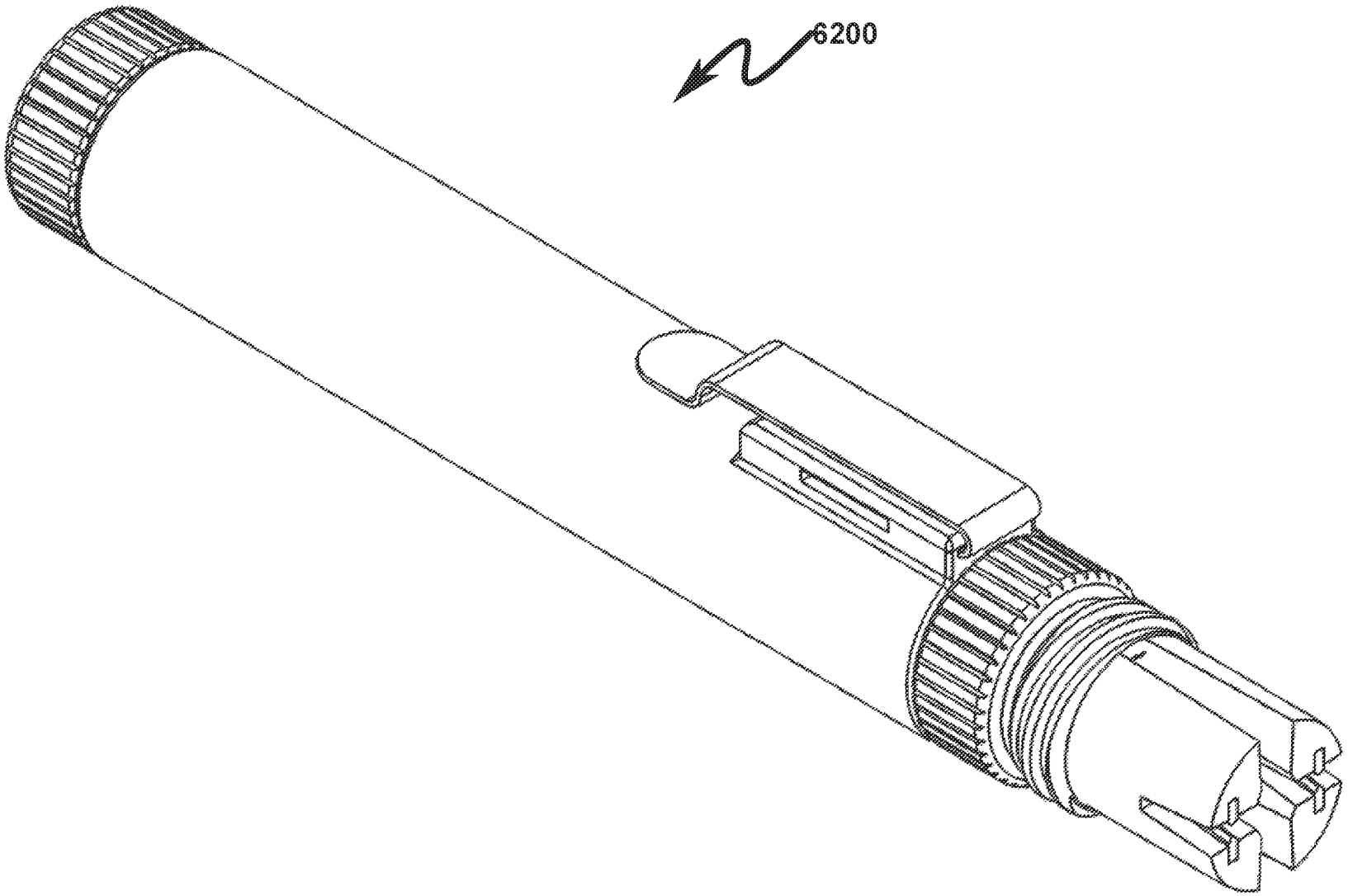
FIG. 62 illustrates a right front top perspective view of a preferred exemplary invention embodiment configured with a double-sided end-cap used to extend the safe operating distance of the knife sharpener.
Figure 63:
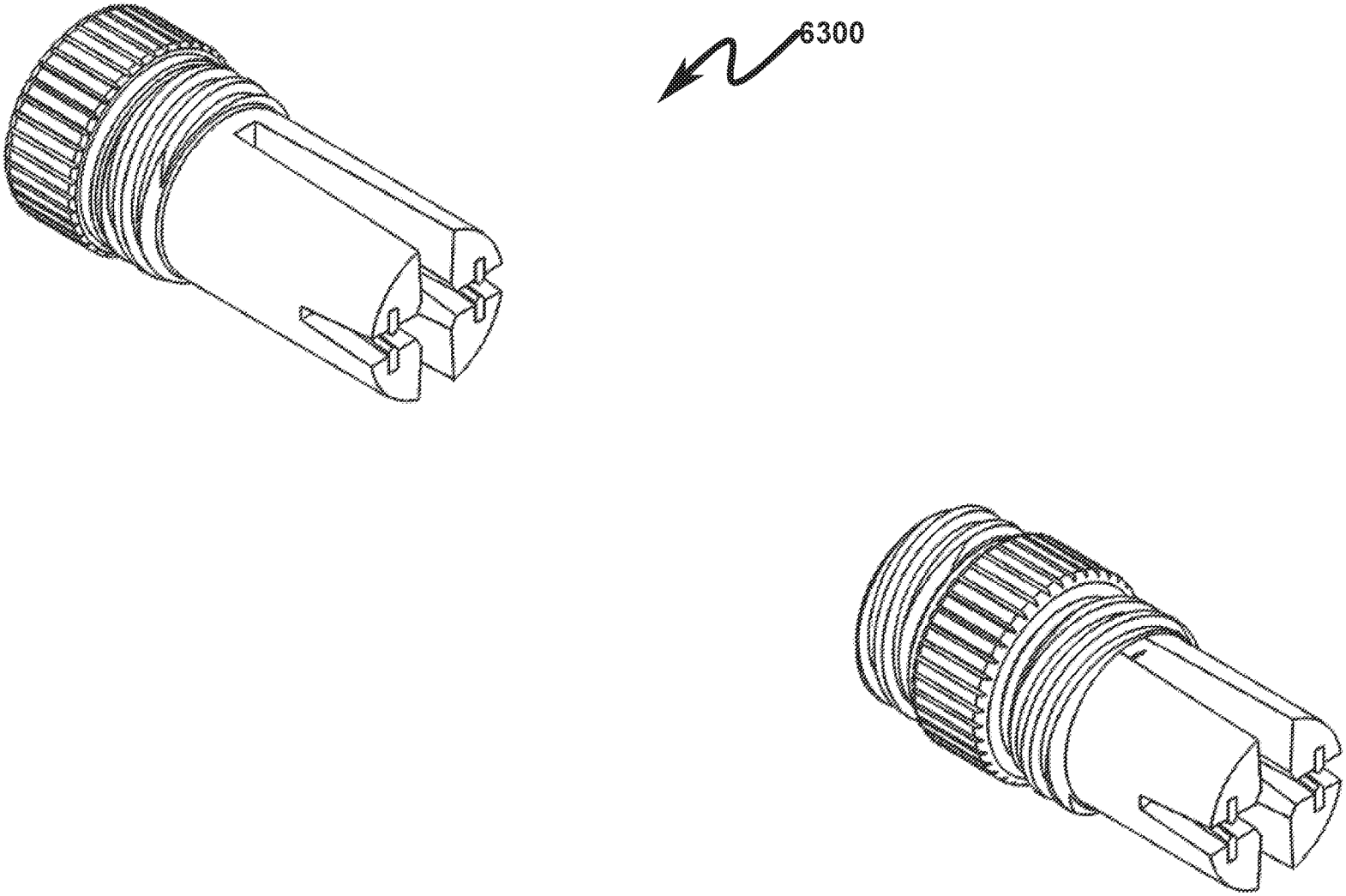
FIG. 63 illustrates a right front top perspective view of a preferred exemplary invention embodiment configured with a double-sided end-cap used to extend the safe operating distance of the knife sharpener (center retention tube (CRT) hidden)

In some preferred embodiments a double-sided end-cap may be provided for as generally depicted in FIG. 59 (5900)-FIG. 63 (6300). In these configurations the FEC and/or SEC may be configured with double-sided threading (threading on both ends) to permit the end-cap to be reversed within the CRT. This configuration permits the knife retention insert (KRI) to be mounted external to the center retention tube (CRT) as depicted in the assembly drawing of FIG. 62 (6200) and FIG. 63 (6300) such that the knife sharpening inserts (KSI) are positioned at the end of the CRT. This allows the CRT to be grasped away from the KSI when sharpening the knife and thus provides an added degree of safety during the sharpening operation by keeping the knife edge away from the hand that supports the CRT/KSI combination.

Figure 55:
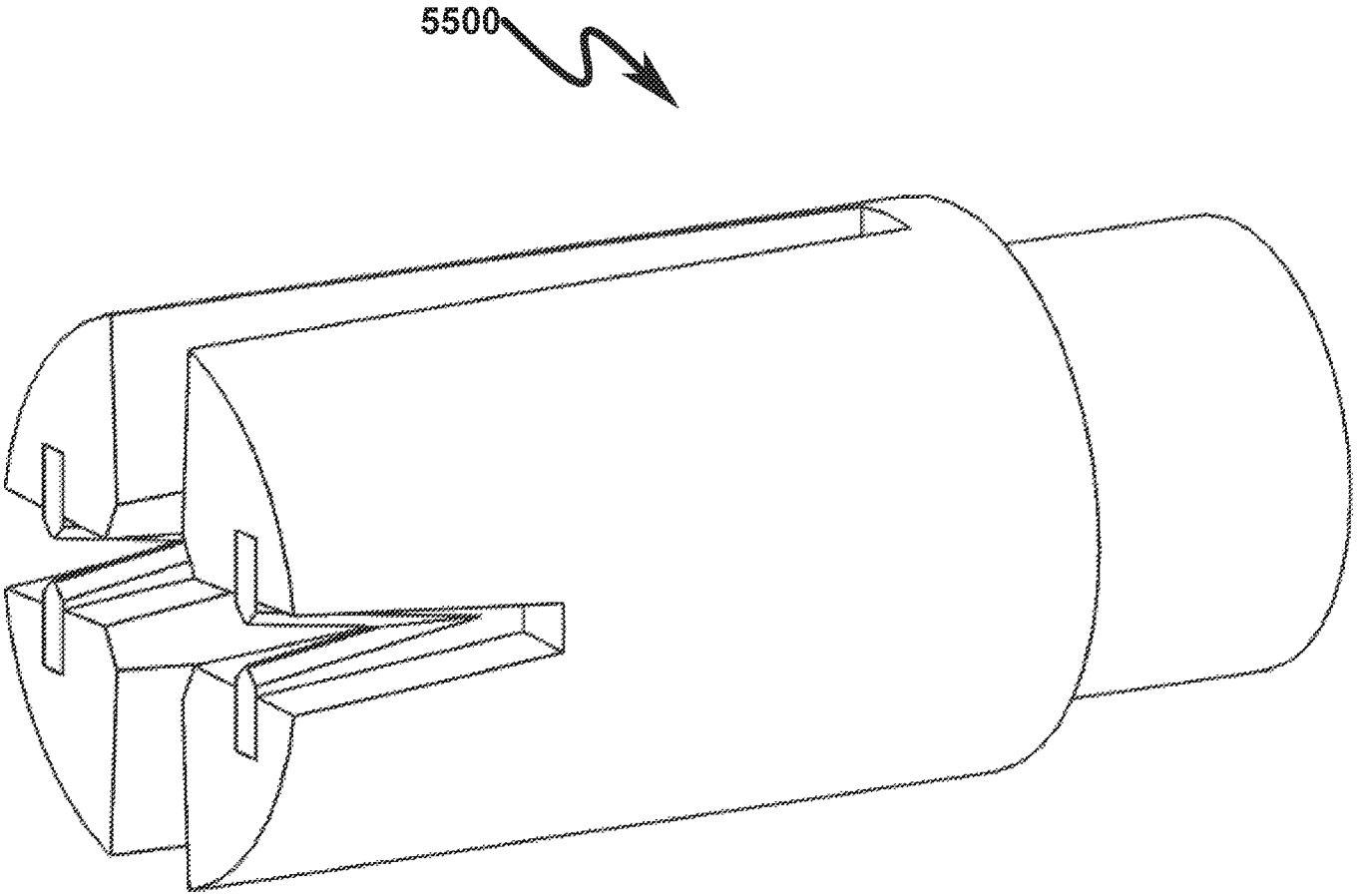
FIG. 55 illustrates a front left side top perspective view of an exemplary knife retention insert (KRI) with knife sharpening inserts (KSI) installed.

As a contrast between single-ended threading and double-sided threading, FIG. 63 (6300) illustrates a single-ended threaded end-cap on the left and a double-ended threaded end-cap on the right that has been reversed in direction to support the assembled knife sharpening structure as depicted in FIG. 62 (6200). While it is possible to grasp the knife sharpening structure as depicted in FIG. 54 (5400)-FIG. 55 (5500) and FIG. 57 (5700)-FIG. 58 (5800), it is safer to grasp the elongated CRT as depicted in FIG. 62 (6200) farther away from the knife sharpening inserts when performing the knife sharpening operation.

Method Overview (6400)

Figure 64:
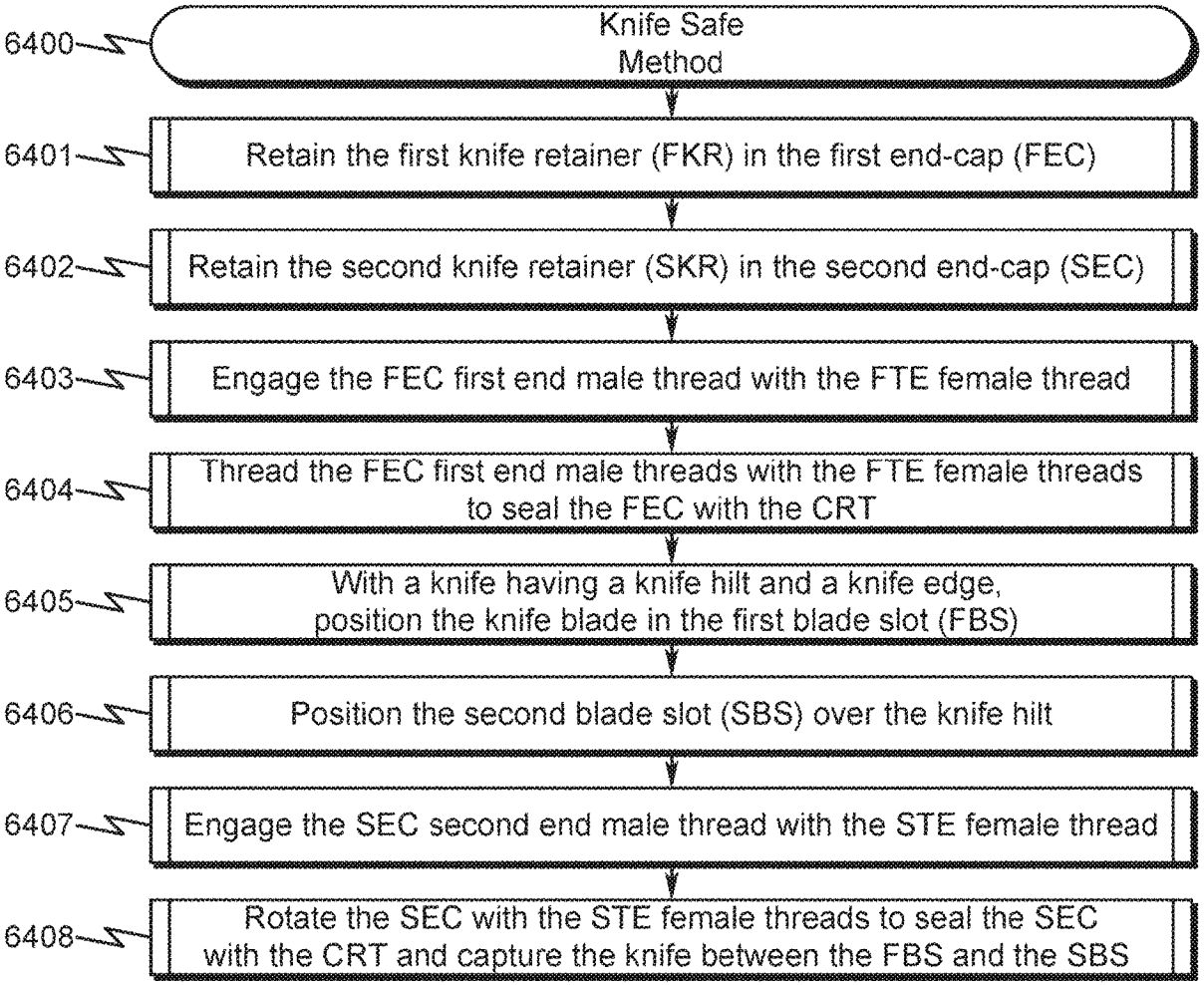
FIG. 64 illustrates an exemplary flowchart depicting a preferred invention method embodiment.

In conjunction with the above-described invention system, a present invention method may implement knife storage with advantageous characteristics. The present invention method may be understood by viewing the flowchart depicted in FIG. 64 (6400) and broadly generalized as a knife storage method utilizing a knife storage system, said method comprising:

(1) Retaining the first knife retainer (FKR) in the first end-cap (FEC) (6401);
(2) Retaining the second knife retainer (SKR) in the second end-cap (SEC) (6402);
(3) Engage the FEC first end male thread with the FTE female thread (6403);
(4) Thread the FEC first end male threads with the FTE female threads to seal the FEC with the CRT (6404);
(5) With a knife having a knife hilt and a knife edge, positioning the knife blade in the first blade slot (FBS) (6405);
(6) Position the second blade slot (SBS) over the knife hilt (6406);
(7) Engaging the SEC second end male threads with the STE female threads; (6407) and;
(8) Rotate the SEC with the STE female threads to seal the SEC with the CRT and capture the knife between the FBS and the SBS (6408).

This general method may be modified heavily depending on a number of factors, with rearrangement and/or addition/deletion of steps anticipated by the scope of the present invention. Integration of this and other preferred exemplary embodiment methods in conjunction with a variety of preferred exemplary embodiment systems described herein is anticipated by the overall scope of the present invention.

System Summary

The present invention system may be broadly generalized as a knife storage system comprising:

(a) center retention tube (CRT);
(b) first end-cap (FEC);
(c) second end-cap (SEC);
(d) first knife retainer (FKR);
(e) second knife retainer (SKR);
(f) first knife sharpener (FKS); and
(g) second knife sharpener (SKS);

wherein:

the CRT comprises an elongated tube having an outer tubular surface (OTS) and an inner tubular surface (ITS);
the CRT comprises a first distal end (FDE) and a second distal end (SDE);
the FDE comprises a first threaded end (FTE) comprising female threads formed on the ITS;
the SDE comprises a second female threaded end (STE) comprising female threads formed on the ITS;
the FKR comprises a first knife cap (FKC) and a first retention end (FRE);
the FRE comprises a first blade slot (FBS) configured to retain the hilt or blade of a knife;
the FRE comprises a first sharpening slot (FSS) configured to retain a V-shaped knife sharpener;
the FKR comprises a first knife cap (FKC) and a first retention end (FRE);
the SRE comprises a second blade slot (SBS) configured to retain the hilt or blade of a knife;
the SRE comprises a second sharpening slot (SSS) configured to retain a V-shaped knife sharpener;
the FEC comprises a first end and a second end;
the FEC first end comprises male threads configured to mate with the FTE female threads;
the FEC first end comprises a cylindrical inset configured to receive the FKC;
the SEC comprises a first end and a second end;
the SEC first end comprises male threads configured to mate with the STE;
the SEC first end comprises a cylindrical inset configured to receive the SKC;
the FKR is attached to the FEC;
the SKR is attached to the SEC;
the FKS is retained within the FSS; and
the SKS is retained within the SSS.

This general system summary may be augmented by the various elements described herein to produce a wide variety of invention embodiments consistent with this overall design description.

Method Summary

The present invention method may be broadly generalized as a knife storage method operating on a knife storage system comprising:

(a) center retention tube (CRT);
(b) first end-cap (FEC);
(c) second end-cap (SEC);
(d) first knife retainer (FKR);
(e) second knife retainer (SKR);
(f) first knife sharpener (FKS); and
(g) second knife sharpener (SKS);

wherein:

the CRT comprises an elongated tube having an outer tubular surface (OTS) and an inner tubular surface (ITS);
the CRT comprises a first distal end (FDE) and a second distal end (SDE);
the FDE comprises a first threaded end (FTE) comprising female threads formed on the ITS;
the SDE comprises a second female threaded end (STE) comprising female threads formed on the ITS;
the FKR comprises a first knife cap (FKC) and a first retention end (FRE);
the FRE comprises a first blade slot (FBS) configured to retain the hilt or blade of a knife;
the FRE comprises a first sharpening slot (FSS) configured to retain a V-shaped knife sharpener;
the FKR comprises a first knife cap (FKC) and a first retention end (FRE);
the SRE comprises a second blade slot (SBS) configured to retain the hilt or blade of a knife;
the SRE comprises a second sharpening slot (SSS) configured to retain a V-shaped knife sharpener;
the FEC comprises a first end and a second end;
the FEC first end comprises male threads configured to mate with the FTE female threads;
the FEC first end comprises a cylindrical inset configured to receive the FKC;
the SEC comprises a first end and a second end;
the SEC first end comprises male threads configured to mate with the STE;
the SEC first end comprises a cylindrical inset configured to receive the SKC;
the FKR is attached to the FEC;
the SKR is attached to the SEC;
the FKS is retained within the FSS; and
the SKS is retained within the SSS;

wherein the method comprises the steps of:

(1) retaining the first knife retainer (FKR) in the first end-cap (FEC) (6401);
(2) retaining the second knife retainer (SKR) in the second end-cap (SEC) (6402);
(3) engaging the FEC first end male thread with the FTE female thread (6403);
(4) threading the FEC first end male threads with the FTE female threads to seal the FEC with the CRT (6404);
(5) with a knife having a knife hilt and a knife edge, positioning the knife blade in the first blade slot (FBS) (6405);
(6) positioning the second blade slot (SBS) over the knife hilt (6406);
(7) engaging the SEC second end male threads with the STE female threads; (6407) and;
(8) rotating the SEC with the STE female threads to seal the SEC with the CRT and capture the knife between the FBS and the SBS (6408).

This general method may be modified heavily depending on a number of factors, with rearrangement and/or addition/deletion of steps anticipated by the scope of the present invention. Integration of this and other preferred exemplary embodiment methods in conjunction with a variety of preferred exemplary embodiment systems described herein is anticipated by the overall scope of the present invention.

System/Method Variations

The present invention anticipates a wide variety of variations in the basic theme of construction. The examples presented previously do not represent the entire scope of possible usages. They are meant to cite a few of the almost limitless possibilities.

This basic system, method, and product-by-process may be augmented with a variety of ancillary embodiments, including but not limited to:

An embodiment wherein the FTE and the STE comprise threads having a lead greater than unity.
An embodiment wherein the CRT has a circular diameter less than or equal to 2.5 inches.
An embodiment wherein the CRT has an overall length less than or equal to 14 inches.
An embodiment wherein the CRT, the FEC, and the SEC comprise plastic.
An embodiment wherein the OTS further comprises an extruded void configured to receive a metal retention clip (MRC).
An embodiment wherein the FKR is mechanically attached to the FEC with a fastener and the SKR is mechanically attached to the SEC with a fastener.
An embodiment wherein the FKR and the FEC form a unitary structure and the SKR and the SEC form a unitary structure.
An embodiment wherein the FEC and the SEC further comprise a sealing ring configured to form a non-permeable liquid barrier at the interfaces between the FEC and the FDE and between the SEC and the SDE.
An embodiment wherein the FKS comprises a tungsten carbide knife sharpening insert (KSI) and the SKS comprises a ceramic knife sharpening insert (KSI).
An embodiment wherein:
the FKS comprises a tungsten carbide knife sharpening insert (KSI);
the SKS comprises a ceramic knife sharpening insert (KSI);
the FEC is configured with double-sided threading; and
the SEC is configured with double-sided threading.

One skilled in the art will recognize that other embodiments are possible based on combinations of elements taught within the above invention description.

CONCLUSION

A knife storage system and method has been disclosed. The system and method utilize a resealable tube with retractable end-caps to safely store a hunting knife that may be contaminated with blood residue from a game animal that has been field dressed. The end-caps are configured with grooved cylinders to safely restrain a hunting knife so as to prevent dulling of the knife edge while simultaneously providing a fluid seal to the resealable tube to prevent contamination of the tube exterior with blood or other animal residue. Removal of both end-caps permits the tube and end-caps to be cleaned of game residue. Incorporated within the end-caps are integrated knife sharpening inserts comprised of ceramic and tungsten carbide to allow the knife to be safely sharpened in the field.

Claims Interpretation

The following rules apply when interpreting the CLAIMS of the present invention:

The CLAIM PREAMBLE should be considered as limiting the scope of the claimed invention.

"WHEREIN" clauses should be considered as limiting the scope of the claimed invention.

"WHEREBY" clauses should be considered as limiting the scope of the claimed invention.

"ADAPTED TO" clauses should be considered as limiting the scope of the claimed invention.

"ADAPTED FOR" clauses should be considered as limiting the scope of the claimed invention.

The term "MEANS" specifically invokes the means-plus-function claims limitation recited in 35 U.S.C. § 112(f) and such claim shall be construed to cover the corresponding structure, material, or acts described in the specification and equivalents thereof.

The phrase "MEANS FOR" specifically invokes the means-plus-function claims limitation recited in 35 U.S.C. § 112(f) and such claim shall be construed to cover the corresponding structure, material, or acts described in the specification and equivalents thereof.

The phrase "STEP FOR" specifically invokes the step-plus-function claims limitation recited in 35 U.S.C. § 112(f) and such claim shall be construed to cover the corresponding structure, material, or acts described in the specification and equivalents thereof.

The step-plus-function claims limitation recited in 35 U.S.C. § 112(f) shall be construed to cover the corresponding structure, material, or acts described in the specification and equivalents thereof ONLY for such claims including the phrases "MEANS FOR", "MEANS", or "STEP FOR".

The phrase "AND/OR" in the context of an expression "X and/or Y" should be interpreted to define the set of "(X and Y)" in union with the set "(X or Y)" as interpreted by Ex Parte Gross (USPTO Patent Trial and Appeal Board, Appeal 2011-004811, Ser. No. 11/565,411, ("'and/or' covers embodiments having element A alone, B alone, or elements A and B taken together").

The claims presented herein are to be interpreted in light of the specification and drawings presented herein with sufficiently narrow scope such as to not preempt any abstract idea.

The claims presented herein are to be interpreted in light of the specification and drawings presented herein with sufficiently narrow scope such as to not preclude every application of any idea.

The claims presented herein are to be interpreted in light of the specification and drawings presented herein with sufficiently narrow scope such as to preclude any basic mental process that could be performed entirely in the human mind.

The claims presented herein are to be interpreted in light of the specification and drawings presented herein with sufficiently narrow scope such as to preclude any process that could be performed entirely by human manual effort.

What is claimed is:

1. A knife storage system comprising:

(a) center retention tube (CRT);

(b) first end-cap (FEC);

(c) second end-cap (SEC);

(d) first knife retainer (FKR);

(e) second knife retainer (SKR);

(f) first knife sharpener (FKS); and (g) second knife sharpener (SKS);

wherein:

said CRT comprises an elongated tube having an outer tubular surface (OTS) and an inner tubular surface (ITS);

said CRT comprises a first distal end (FDE) and a second distal end (SDE);

said FDE comprises a first threaded end (FTE) comprising female threads formed on said ITS;

said SDE comprises a second female threaded end (STE) comprising female threads formed on said ITS;

said FKR comprises a first knife cap (FKC) and a first retention end (FRE);

said FRE comprises a first blade slot (FBS) configured to retain a hilt or blade of a knife;

said FRE comprises a first sharpening slot (FSS) configured to retain a V-shaped knife sharpener;

said SKR comprises a second knife cap (SKC) and a second retention end (SRE);

said SRE comprises a second blade slot (SBS) configured to retain the hilt or blade of the knife;

said SRE comprises a second sharpening slot (SSS) configured to retain a V-shaped knife sharpener;

said FEC comprises a first end and a second end;

said FEC first end comprises male threads configured to mate with said FTE female threads;

said FEC first end comprises a cylindrical inset configured to receive said FKC;

said SEC comprises a first end and a second end;

said SEC first end comprises male threads configured to mate with said STE;

said SEC first end comprises a cylindrical inset configured to receive said SKC;

said FKR is attached to said FEC;

said SKR is attached to said SEC;

said FKS is retained within said FSS; and said SKS is retained within said SSS.

2. The knife storage system of claim 1 wherein said FTE and said STE comprise threads having a lead greater than unity.

3. The knife storage system of claim 1 wherein said CRT has a circular diameter less than or equal to 2.5 inches and said CRT has an overall length less than or equal to 14 inches.

4. The knife storage system of claim 1 wherein said CRT, said FEC, and said SEC comprise plastic.

5. The knife storage system of claim 1 wherein said OTS further comprises an extruded void configured to receive a metal retention clip (MRC).

6. The knife storage system of claim 1 wherein said FKR is mechanically attached to said FEC with a fastener and said SKR is mechanically attached to said SEC with a fastener.

7. The knife storage system of claim 1 wherein said FKR and said FEC form a unitary structure and said SKR and said SEC form a unitary structure.

8. The knife storage system of claim 1 wherein said FEC and said SEC further comprise a sealing ring configured to form a non-permeable liquid barrier at the interfaces between said FEC and said FDE and between said SEC and said SDE.

9. The knife storage system of claim 1 wherein said FKS comprises a tungsten carbide knife sharpening insert (KSI) and said SKS comprises a ceramic knife sharpening insert (KSI).

10. The knife storage system of claim 1 wherein:

said FKS comprises a tungsten carbide knife sharpening insert (KSI);

said SKS comprises a ceramic knife sharpening insert (KSI);

said FEC is configured with double-sided threading; and said SEC is configured with double-sided threading.

11. A knife storage method operating on a knife storage system, said system comprising:

(a) center retention tube (CRT);

(b) first end-cap (FEC);

(c) second end-cap (SEC);

(d) first knife retainer (FKR);

(e) second knife retainer (SKR);

(f) first knife sharpener (FKS); and (g) second knife sharpener (SKS);

wherein:

said CRT comprises an elongated tube having an outer tubular surface (OTS) and an inner tubular surface (ITS);

said CRT comprises a first distal end (FDE) and a second distal end (SDE);

said FDE comprises a first threaded end (FTE) comprising female threads formed on said ITS;

said SDE comprises a second female threaded end (STE) comprising female threads formed on said ITS;

said FKR comprises a first knife cap (FKC) and a first retention end (FRE);

said FRE comprises a first blade slot (FBS) configured to retain a hilt or blade of a knife;

said FRE comprises a first sharpening slot (FSS) configured to retain a V-shaped knife sharpener;

said SKR comprises a second knife cap (SKC) and a second retention end (SRE);

said SRE comprises a second blade slot (SBS) configured to retain the hilt or blade of the knife;

said SRE comprises a second sharpening slot (SSS) configured to retain a V-shaped knife sharpener;

said FEC comprises a first end and a second end;

said FEC first end comprises male threads configured to mate with said FTE female threads;

said FEC first end comprises a cylindrical inset configured to receive said FKC;

said SEC comprises a first end and a second end;

said SEC first end comprises male threads configured to mate with said STE;

said SEC first end comprises a cylindrical inset configured to receive said SKC;

said FKR is attached to said FEC;

said SKR is attached to said SEC;

said FKS is retained within said FSS; and said SKS is retained within said SSS;

wherein said method comprises the steps of:

(1) retaining said first knife retainer (FKR) in said first end-cap (FEC);

(2) retaining said second knife retainer (SKR) in said second end-cap (SEC);

(3) engaging said FEC first end male thread with said FTE female thread;

(4) threading said FEC first end male threads with said FTE female threads to seal said FEC with said CRT;

(5) with a knife having a knife hilt and a knife edge, positioning said knife blade in said first blade slot (FBS);

(6) positioning said second blade slot (SBS) over said knife hilt;

(7) engaging said SEC second end male threads with said STE female threads; and;

(8) rotating said SEC with said STE female threads to seal said SEC with said CRT and capture said knife between said FBS and said SBS.

12. The knife storage method of claim 11 wherein said FTE and said STE comprise threads having a lead greater than unity.

13. The knife storage method of claim 11 wherein said CRT has a circular diameter less than or equal to 2.5 inches and said CRT has an overall length less than or equal to 14 inches.

14. The knife storage method of claim 11 wherein said CRT, said FEC, and said SEC comprise plastic.

15. The knife storage method of claim 11 wherein said OTS further comprises an extruded void configured to receive a metal retention clip (MRC).

16. The knife storage method of claim 11 wherein said FKR is mechanically attached to said FEC with a fastener and said SKR is mechanically attached to said SEC with a fastener.

17. The knife storage method of claim 11 wherein said FKR and said FEC form a unitary structure and said SKR and said SEC form a unitary structure.

18. The knife storage method of claim 11 wherein said EEC and said SEC further comprise a sealing ring configured to form a non-permeable liquid barrier at the interfaces between said FEC and said FDE and between said SEC and said SDE.

19. The knife storage method of claim 11 wherein said FKS comprises a tungsten carbide knife sharpening insert (KSI) and said SKS comprises a ceramic knife sharpening insert (KSI).

20. The knife storage method of claim 11 wherein:

said FKS comprises a tungsten carbide knife sharpening insert (KSI);

said SKS comprises a ceramic knife sharpening insert (KSI);

said FEC is configured with double-sided threading; and said SEC is configured with double-sided threading.

* * * * *